United States Patent [19]

Gross et al.

[11] 3,960,707

[45] June 1, 1976

[54] SIMULATION OF CATALYTIC CRACKING PROCESS

[75] Inventors: Benjamin Gross; Solomon M. Jacob, both of Cherry Hill; Donald M. Nace, Woodbury, all of N.J.; Sterling E. Voltz, Media, Pa.

[73] Assignee: Mobil Oil Corporation, New York, N.Y.

[22] Filed: Dec. 3, 1974

[21] Appl. No.: 529,055

Related U.S. Application Data

[60] Division of Ser. No. 472,525, May 23, 1974, which is a continuation of Ser. No. 148,051, May 28, 1971, abandoned.

[52] U.S. Cl. ..... 208/113; 208/DIG. 1; 208/164; 235/151.12

[51] Int. Cl.[2] ..... C10G 9/32

[58] Field of Search ..... 208/DIG. 1, 113, 164

[56] References Cited

UNITED STATES PATENTS

| | | | |
|---|---|---|---|
| 3,175,968 | 3/1965 | Berger | 208/164 |
| 3,384,573 | 5/1968 | Gorring | 208/113 |
| 3,497,449 | 2/1970 | Urban | 208/108 |
| 3,666,932 | 5/1972 | White | 235/151.12 |

*Primary Examiner*—Herbert Levine
*Attorney, Agent, or Firm*—C. A. Huggett

[57] ABSTRACT

The specific disclosure is directed to a catalytic cracking model wherein the reactant and product species are lumped according to molecular type and boiling range. The specific invariant lumping scheme includes paraffins, naphthenes, aromatic rings, and aromatic substituent groups.

6 Claims, 33 Drawing Figures

LUMPED KINETIC SCHEME

FIG.3

MATRIX OF RATE CONSTANTS $\underset{\approx}{K}$ $$
\begin{array}{c}
 \\ P_h \\ N_h \\ A_h \\ C_{Ah} \\ P_\ell \\ N_\ell \\ A_\ell \\ C_{A\ell} \\ G \\ C
\end{array}
\begin{array}{c}
\begin{array}{ccccccccc} P_h & N_h & A_h & C_{Ah} & P_\ell & N_\ell & A_\ell & C_{A\ell} & G & C \end{array} \\
\begin{pmatrix}
-(K_{php\ell}+K_{phg}+K_{phc}) & & & & & & & & & \\
 & -(K_{nhn\ell}+K_{nhg}+K_{nhc}) & & & & & & & & \\
 & & -(K_{aha\ell}+K_{ahg}+K_{ahc}+K_{ahca\ell}) & & & & & & & \\
 & & & -(K_{cahca\ell}+K_{cahc}) & & & & & & \\
\nu_{h\ell}\ K_{php\ell} & & & & -(K_{p\ell g}+K_{p\ell c}) & & & & & \\
 & \nu_{h\ell}\ K_{nhn\ell} & & & & -(K_{n\ell g}+K_{n\ell c}) & & & & \\
 & & \nu_{h\ell}\ K_{aha\ell} & & & & -(K_{a\ell g}+K_{a\ell c}) & & & \\
 & & \nu_{h\ell}\ K_{ahca\ell} & \nu_{h\ell}\ K_{cahca\ell} & & & & -K_{ca\ell c} & & \\
\nu_{hg}\ K_{phg} & \nu_{hg}\ K_{nhg} & \nu_{hg}\ K_{ahg} & 0 & \nu_{\ell g}\ K_{p\ell g} & \nu_{\ell g}\ K_{n\ell g} & \nu_{\ell g}\ K_{a\ell g} & 0 & -K_{gc} & \\
\nu_{hc}\ K_{phc} & \nu_{hc}\ K_{nhc} & \nu_{hc}\ K_{ahc} & \nu_{hc}\ K_{cahc} & \nu_{\ell c}\ K_{p\ell c} & \nu_{\ell c}\ K_{n\ell c} & \nu_{\ell c}\ K_{a\ell c} & \nu_{\ell c}\ K_{ca\ell c} & \nu_{gc}\ K_{qc} & 0
\end{pmatrix}
\end{array}
$$

where, $\nu_{h\ell}$ = Stoichiometric coefficient (Mol. Wt. of heavy fuel oil/Mol. Wt. of light fuel oil)
$\nu_{hg}$ = " " (Mol. Wt. of heavy fuel oil/Mol. Wt. of gasoline)
$\nu_{hc}$ = " " (Mol. Wt. of heavy fuel oil/Mol. Wt. of C lump)
$\nu_{\ell g}$ = " " (Mol. Wt. of light fuel oil/Mol. Wt. of gasoline)
$\nu_{\ell c}$ = " " (Mol. Wt. of light fuel oil/Mol. Wt. of C lump)
$\nu_{gc}$ = " " (Mol. Wt. of gasoline/Mol. Wt. of C lump)

Computed Vs. Observed Time-Averaged Gasoline Yields

Computed Vs. Observed Time-Averaged C Lump Yields

Computed Vs. Observed Time-Averaged LFO Yields

Observed Vs. Computed Time-Averaged Gasoline Yields ($t_c$ = 5.0 Minutes)
As a Function of Charge Stock Observed Vs. Computed Time-Averaged Gasoline Yields ($t_c$ = 1.25 Minutes)
As a Function of Charge Stock Model Selectivity Plot for a Naphthenic Charge Stock (N3)
$t_c$ = 5.0 Minutes, Temp = 900°F Model Selectivity Plots for a Paraffinic Charge Stock (P3)
$t_c$ = 5.0 Minutes, Temp = 900°F Model Selectivity Plot for an Aromatic
Charge Stock (PA33) $t_c$ = 5.0 Minutes, Temp = 900°F Predicted Vs. Experimenal Cracking Yields at a Catalyst Residence Time of 10 Minutes Experimental Cracking Yields Vs. Computed Yields for WCMCGO with 0.1 Wt. % Addition Basic N as Quinoline Experimental Cracking Yields Vs. Computed Yields for WCMCGO with 0.2 Wt. % Addition Basic N as Quinoline Predicted Vs. Observed Ethylene Yields in Catalytic Cracking Predicted Vs. Observed Normal Butane Yields in Catalytic Cracking

SIMULATION OF CATALYTIC CRACKING PROCESS

This is a division of application Ser. No. 472,525 filed May 23, 1974, which application is a continuation of Ser. No. 148,051 filed May 28, 1971 now abandoned.

BACKGROUND OF THE INVENTION

1. Field of the Invention

The present invention is directed to a method and a system for simulating a catalytic cracking process. More particularly, the present invention is directed to a kinetic computer model for a catalytic cracking process.

2. Description Of The Prior Art

In a refinery operation such as a fluid catalytic cracking system, the number of different molecules involved runs into the thousands. Consequently, it is impossible, or at least greatly impractical, to investigate each of the thousands of molecules to determine the kinetics of a system or to characterize feed stocks or products. However, it is known to partition molecules into a number of classes and then to consider each class as an independent entity. For example, it is possible to consider all oxygen molecules as "oxygen", even though the kinetic energies of the individual oxygen molecules are different. Such grouping or lumping is used in a standard petroleum processing analysis known as PONA, in which all species are divided into 4 classes: paraffins, olefins, naphthenes and aromatics.

SUMMARY OF THE INVENTION

In accordance with the present invention, there is provided a method for simulation of a catalytic cracking process for the conversion of the hydrocarbon feed stream wherein the stream is contacted with an active catalyst in a reactor maintained under catalytic conversion conditions to provide reaction products which are removed from the reactor. The catalyst in the reactor becomes contaminated by the deposition of coke thereon. The simulation method comprises programming an automatic processing system to (a) generate rates of change of hydrocarbon reactants in the reactor in accordance with:

$$\frac{d\underset{\sim}{a}}{dt} = Q\underset{\approx}{K}\,\underset{\sim}{a}$$

where $$\frac{d\underset{\sim}{a}}{dt} = \text{rates of reaction,}$$

Q = catalyst properties and process variables, $\underset{\approx}{K}$ = matrix of reaction rate constants lumped kinetically and according to boiling range, and $\underset{\sim}{a}$ = composition vector of reactants and product species lumped according to molecular type and boiling range, and, b. generate the composition vector $\underset{\sim}{a}$ as a function of reaction time.

In accordance with another aspect of the present invention, there is provided a system for simulating a catalytic cracking process for the conversion of a hydrocarbon feed stream wherein the stream is contacted with an active catalyst in a reactor maintained under catalytic conversion conditions to provide reaction products which are removed from the reactor. The catalyst in the reactor becomes contaminated by the deposition of coke thereon. The system comprises processing means programmed to generate rates of change of hydrocarbon reactants in the reactor in accordance with:

$$\frac{d\underset{\sim}{a}}{dt} = Q\underset{\approx}{K}\,\underset{\sim}{a}$$

where $$\frac{d\underset{\sim}{a}}{dt} = \text{rates of reaction,}$$

Q = catalyst properties and process variables, $\underset{\approx}{K}$ = matrix of reaction rate constants lumped kinetically and according to boiling range, and $\underset{\sim}{a}$ = composition vector of reactants and product species lumped according to molecular type and boiling range.

The processing means is further programmed to generate the composition vector a as a function of reaction time.

BRIEF DESCRIPTION OF THE DRAWINGS

FIG. 3 is a matrix of rate constants for a specific embodiment of the present invention.

DESCRIPTION OF SPECIFIC EMBODIMENTS

Figure 1:
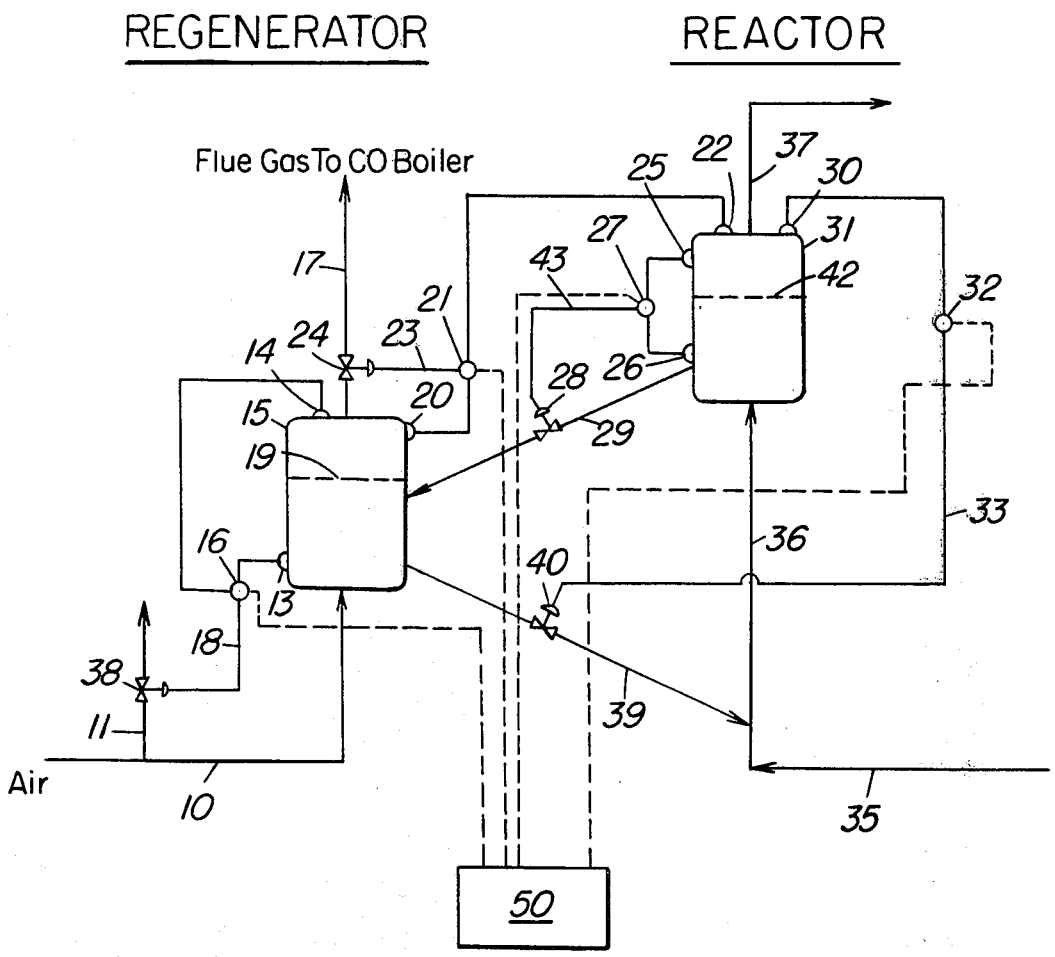
FIG. 1 is a block diagram of a catalyst section of a fluid catalytic cracking process.

FIG. 1 shows the essentials of a typical catalysts section control system wherein fresh hydrocarbon feed which can include recycle oil from a fractionator (not shown) is applied by a line 35 to the lower end of a riser line 36. Heated regenerated catalyst from a standpipe 39 having a control 40 is combined with the oil in the riser line 36 such that an oil-catalyst mixture rises in an ascending dispersed stream to the lower end of a reactor 31. In the reactor 31, there may be further fluidized contacting between the oil and the catalyst particles within a relatively dense fluidized bed diagrammatically represented below the dashed line 42. Generally, a major portion of the necessary cracking and contact of the oil with the catalyst takes place in the riser 36.

At the upper end of the reactor, the catalyst particles are separated from the vaporous cracked reaction products by cyclone separating means (not shown). The reaction products are transferred overhead by a line 37 to a products recovery section which includes at least one fractionator (not shown). A stream of spent or coked catalyst is continuously passed from the reactor 31 to a regenerator 15 by a spent catalyst transfer line 29 having a control valve 28 such that the catalyst is transferred to the regenerator 15 at a controlled rate.

In the regenerator 15, the carbonized or coked catalyst particles are subjected to oxidation and carbon removal in the presence of air being introduced to the regenerator by a line 10. A bypass line 11 having a control valve 38 is connected to the line 10 to vent a portion of the air being introduced into the regenerator 15 and thus regulate the flow rate of air.

In the lower portion of the regenerator 15, a fluidized dense phase bed diagrammatically represented as below the dashed line 19 provides for contact between the coked catalyst particles and the oxidizing air stream. In the upper portion of the regenerator 15, as light phase zone permits the separation of catalyst particles by suitable centrifugal separating means (not shown) from a flue gas stream being discharged from the regenerator 15 by a line 17 having a control valve 24 therein. The line 17 vents the regenerator flue gas or feeds the flue gas to a carbon monoxide boiler (not shown) where the carbon monoxide is converted to carbon dioxide.

A level controller 27 is connected by level indicating taps 25, 26 to the side wall of the reactor 31. A control line 43 from the level controller 27 is connected to the valve 28 in the transfer line 29 to control the flow rate of catalyst through the transfer line 29. Thus, the dense phase bed 42 level and quantity of catalyst in the lower portion of the reactor 31 are maintained at desired values. A temperature controller 32 is connected to a temperature indicating means 30 at the upper portion of the reactor 31, and generates a control signal on a line 33 to control the setting of the valve 40. Thus, a variable quantity of hot regenerated catalyst may be withdrawn from the standpipe 39 to the riser line 36 to maintain a predetermined reactor temperature as defined by the set point of the temperature controller 32.

A pressure sensitive means 22 is positioned in the upper part of the reactor 31, and another pressure sensitive means 20 is positioned in the upper portion of the regenerator 15. The pressure sensitive means 20, 22 are connected to a differential pressure regulator 21 having an adjustable set point to maintain a desired differential pressure between the reactor 31 and the regenerator 15. The differential pressure regulator 21 is connected by a line 23 to the control valve 24 in the line 17 to regulate the flue gas flow through the line 17 and in turn vary the internal pressure within the upper portion of the regenerator 15 to thereby maintain the desired pressure difference between the reactor 31 and the regenerator 15. Generally, the pressure differential between the reactor 31 and the regenerator 15 is relatively low, for example, in the order of about 6 psi, and is necessary to permit the maintenance of suitable pressure differentials across the slide valves 28, 40 in the spent catalyst transfer line 29 and in the standpipe 39 to thus provide for a continuous circulation of catalyst particles between the reactor 31 and the regenerator 15.

Temperature indicating means 13, 14 within the lower and upper portions of the regenerator 15 are connected to a differential temperature controller 16, which in turn is connected by a line 18 to the valve 38 in the air vent line 11. Thus, when the temperature differential between the lower and the upper portions of the regenerator 15 varies from a predetermined differential as defined by the set point of the differential pressure controller 16, the valve 38 in the vent line 11 is adjusted to control the amount of air flowing in the line 10 to the lower portion of the regenerator 15.

In accordance with an aspect of the present invention, there is provided a lumped invariant kinetic model 50 for catalytic cracking processes. The model 50 contains an invariant kinetic scheme of simultaneous and consecutive reactions to predict the product yields produced in the reactor such as that shown in FIG. 1. The yields predicted in this specific embodiment are gasoline, light fuel oil, and light ends + coke (C lump). Correlation methods based on certain kinetic principles are used to break the C lump into individual light ends and coke.

The lumping scheme groups kinetically similar molecules or components according to boiling range of the molecules or components. The lumping scheme according to a specific embodiment is based on the concentrations of paraffins, naphthenes, aromatic rings, and aromatic substituent groups (paraffinic and naphthenic groups attached to aromatic rings) in the charge stock in line 35 and appears adequate to predict the major product yields in the cracking of widely different charge stocks under a broad range of process conditions. Gas oils of wide boiling range have thousands of compounds of different molecular structures and molecular weights. However, the kinetic behavior of so many different molecules can be reasonably accounted for by such a relatively simple lumping scheme in accordance with this specific embodiment. The product yields of virgin gas oils can be adequately predicted by the simple lumping scheme of paraffins, naphthenes, and aromatics; however, it is necessary to split the aromatics into aromatic rings and aromatic substituent groups to include recycle feedstocks in the model. This is not unexpected, since the molecular compositions of recycle feeds are significantly different from those of virgin gas oils. Recycle feedstocks are generally recycled from the fractionator (not shown) downstream on line 37, and are combined with the fresh charge stock in the line 35.

In addition to the lumping scheme, other factors have been incorporated into the model of the present embodiment to account for process variables and other related phenomena. A catalyst decay term is provided to account for the rapid deactivation of the catalyst which occurs during the catalytic cracking of gas oils in the line 36 and the reactor 31. Other features are an adsorption term for nitrogen poisoning, activation energies, molecular weight, residual carbon on regenerated catalyst in the line 39, and some catalyst effects.

Lumping and Reaction Scheme

Figure 2:
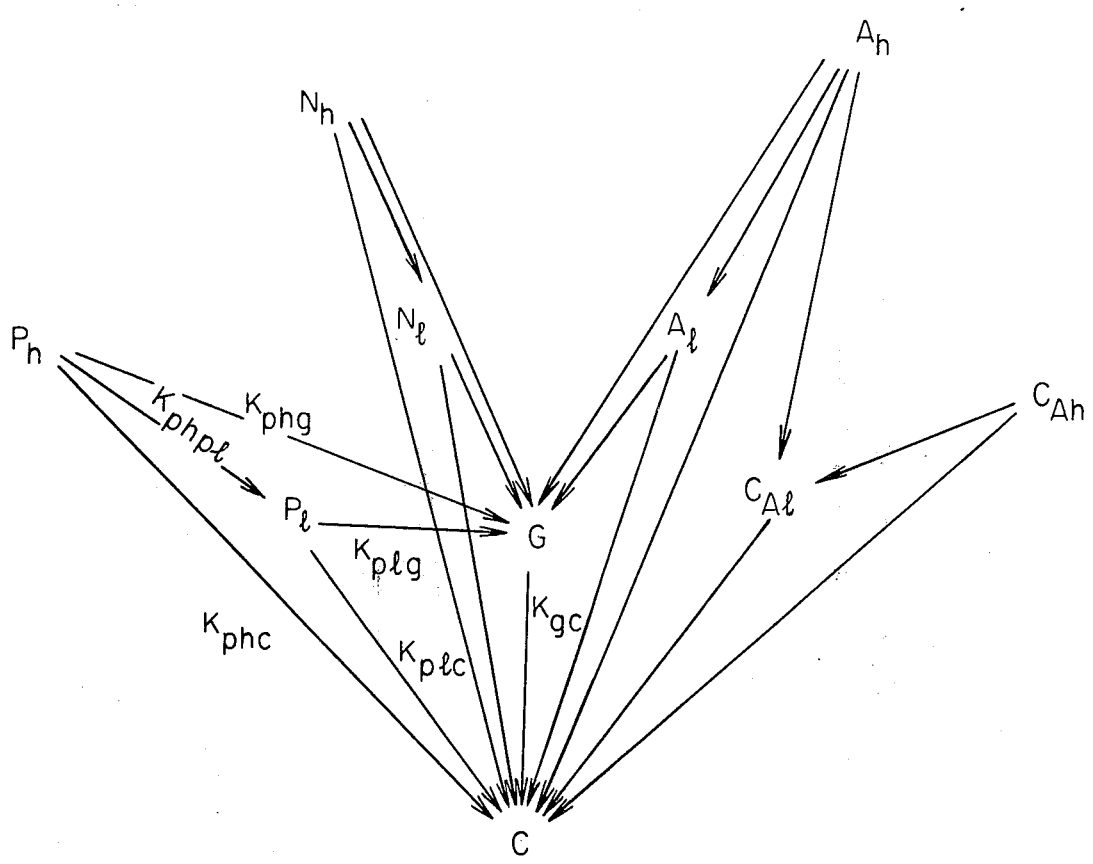
FIG. 2 shows a kinetic scheme for a specific embodiment of the present invention.

The lumped invariant kinetic model for fluid catalytic cracking such as shown in FIG. 1 consists of a kinetic scheme shown in FIG. 2. With reference to FIG. 2, ten lumps are provided to follow the cracking of virgin gas oils and recycle oil charge stocks. The lumps of FIG. 1 are:

$P_l$ = Wt. % paraffinic molecules, (mass spec analysis), 430°–650°F $N_l$ = Wt. % naphthenic molecules, (mass spec analysis), 430°–650°F $C_{Al}$ = wt. % carbon atoms among aromatic rings, (n-d-M method), 430°–650°F

$A_l$ = Wt. % aromatic substituent groups (430°–650°F)

$P_h$ = Wt. % paraffinic molecules, (mass spec analysis), 650°F$^+$ $N_h$ = Wt. % naphthenic molecules, (mass spec analysis), 650°F$^+$ $C_{Ah}$ = Wt. % carbon atoms among aromatic rings, N-d-M method, 650°F$^+$ $A_h$ = Wt. % aromatic substituent groups (650°F$^+$)

$G = G$ lump ($C_5^+ - 430°F$)
$C = C$ lump ($C_1$–$C_4$ + coke)
$C_{Al} + P_l + N_l + A_l = LFO$ (430°F – 650°F)
$C_{Ah} + P_h + N_h + A_h = HFO$ (650°F+)

Adapted Nomenclature for rate constants is detailed in the FIG. 2 for paraffinic molecules. Similar rules apply for the other reaction steps.

This lumping scheme successfully treats gasoline (G lump, $C_5$+ –430°F), C lump ($H_2$, $H_2S$, $C_1$–$C_4$, + coke), light fuel oil, LFO, (430–650°F) yields resulting from gas oil cracking. It will be noted that the total wt.% conversion is just the sum of the G and C lumps. Detailed composition changes resulting in the light fuel oil, LFO, (430°–650°F) and heavy fuel oil, HFO, (650°F+) are obtained by following the concentrations of paraffinic, naphthenic, aromatic rings, and aromatic substituent groups as the gas oil proceeds to crack. The split of aromatics is necessary for the inclusion of recycle charge stocks in the model. This split permits closing of the recycle loop and iterating about a recycle composition until convergence is established.

The kinetic scheme of FIG. 2 shows that a paraffinic molecule in HFO will form paraffinic molecules in LFO ($P_h - P_l$) and molecules in G lump ($P_h - G$) and C lump ($P_h - C$). Paraffinic molecules in LFO can only crack to molecules in G lump ($P_l - G$) and in C lump ($P_l - C$).

Likewise a naphthenic molecule in HFO can form a naphthenic molecule in LFO and molecules in the G and C lumps. This is popularly designated as saying there is "no interaction" between the paraffinic, naphthenic, and aromatic groups.

The side chains and naphthenic rings attached to the aromatic rings react similarly, except for a single interaction step which allows $A_h - C_{al}$. This is the only interaction reaction step in the model, and is designated by the rate constant $K_{ahcal}$ in a matrix of rate constants shown in FIG. 3. The aromatic rings in the HFO ($C_{Ah}$) and LFO ($C_{Al}$) do not form gasoline, but result in the formation of the C lump and are primarily manifested as the coke contribution to the C lump. In the present model, no distinction is made between P, N, A molecules in the gasoline fraction; consequently, all the gasoline molecules are lumped together with a single cracking rate. The matrix of rate constants shown in FIG. 3 is a lower triangular and is a consequence of the irreversible nature of the postulated cracking kinetic network. Irreversible reactions lend themselves to stepwise solution and considerable advantage is derived from this fact when determining the rate constants.

Nomenclatures for terms used in the present application is listed in Appendix I which forms part of the present specification.

REACTOR MODEL FLUIDIZED DENSE BED

The rate of reaction for a mixture of hydrocarbons is a function of catalyst properties and process variables, and of charge stock composition. In accordance with the present invention, the rate of reaction can be represented as the following equation.

$$\frac{d\underset{\sim}{a}}{dt} = Q\underset{\approx}{K}\,\underset{\sim}{a}$$

where $\frac{d\underset{\sim}{a}}{dt}$ = rates of reaction,

Q = catalyst properties and process variables,
$\underset{\approx}{K}$ = matrix of reaction rate constants lumped kinetically and according to boiling range, and
$\underset{\sim}{a}$ = composition vector of reactants and product species lumped according to molecular type and boiling range.

A specific fluid catalytic cracking reactor model in accordance with the present invention includes nonlinear differential equations which describe the behavior of the feedstock composition vector in a plug flow vapor phase, fluid catalyst reactor with time-decaying non-diffusion limited fluid catalyst at atmospheric pressure. Plug flow vapor phase assumes that there is no change in composition across any cross-section of the reactor. In matrix notation these equations are $$\frac{d\underset{\sim}{a}}{dX} = \frac{1}{1 + K_{Ah}\,C_{Ah}}\;\frac{P\,\overline{MW}}{RT}\;\frac{\Phi(t_c)}{S_{WH}}\,\underset{\approx}{K}\,\underset{\sim}{a}$$

where $\underset{\sim}{a}$ = composition vector consisting of j lumped species ($a_j$ = moles j/g gas)

$$= \begin{pmatrix} P_h \\ N_h \\ A_h \\ C_{Ah} \\ P_l \\ N_l \\ A_l \\ C_{Al} \\ G \\ C \end{pmatrix}$$

X = dimensionless reactor length.
P = absolute pressure (atmospheres).
R = gas constant (82.05 atm. cm³/g-mole °K).
T = absolute temperature (°K).

$\overline{MW}$ = mean molecular weight of the mixture = $\frac{1}{\Sigma_j a_j}$.

$S_{WH}$ = true weight hourly space velocity (g feed/g catalyst-hr).

$\underset{\approx}{K}$ = matrix of invariant rate constants (g catalyst/cm-$^3)^{-1}$ (hr)$^{-1}$. a function of T, catalyst type, residual carbon on regenerated catalyst, Basic N poison, pressure, metals, etc. The effects of temperature; Basic N poisoning, catalyst type and residual carbon on regenerated catalyst on the $\underset{\approx}{K}$ matrix are detailed in their corresponding sections.

$t_c$ = time from start of run, hr.

$\Phi(t_c)$ = catalyst decay as a function of catalyst residence time, $\frac{1}{1 + \beta t_c^{\gamma}}$ where $\beta$ and $\gamma$ are constants.

$K_{Ah}$ = absorption term associated with the concentration of aromatic rings in the 650°F+ fraction, ($C_{Ah}$)

A detailed development of the reactor model is included in Appendix II, and a program listing is in Appendix III of the specification.

Determination of Rate Constants

A pattern search technique was used to determine the rate constants, K, from experimental data. The data supplied to the program consisted of 63 sets of isothermal cracking data at 900°F in a fluidized dense bed. These were obtained on 15 charge stocks with widely different boiling ranges and compositions. The ranges of charge stock composition, process variables, and resulting yields are given in Table 1. It should be noted that all the experimental data presented are time-averaged data. Further, it should be understood that throughout this application "conversion" or "yields" imply "time-averaged conversion" and "time-averaged yields".

The function used to measure "goodness of fit" is $$f=\sqrt{\frac{\sigma_G^2+\sigma_C^2+0.3\,\sigma_L^2}{N_D-N_P}}$$

where $\sigma_G^2$, $\sigma_C^2$, and $\sigma_L^2$ are the sums of the squares of the deviations over all experimental points for G lump, C lump, and LFO, respectively.

$N_D$ is the number of data points.

$N_P$ is the number of parameters used in the estimation.

Table 1

Range of Charge Stock Composition, Process Variables, And Resulting Yields Used in Fitting the Model Parameters

| | Range | |
|---|---|---|
| Conversion (G lump + C lump) Wt. % | 30.5 | - 82.1 |
| G lump ($C_5^+$ —430°F) Wt. % | 20.0 | - 59.4 |
| C lump ($H_2$, $H_2S$, $C_1$–$C_4$, + coke) Wt. % | 9.1 | - 25.2 |
| LFO (430–650°F) | 14.0 | - 43.0 |
| Total Paraffins in Charge Stock (Wt. %) | 8.6 | - 51.9 |
| Total Naphthenes in Charge Stock (Wt. %) | 14.2 | - 68.8 |
| Total Aromatic Rings in Charge Stock (Wt. %) | 6.1 | - 45.0 |
| Total Aromatic Substituent Groups | 5.6 | - 23.5 |
| Molecular weight of charge stock | 206 | - 402 |
| Boiling Range (°F) | 430 | - 1000 |
| Catalyst Residence Time (Min.) | 1.25, | 5.0 |
| Catalyst/Oil Ratio (Wt.) | 1.25 | - 6.0 |
| Temperature (°F) | 900 | |
| Nitrogen Dilution (Mole %) | 10 | |
| Pressure (psig) | 0 | |

Figure 4:
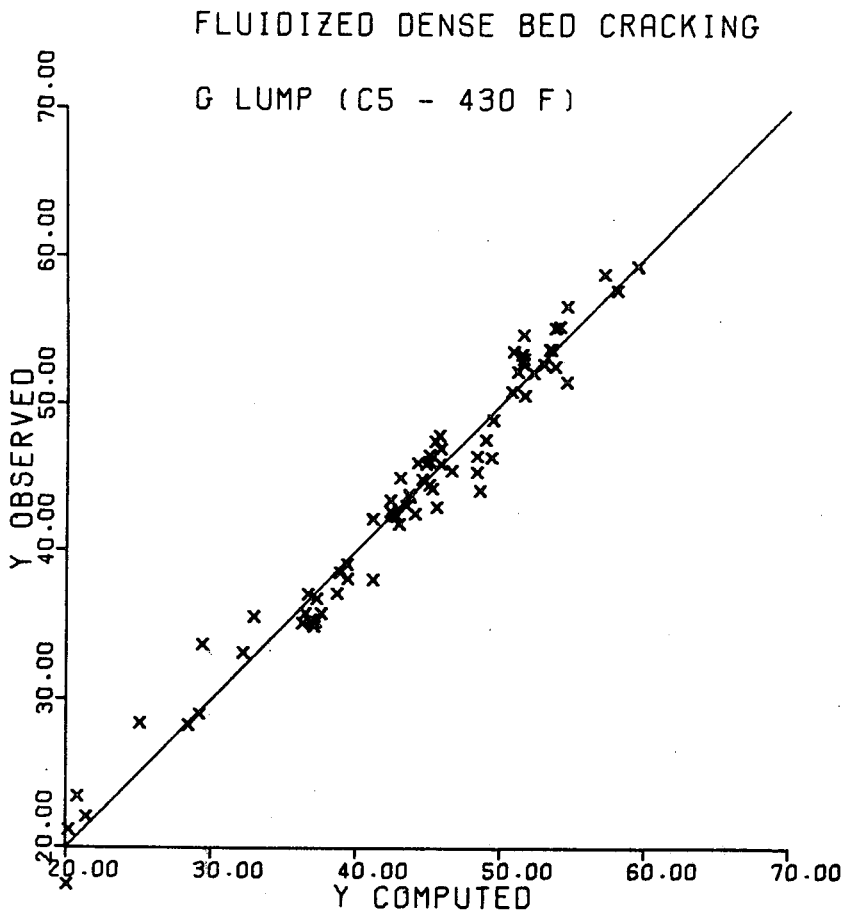
FIGS. 4 through 33 are graphs of computer generated data.
Figure 5:
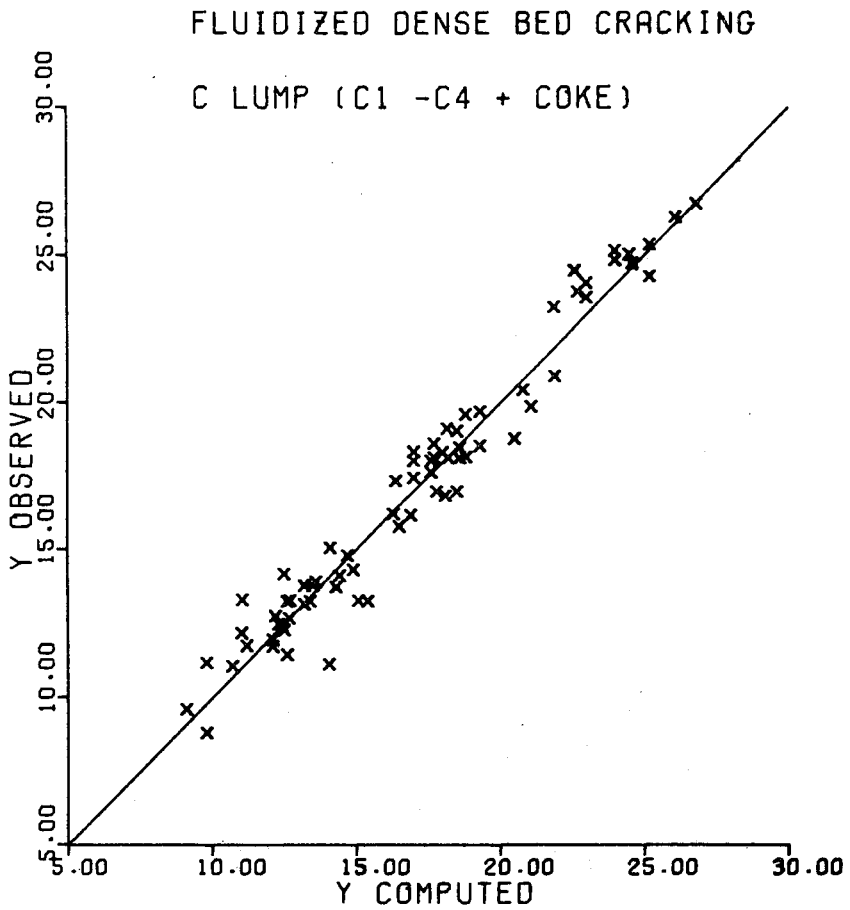
Figure 6:
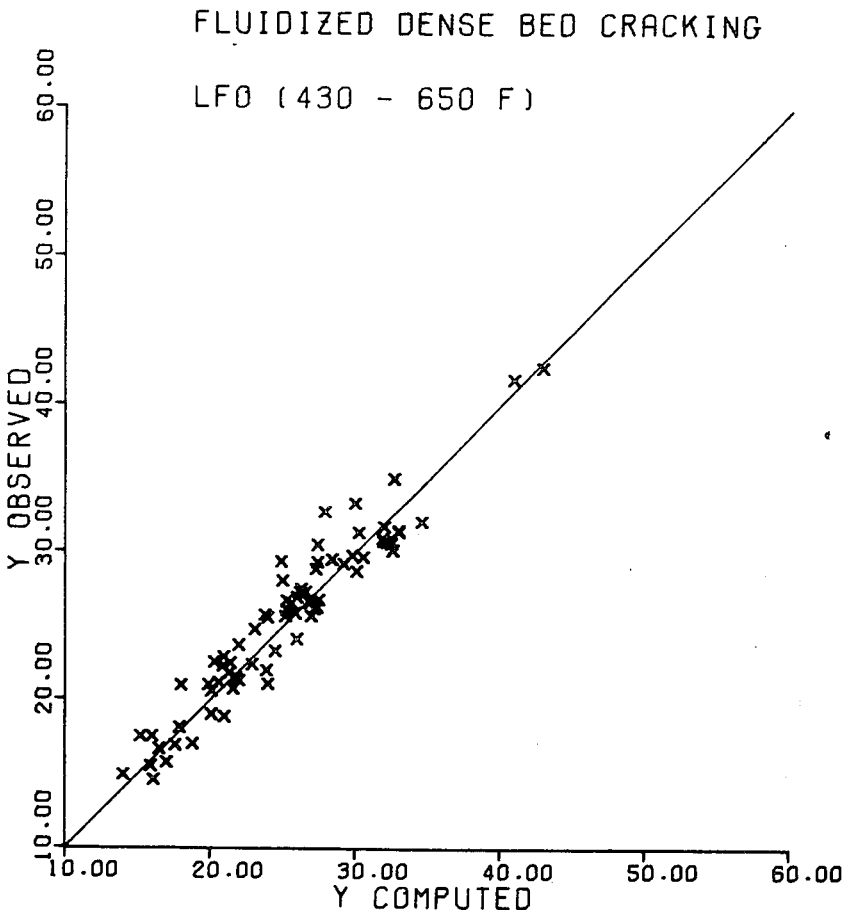

Plots of observed vs. computed yields of gasoline, C lump, and LFO are shown in FIGS. 4, 5 and 6. The best fit occurs where f is a minumum.

The economics of cracking suggest that more importance be attached to the G lump and C lump fit as compared to the fit on LFO. Hence less significance is attached to the sum of the squares of deviations for LFO. This allows the LFO, G lump, and C lump to be fitted simultaneously, yet the deviations on the LFO fit will not excessively sway the G lump and C lump fit. The best set of parameters is shown in Table 2. The reactions have been grouped into four types of reactions to facilitate further discussion. With a weighting of 30% applied to LFO deviations, it may be seen from Table 2 that the average and standard error for gasoline and LFO are comparable. Heavier weighting on LFO will result in a better fit on LFO at the expense of the fit on gasoline and C lump.

Table 2

Model Parameters

| G Lump (Gasoline Formation Reactions | | Best Parameters |
|---|---|---|
| $K_{alg}$ | (g catalyst/cm³)⁻¹ (hr)⁻¹ | $18.50 \times 10^3$ |
| $K_{ahg}$ | | $63.00 \times 10^3$ |
| $K_{nlg}$ | | $66.15 \times 10^3$ |
| $K_{nhg}$ | | $84.70 \times 10^3$ |
| $K_{plg}$ | | $23.85 \times 10^3$ |
| $K_{phg}$ | | $55.00 \times 10^3$ |
| C Lump Formation Reactions | | |
| $K_{alc}$ | | $3.63 \times 10^3$ |
| $K_{ahc}$ | | $34.20 \times 10^3$ |
| $K_{nlc}$ | | $8.18 \times 10^3$ |
| $K_{nhc}$ | | $14.87 \times 10^3$ |
| $K_{plc}$ | | $9.44 \times 10^3$ |
| $K_{phc}$ | | $7.85 \times 10^3$ |
| $K_{calc}$ | | $1.00 \times 10^3$ |
| $K_{cahc}$ | | $14.63 \times 10^3$ |
| Gasoline Cracking Reaction | | |
| $K_{gc}$ | | $4.4 \times 10^3$ |
| LFO Formation Reactions | | |
| $K_{ahal}$ | | $19.00 \times 10^3$ |
| $K_{nhnl}$ | | $22.50 \times 10^3$ |
| $K_{phpl}$ | | $20.70 \times 10^3$ |
| $K_{cahcal}$ | | $5.86 \times 10^3$ |
| $K_{ahcal}$ | | $50.00 \times 10^3$ |
| Heavy Aromatic Ring Adsorption Constant $K_{Ah}$, (Wt. % $C_{Ah}$)⁻¹ | | 0.128 |
| Catalyst Deactivation, $\frac{1}{1+3t_c^{\gamma}}$, dimensionless | | |
| $\beta$ ($t_c$ in hours) | | 162.15 |
| $\gamma$ | | 0.76 |
| Average Absolute Error (G lump), Wt. % | | 1.26 |
| Average Absolute Error (C lump), Wt. % | | 0.69 |
| Average Absolute Error (LFO) , Wt. % | | 1.41 |

Table 2-continued

| Model Parameters<br>G Lump (Gasoline Formation Reactions | Best Parameters |
|---|---|
| Standard Error (G lump), $\sqrt{\frac{\sigma_G^2}{N_D-N_G}}$, Wt. % | 1.78 |
| Standard Error (C lump), $\sqrt{\frac{\sigma_G^2}{N_D-N_C}}$, Wt. % | 0.95 |
| Standard Error (LFO), $\sqrt{\frac{\sigma_G^2}{N_D-N_L}}$, Wt. % | 1.90 |

$N_D$ = No. of data points
$N_G$ = No. of parameters associated with the G lump fit
$N_C$ = No. of parameters associated with the C lump fit
$N_L$ = No. of parameters associated with the LFO fit It is interesting to compare some of the rate constants listed in Table 2 with the known kinetics of the catalytic cracking of pure hydrocarbons and classes of hydrocarbons. The rate constants for the cracking of the heavy fuel oil fractions of the P, N, and A lumps to gasoline are greater than the respective ones for the light fuel oil fractions. This is quite reasonable as the cracking rates of most paraffins and naphthenes increase with increasing molecular weight.

The aromatic substituent groups in heavy fuel oil ($A_h$) have the highest rate constant ($K_{ahc}$) for C lump formation. This is consistent with the high cracking rate of side chain alkyl groups particularly $C_3$ and $C_4$ and the high coking tendency of 3 and 4 membered ring aromatic compounds. Consider the refractory aromatic rings in LFO ($C_{Al}$). This lump should exhibit smaller coke forming and cracking tendencies ($K_{calc}$) compared to the higher boiling aromatic fractions. The ratios of the resepctive rate constants for gasoline formation to the corresponding ones for C lump formation are an approximate measure of the selectivity of each lump for gasoline formation. The cracking of gasoline to C lump ($K_{gc}$) is considerably smaller than the rate constants for formation as would be expected.

Further, significance of these rate constants may be gleaned from the next section where predicted and experimental yields are discussed for paraffinic, naphthenic, aromatic, and recycle charge stocks.

Comparison of Predicted Product Yields with Experimental Results

Some comparisons of time-averaged predicted versus time-averaged observed product yields for the G lump, C lump, and light fuel oil are shown in FIGS. 4, 5, and 6, respectively. These data were used for the computation of the rate constants given in Table 2. The agreement is extremely good for all 15 widely different charge stocks used in the calculations of the rate constants. The results represent wide ranges of charge stock properties, reaction conditions, and conversion levels.

Figure 7:
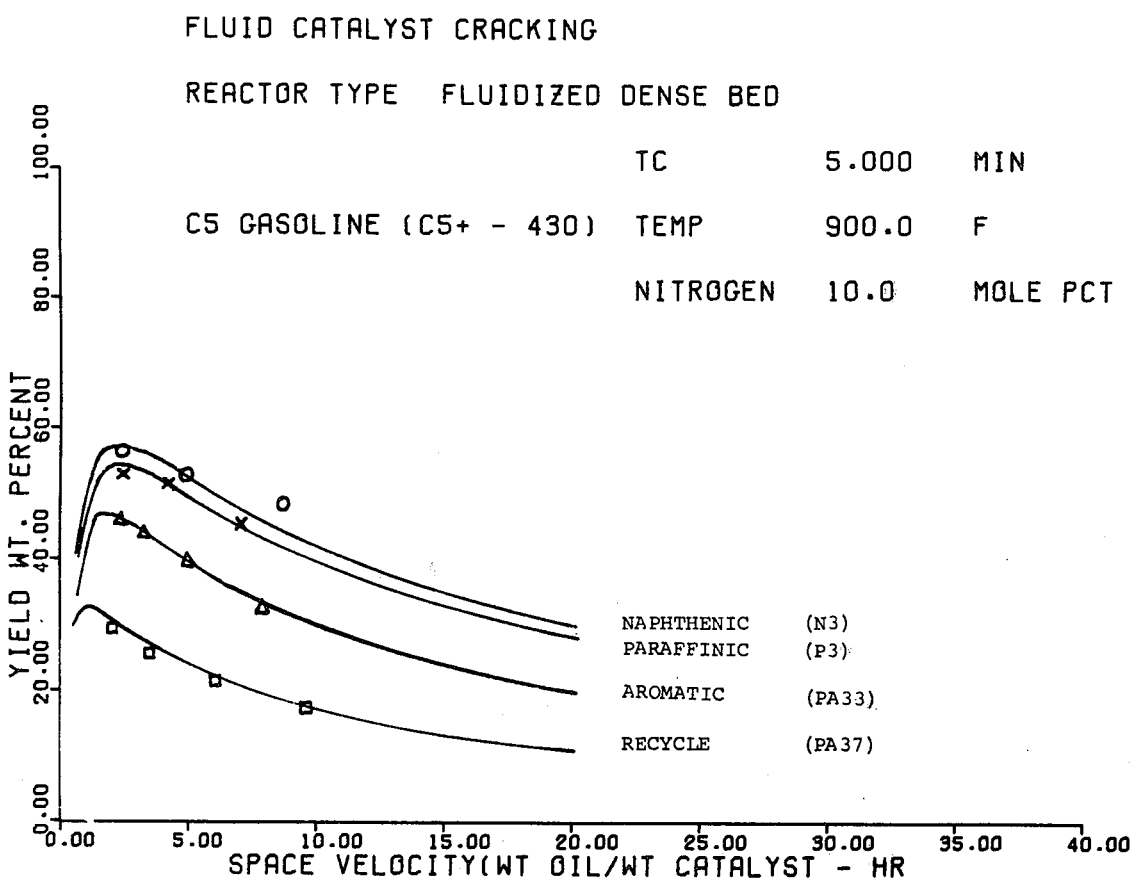
Figure 8:
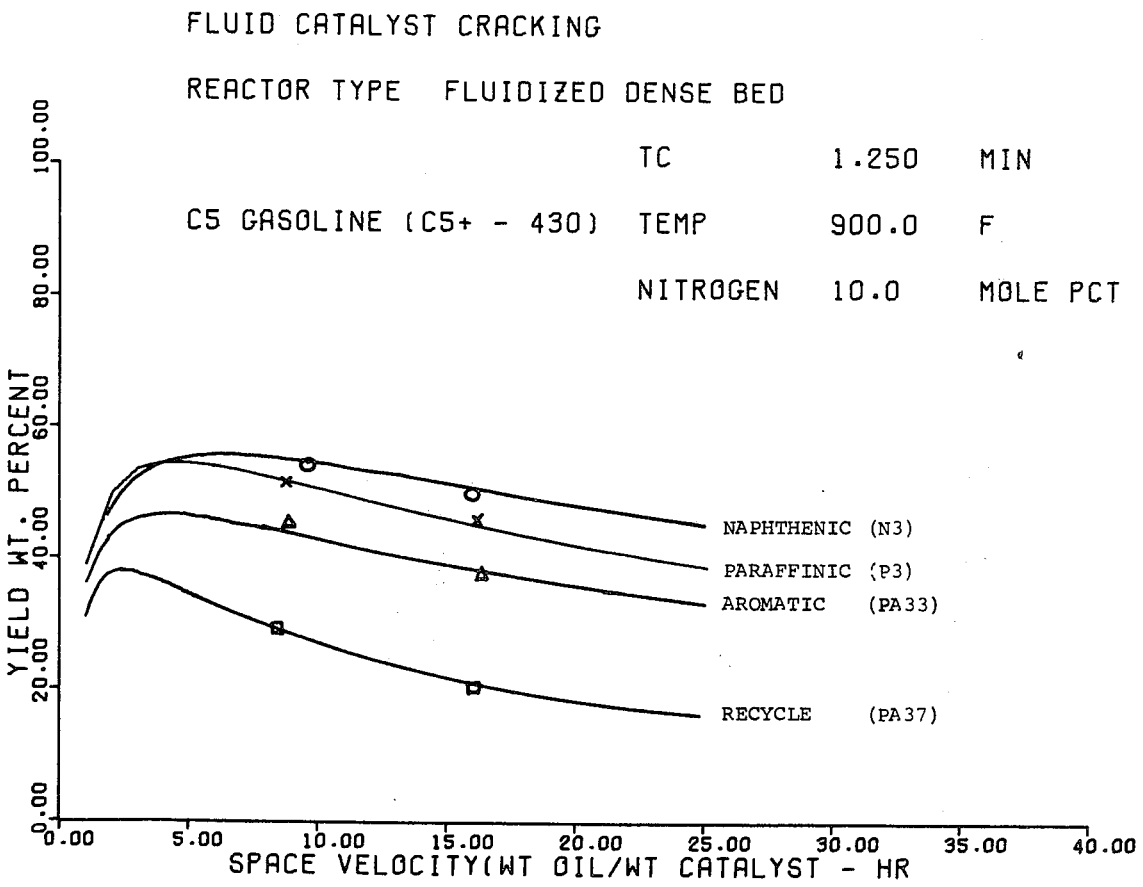

Plots of gasoline yields versus space velocity are given for four different charge stocks in FIGS. 7 and 8. The catalyst residence times are 5.0 to 1.25 minutes, respectively, in these plots. The points are the experimental data for each charge stock and the solid curves were calculated from the mode. N3 is a highly naphthenic charge stock and gives the greatest yields of gasoline. The highly paraffinic charge stock, P3, gives gasoline yields only slightly lower than N3. Both the highly aromatic (PA 33) and recycle (PA 37) charge stocks give much lower gasoline yields. The side chains on aromatic rings crack quite readily, but aromatic rings are very stable and are extremely resistant to cracking reactions. Recycle charge stocks consist largely of refractory aromatic molecules and as expected give very low yields of cracked products.

Figure 9:
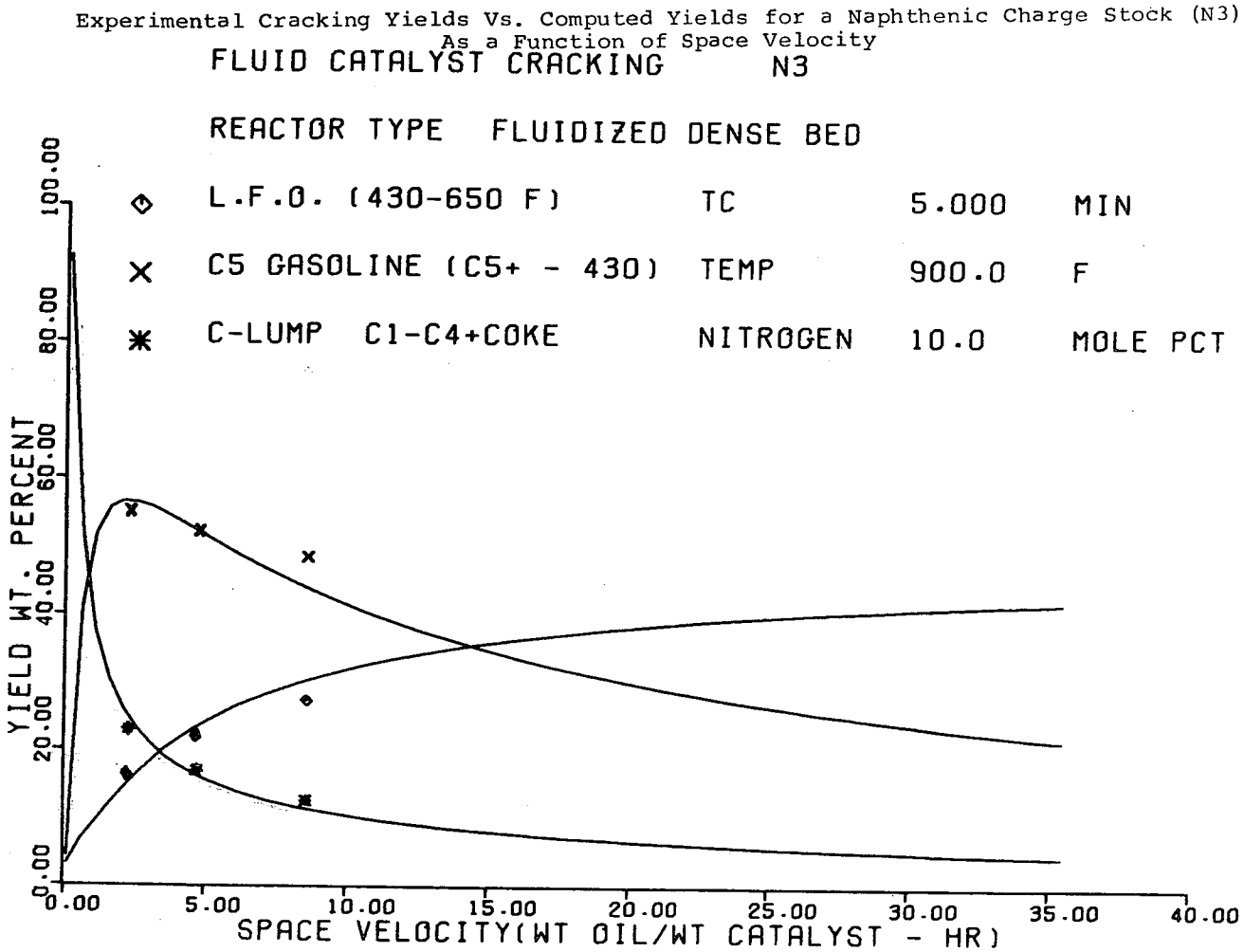

Some detailed yield data for N3 are given in FIG. 9 which contains plots of gasoline, C lump, and light fuel oil versus space velocity. The yield of gasoline goes through a maximum. The C lump increases with decreasing space velocity and the light fuel oil decreases. The agreements between the calculated and experimental results are very good.

Figure 10:
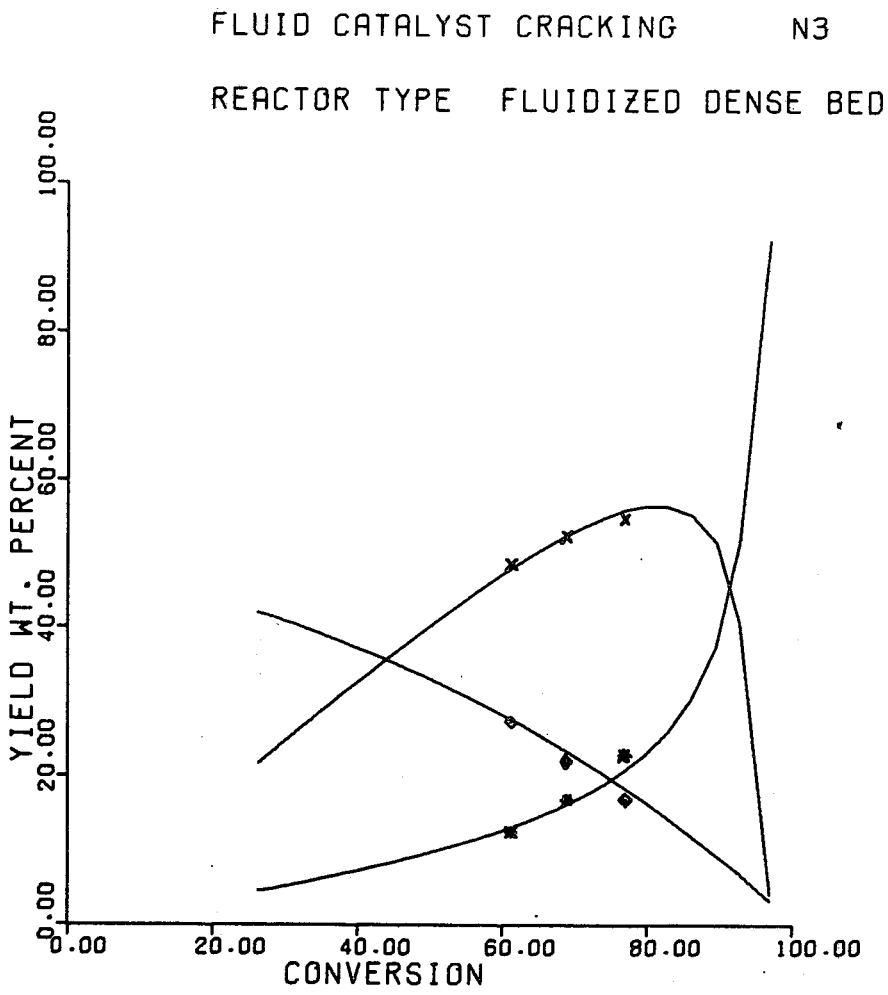
Figure 11:
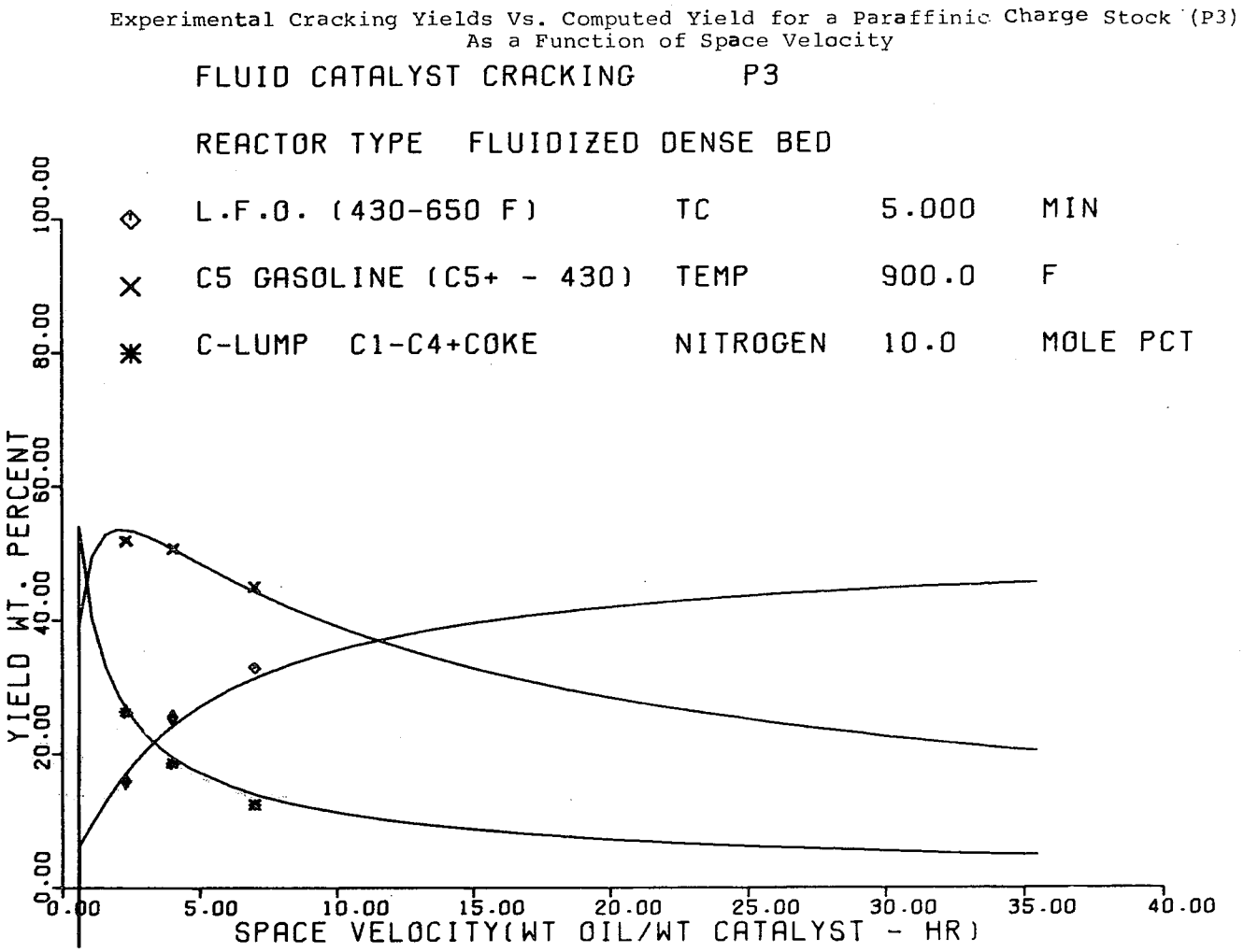
Figure 12:
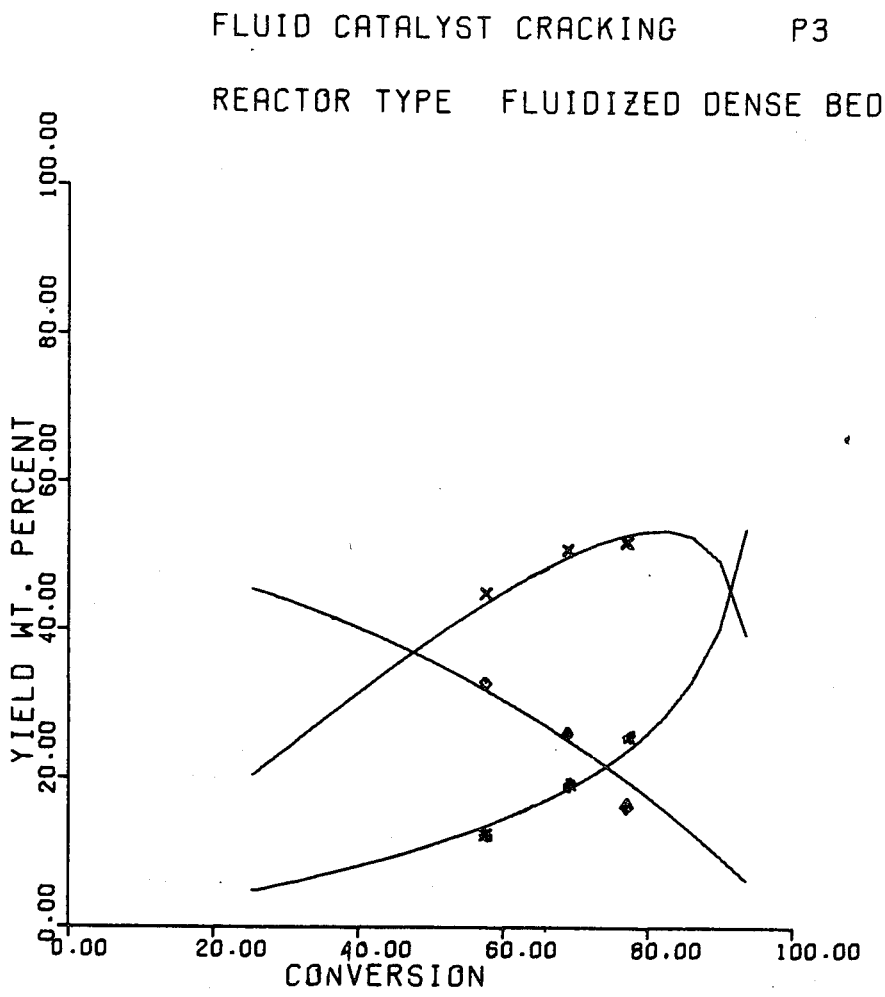
Figure 13:
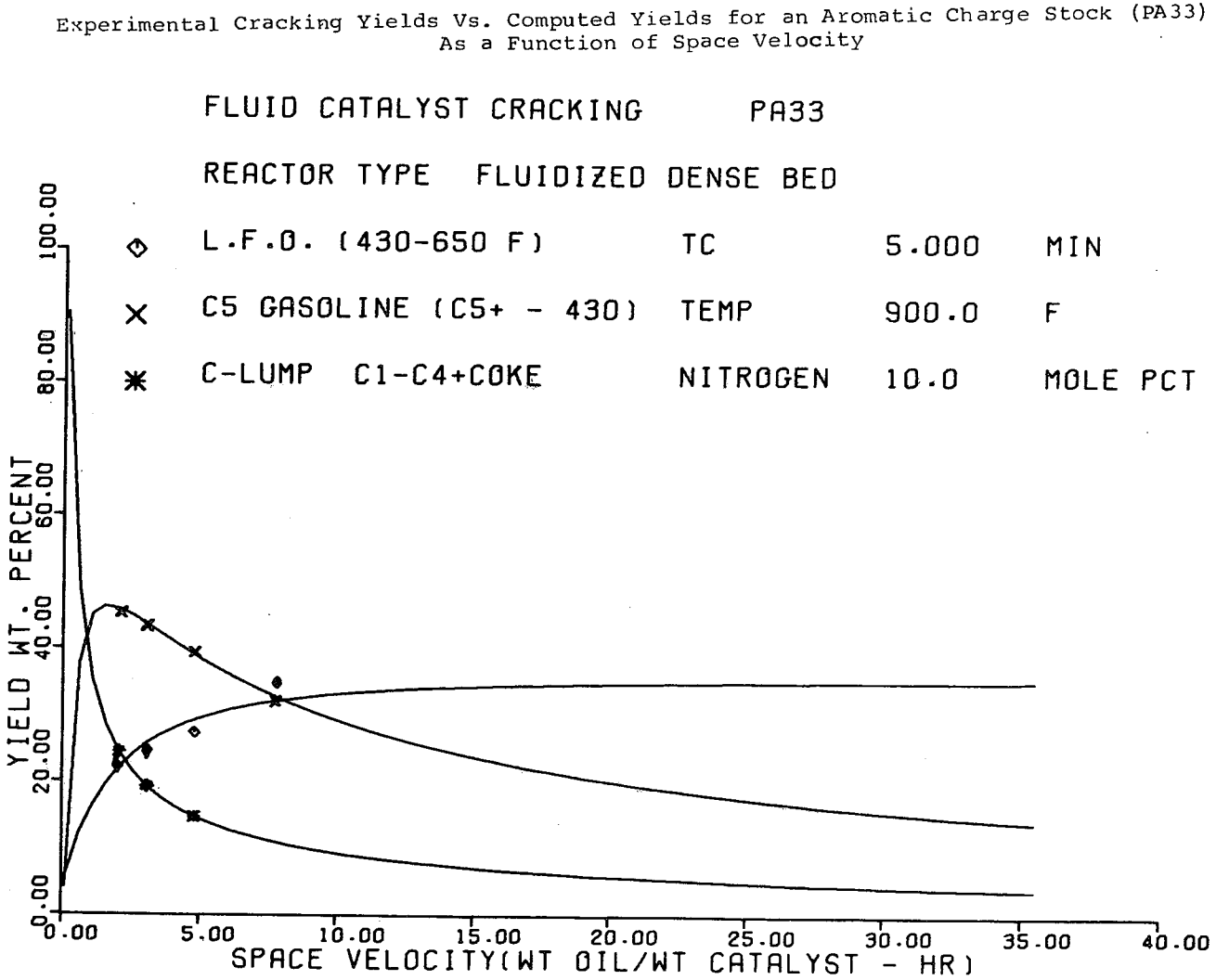
Figure 14:
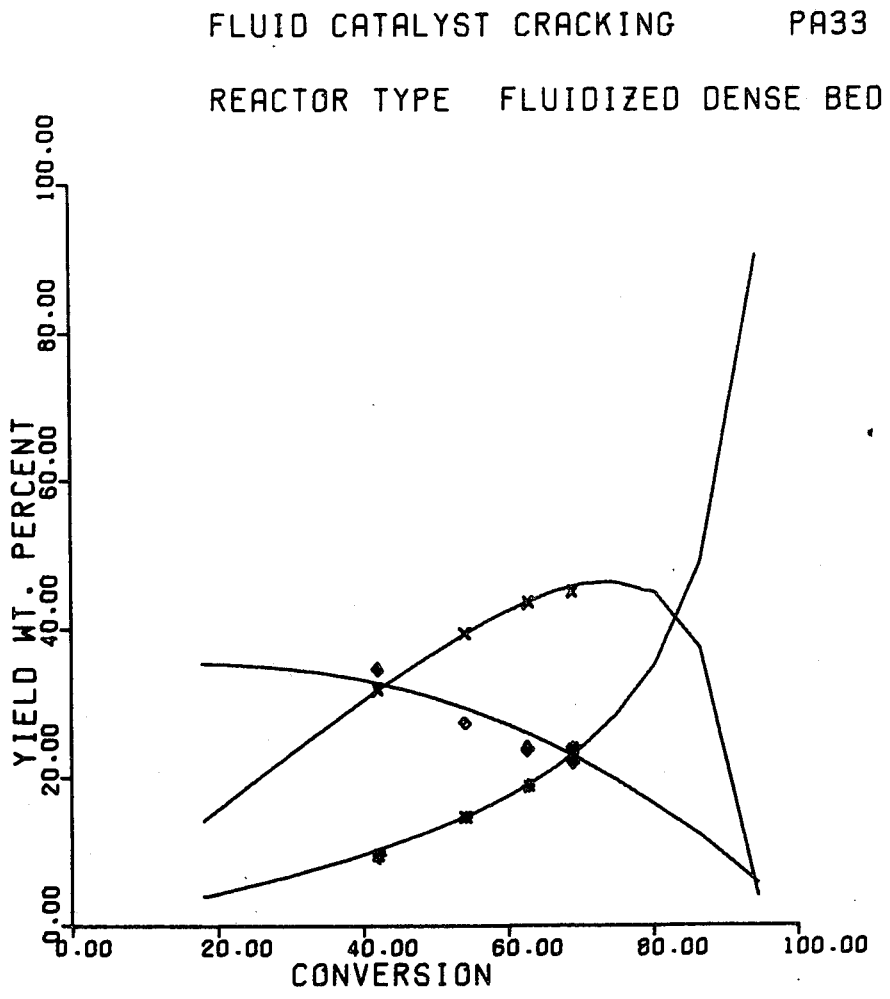
Figure 15:
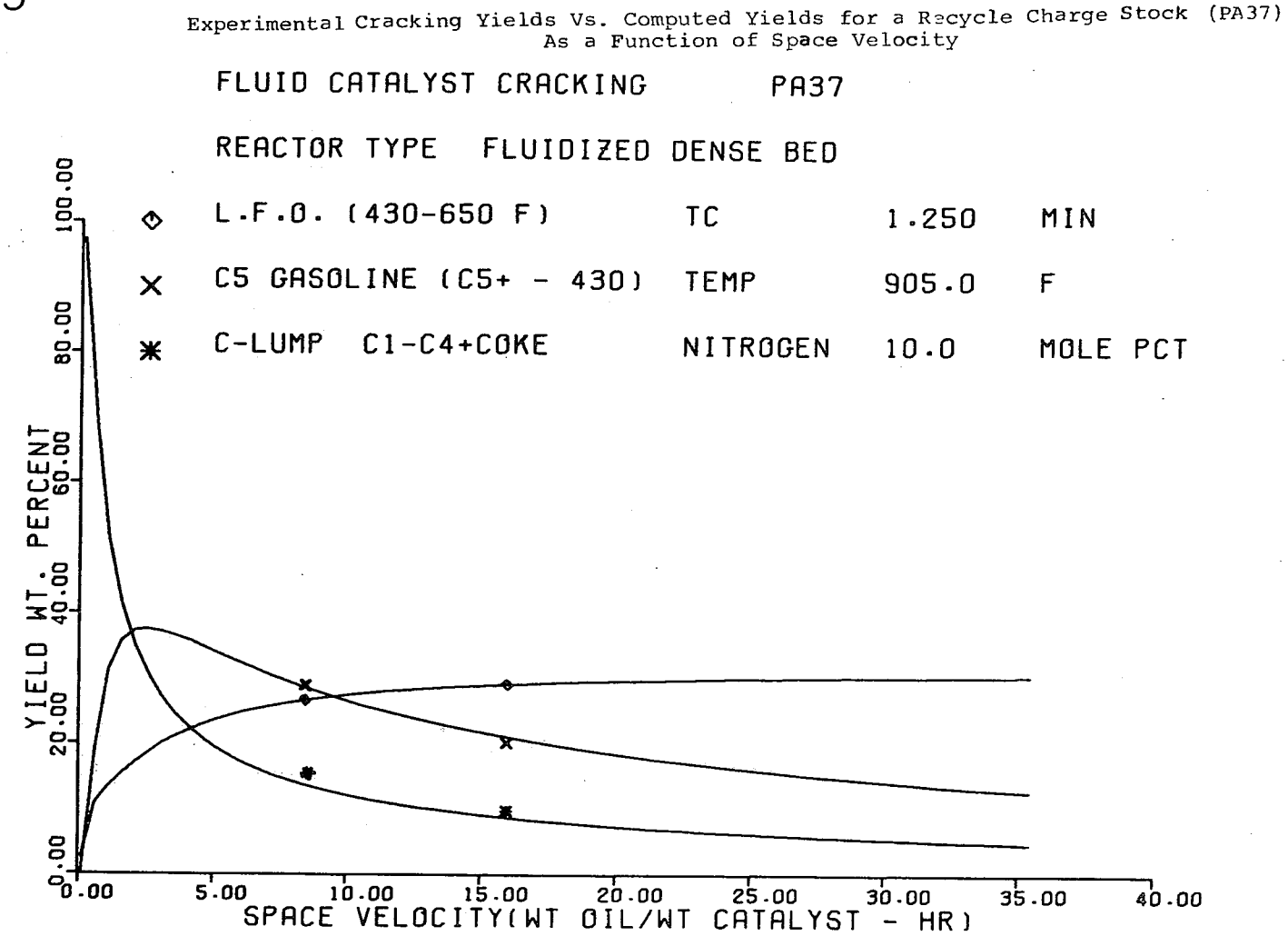
Figure 16:
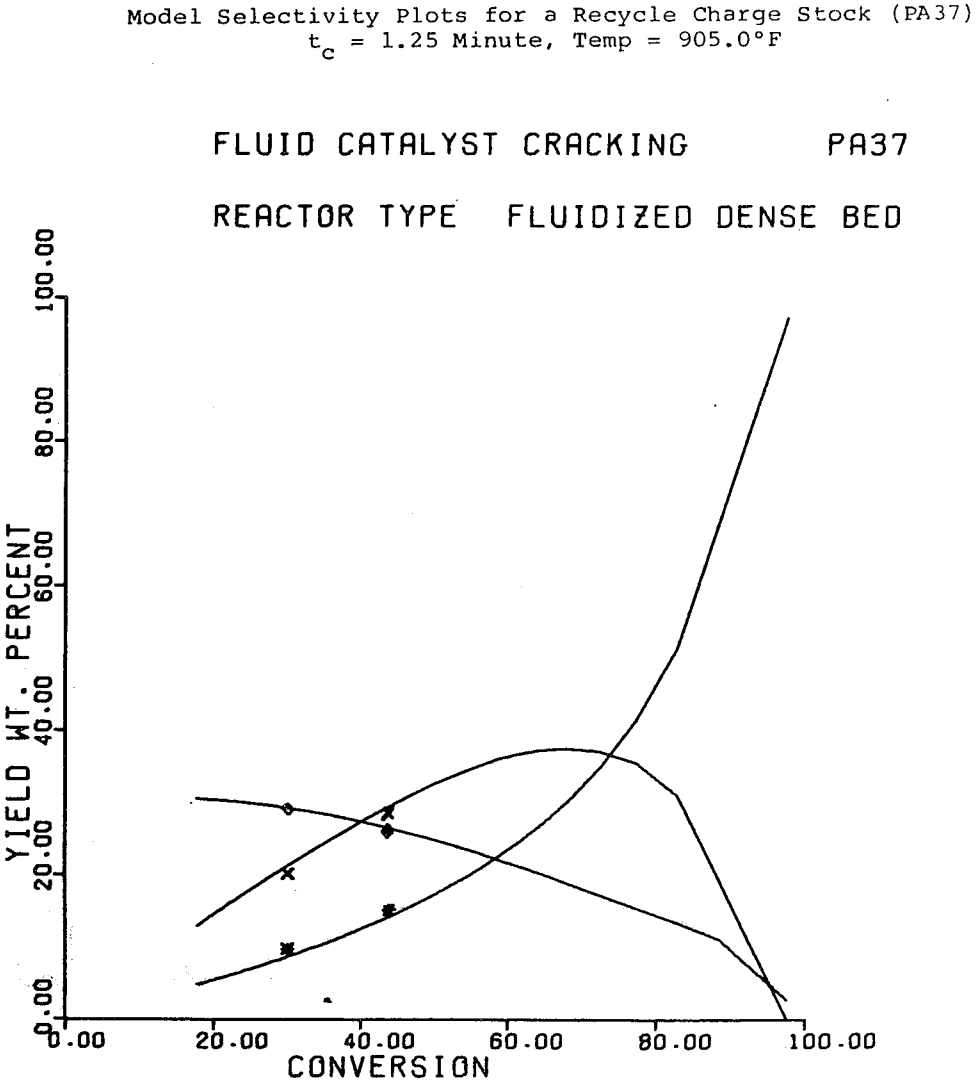

Selectivity curves for N3 are shown in FIG. 10. Yields of gasoline, C lump, and light fuel oil are plotted against total conversion. Gasoline yield goes through a maximum whereas the C lump increases and light fuel oil decreased with increasing conversion. It is particularly significant that the model not only fits the experimental data well, but predicts the proper trends over the entire range of conversion.

Similar data for charge stocks P3, PA33, and PA37 are given in FIGS. 11–16.

Compositional Changes During Reaction

Most importantly, it has been demonstrated that with the model parameters shown in Table 2 the HFO and LFO compositions are accurately traced as conversion proceeds. It must be remembered that these compositional changes were not used in determining the model parameters. Rather, the predictions of compositional change result as a pure prediction from fitting the model to the G lump, C lump, and LFO as such provide considerable support for the validity of the kinetic scheme.

Figure 17:
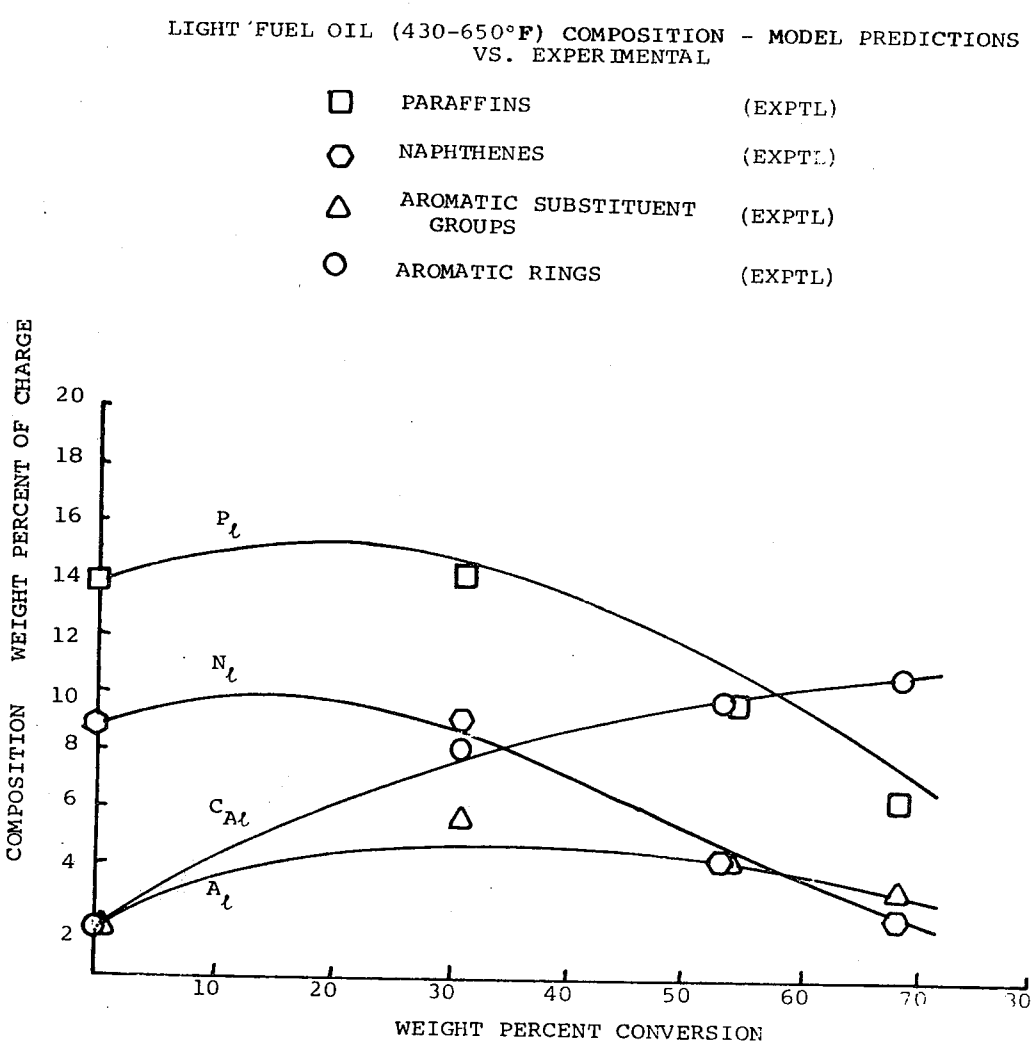
Figure 18:
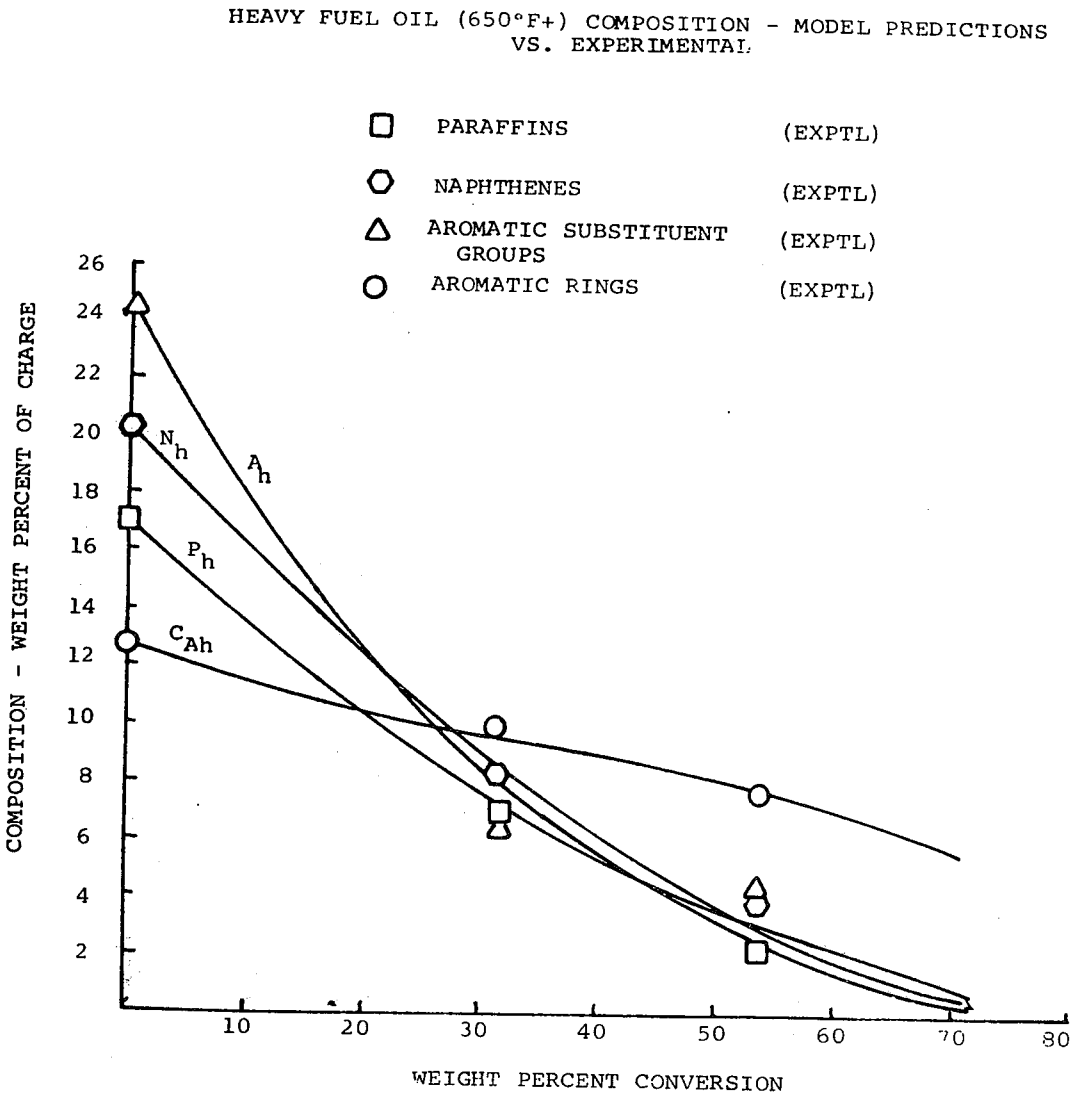

Detailed experimental analyses of the LFO and HFO are shown for the single highly aromatic charge stock PA33 in FIGS. 17 and 18 as a function of conversion. The solid lines represent the kinetic paths traced by the model for each of the compositional lumps. The model accurately follows the increase and subsequent decrease in the wt. % of the kinetic lumps in LFO, and follows the decrease in the wt. % of the kinetic lumps in HFO.

It is especially important, from the viewpoint of recycle, to be able to predict the polynuclear aromatic rings in the HFO % $C_{Ah}$ as this lump primarily determines the increased coke production from recycle charge stocks and also reflects its cracking characteristics. At high conversion (60–70 wt. %) the HFO is almost solely composed of polynuclear aromatic rings. Since the lumped composition of these fractions is accurately predicted, recycle situations (recycling HFO or LFO, or both) may now be treated with confidence.

Example of Predictive Capabilities of Model

The fluid catalytic cracking reactor model can be used to predict G lump ($C_5$+—430°F gasoline), C lump ($H_2$, $H_2S$, $C_1$–$C_4$, coke), and LFO (430°–650°F) yields for charge stocks not used in determining the rate constants. Predictions are computed using the kinetic model base on kinetically invariant lumps of paraffins, naphthenes, aromatic rings, and aromatic substituent groups and the model parameters presented in Table 2. The average and standard errors of the predictions are similar to those obtained when the model was fitted to the original data. The model has good prediction capability as demonstrated by the following examples.

Figure 19:
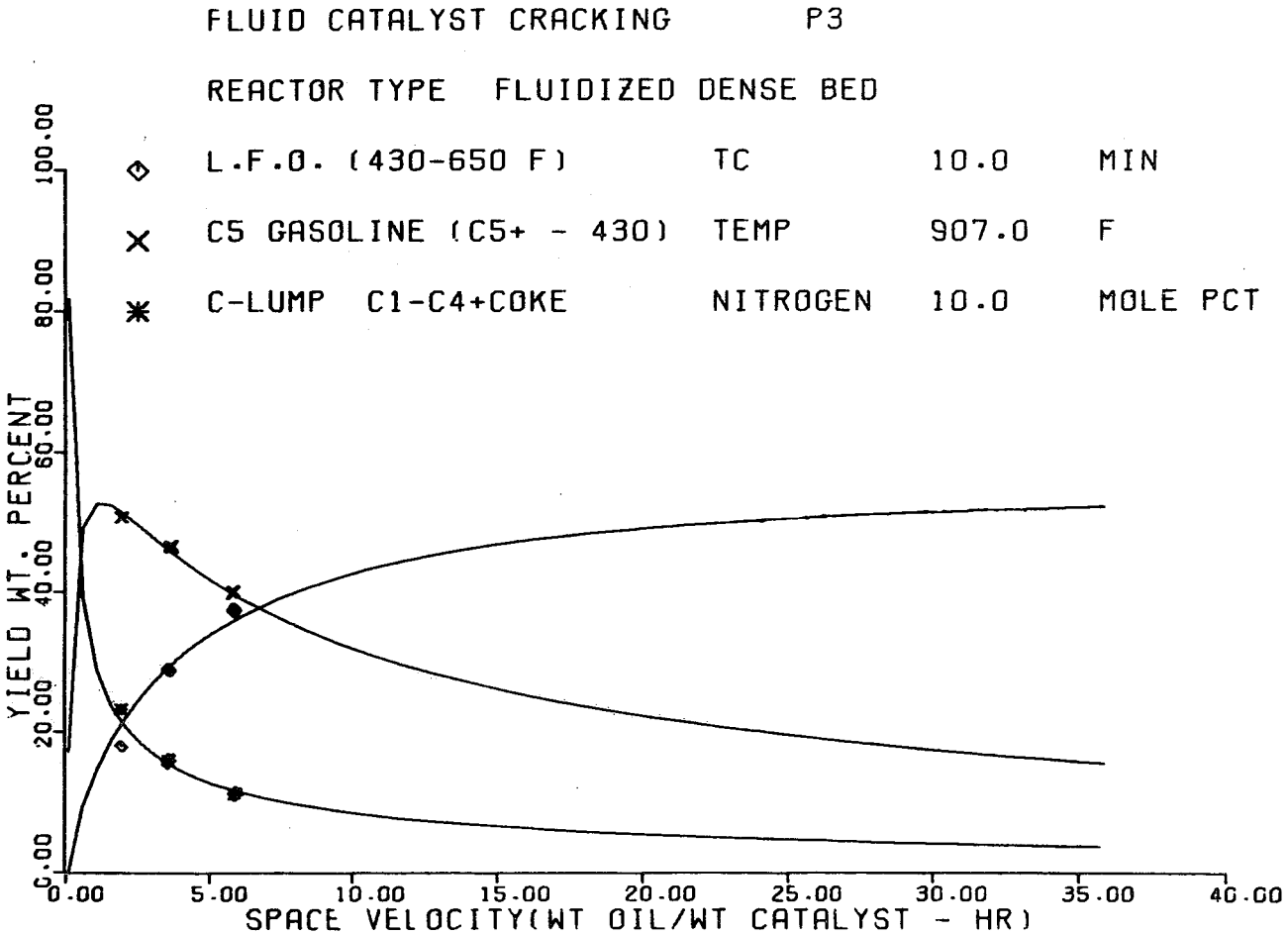

Amal gas oil (P3) was run at a catalyst residence time of 10 minutes to test the validity of extrapolating the catalyst deactivation function to longer catalyst residence times. The catalyst deactivation function was previously computed from the cracking results of 15 charge stocks at 1.25 and 5 minutes on-stream periods. FIG. 19 shows the deactivation function adequately predicts the cracking yields of gasoline, C lump, and LFO at longer catalyst residence times ($t_c = 10$ min.).

Figure 20:
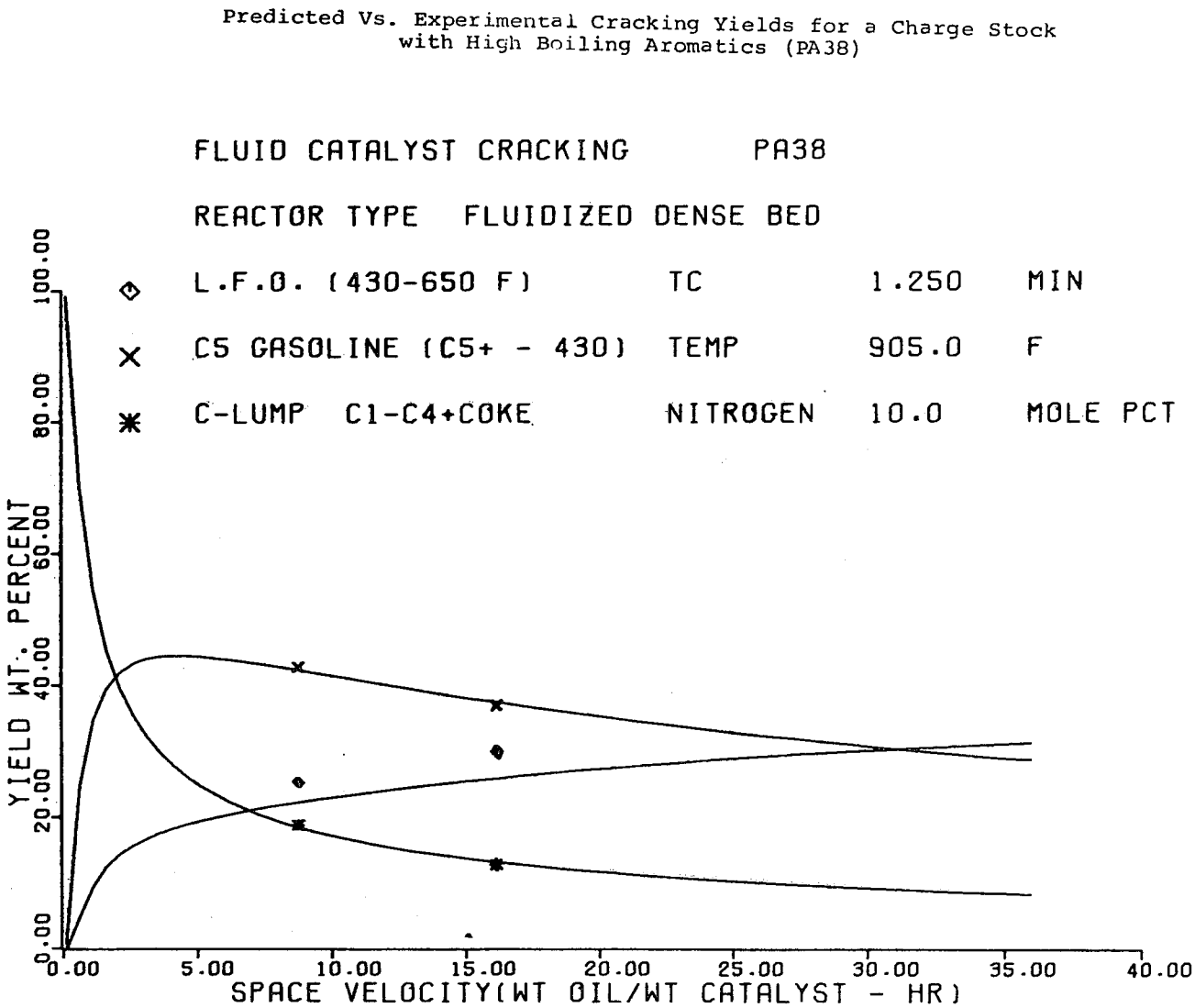

FIG. 20 is a plot of the yields of gasoline, C lump, and light fuel oil versus space velocity for another gas oil (PA38). This charge stock was not used in the determination of the rate constants given in Table 2. The agreement between the experimental data and the predicted curves is excellent.

Figure 27:
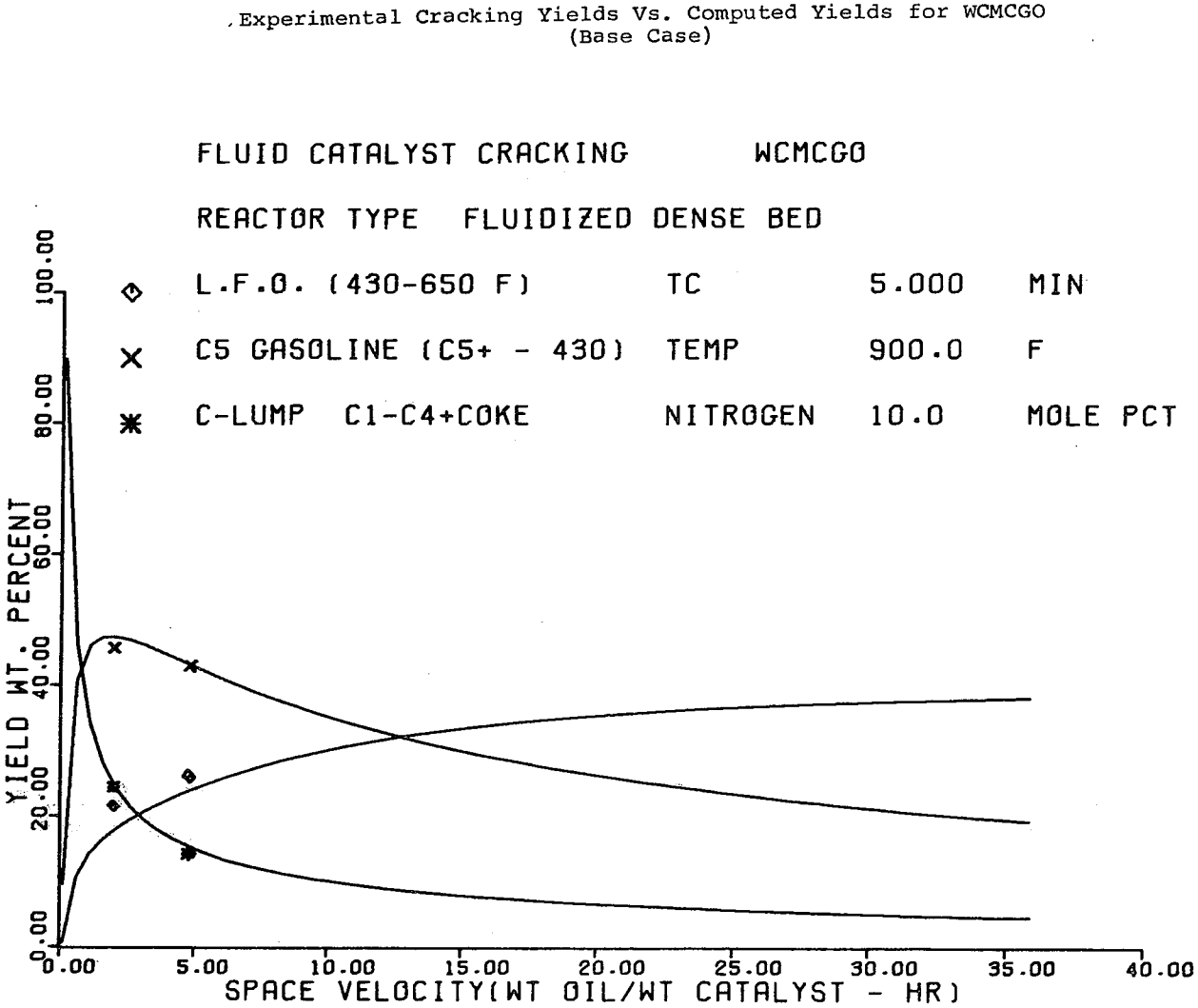
Figure 28:
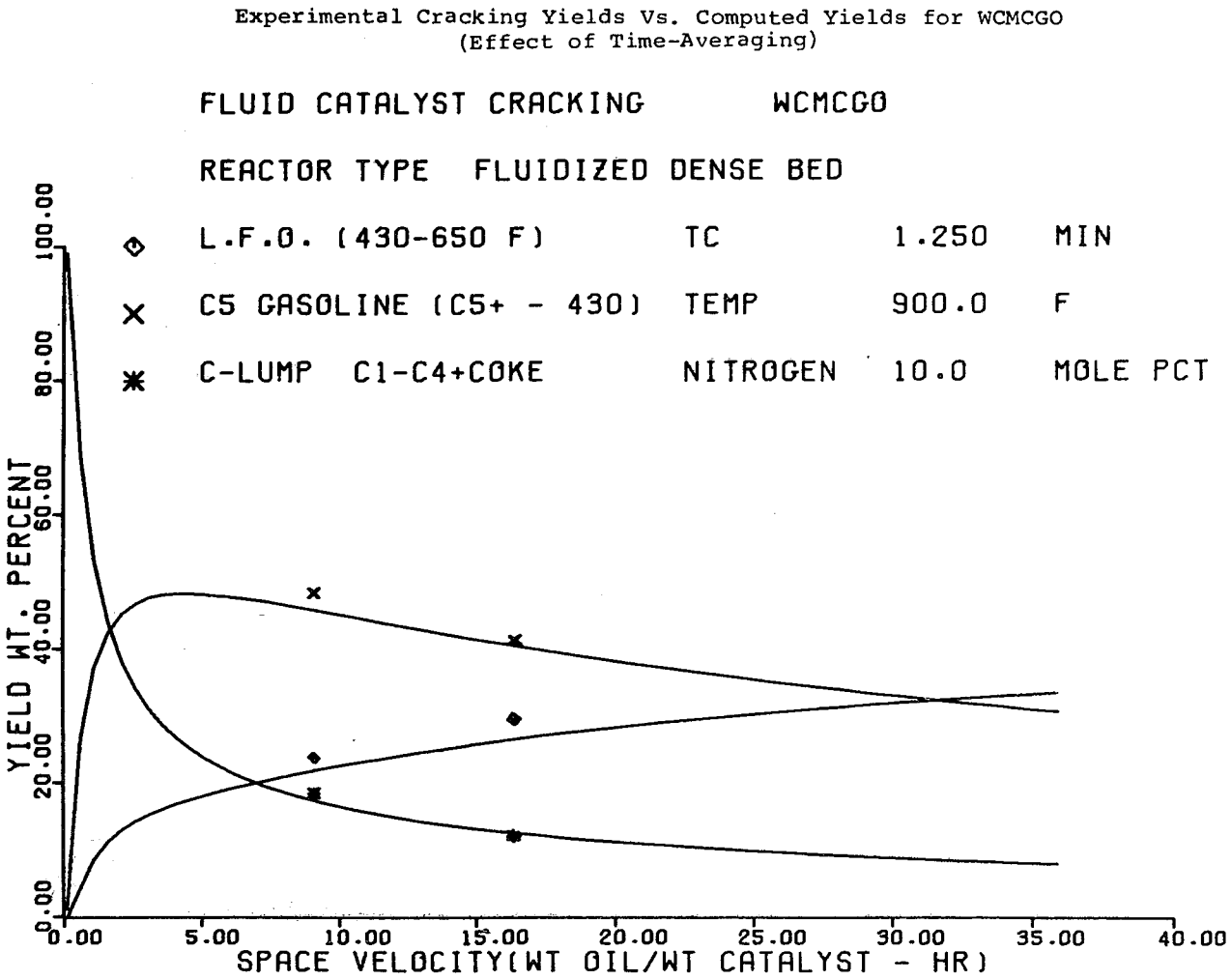

A similar plot in FIG. 27 is shown for a wide cut mid-continent gas oil (WCMCGO) a new charge stock not previously used in the model, and again the agreement is very good.

Activation Energies

Figure 21:
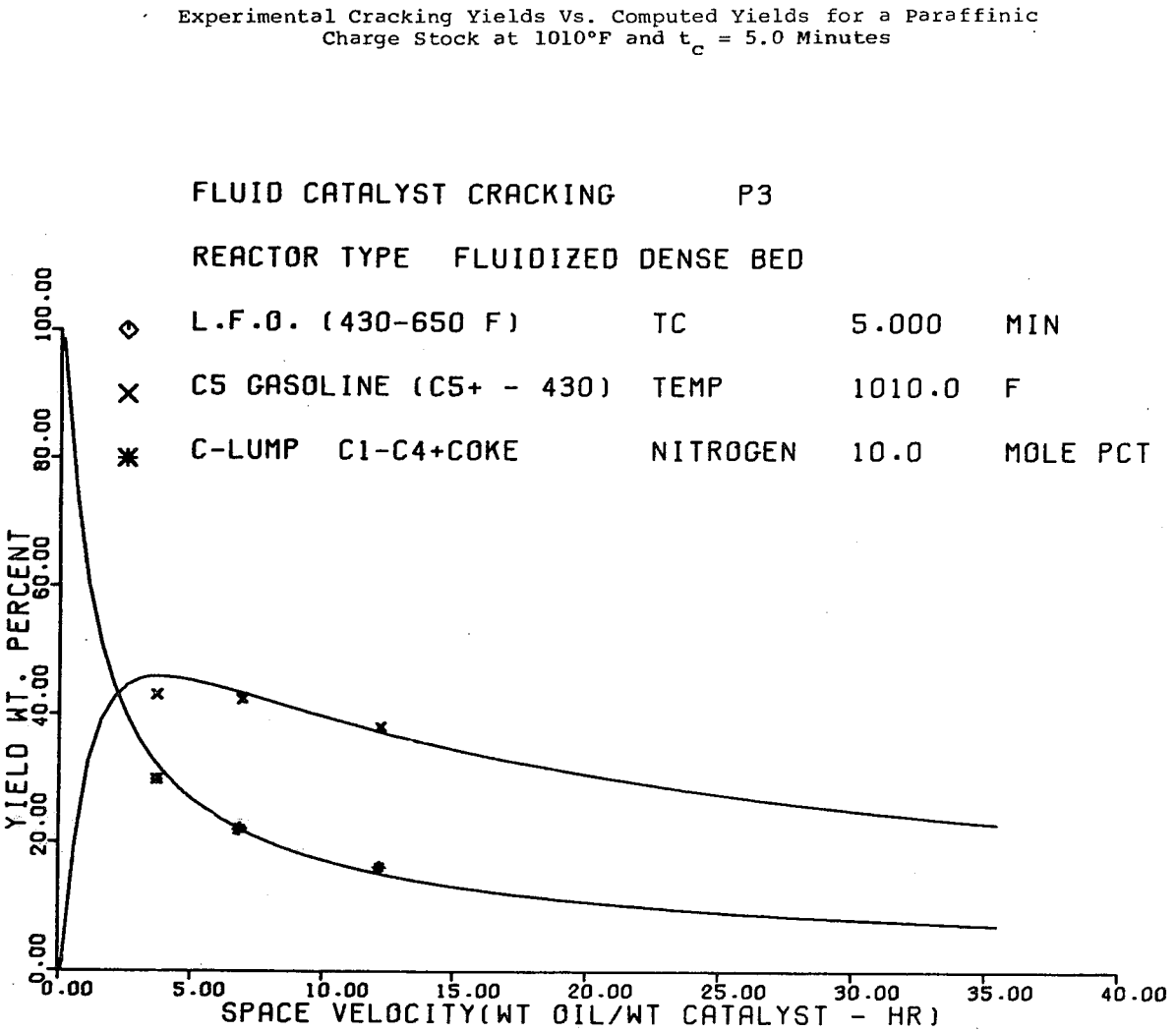
Figure 22:
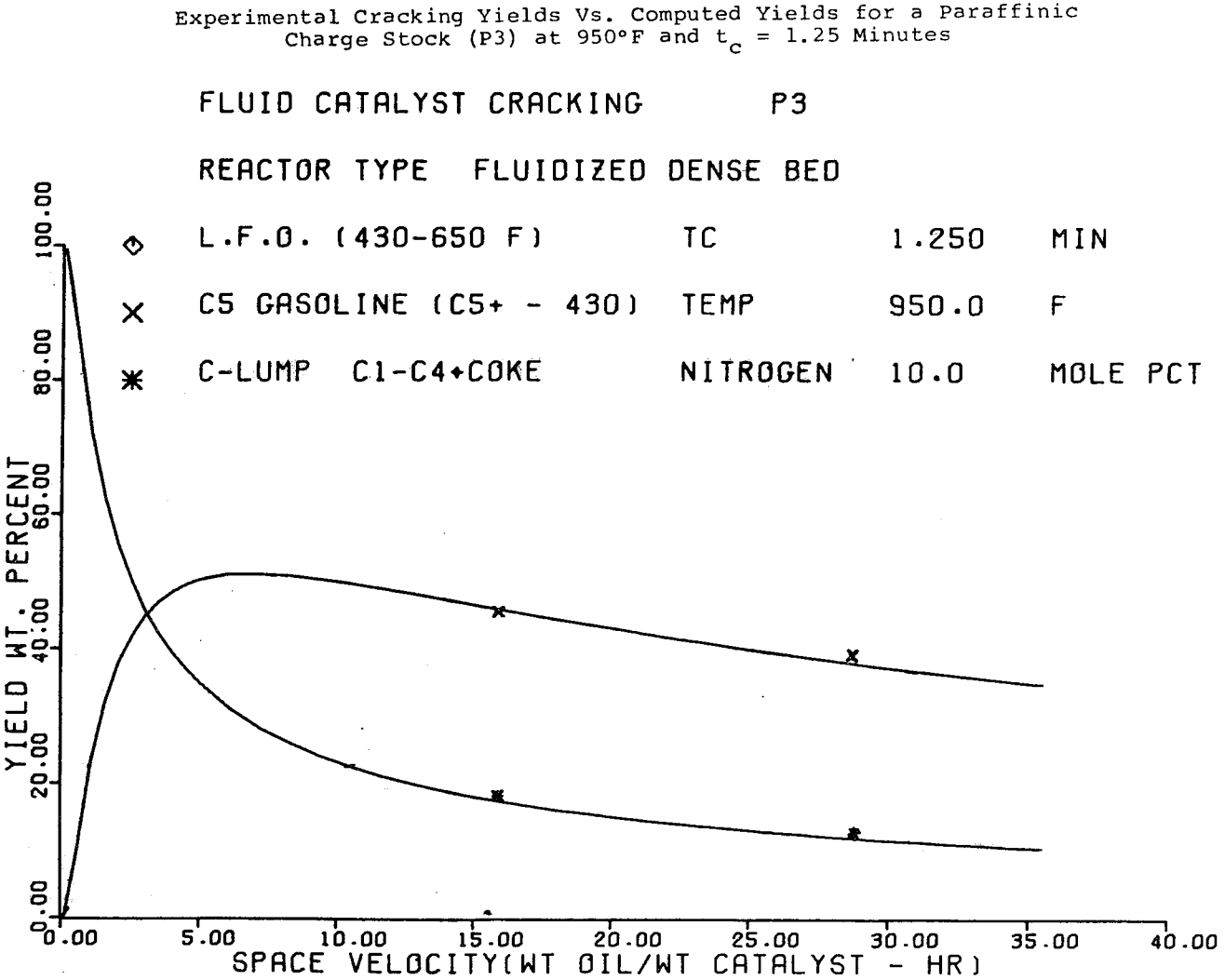
Figure 29:
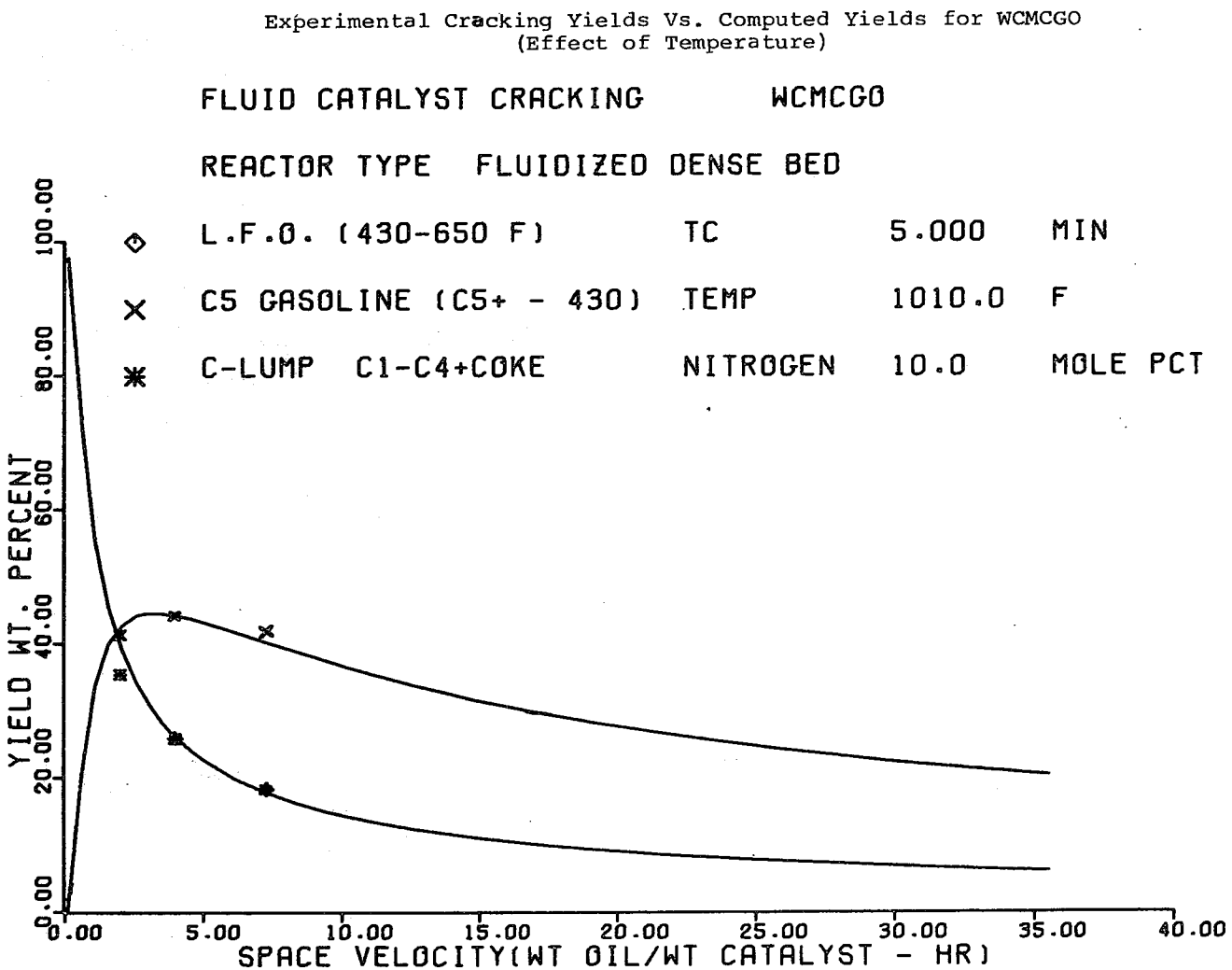
Figure 30:
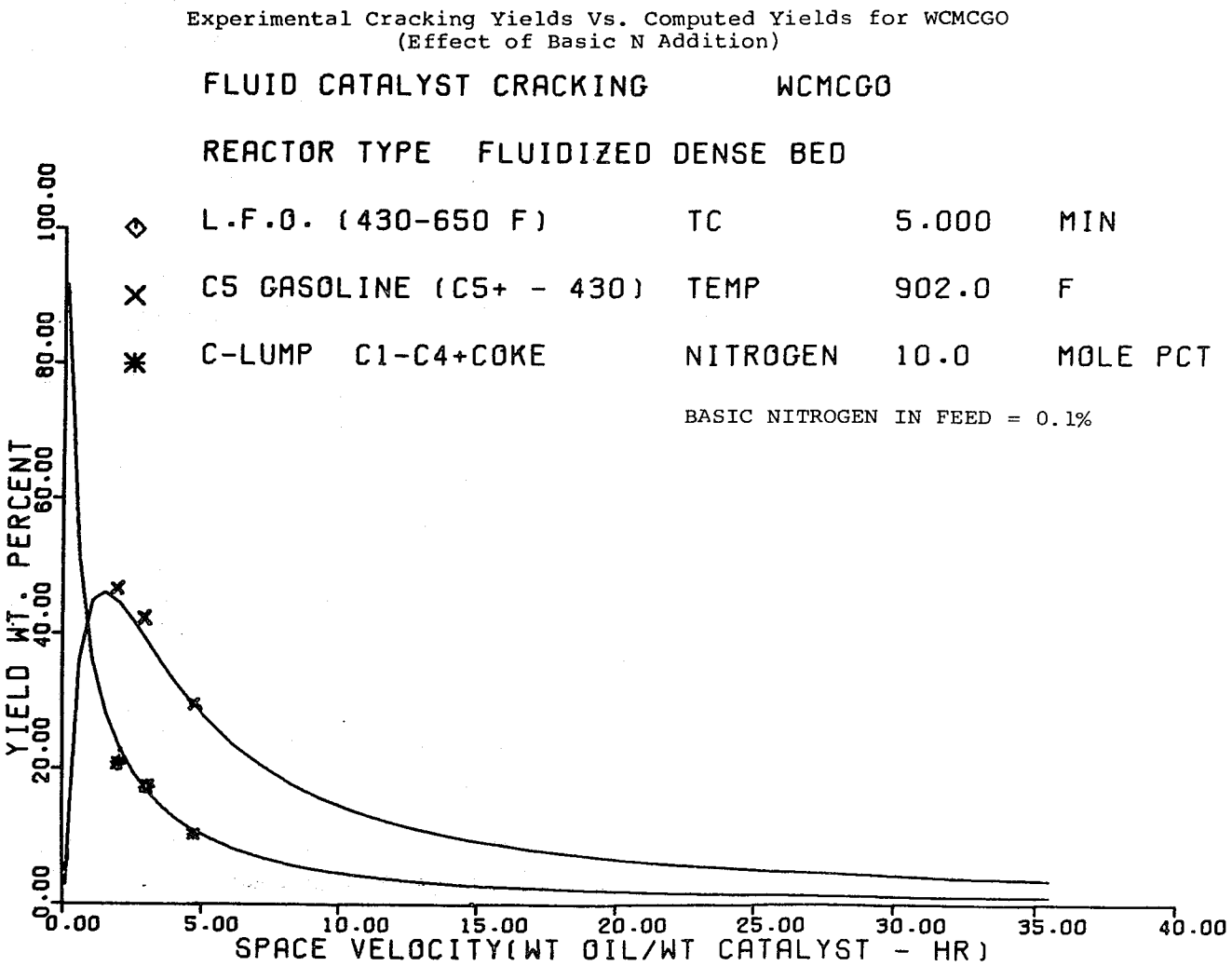
Figure 31:
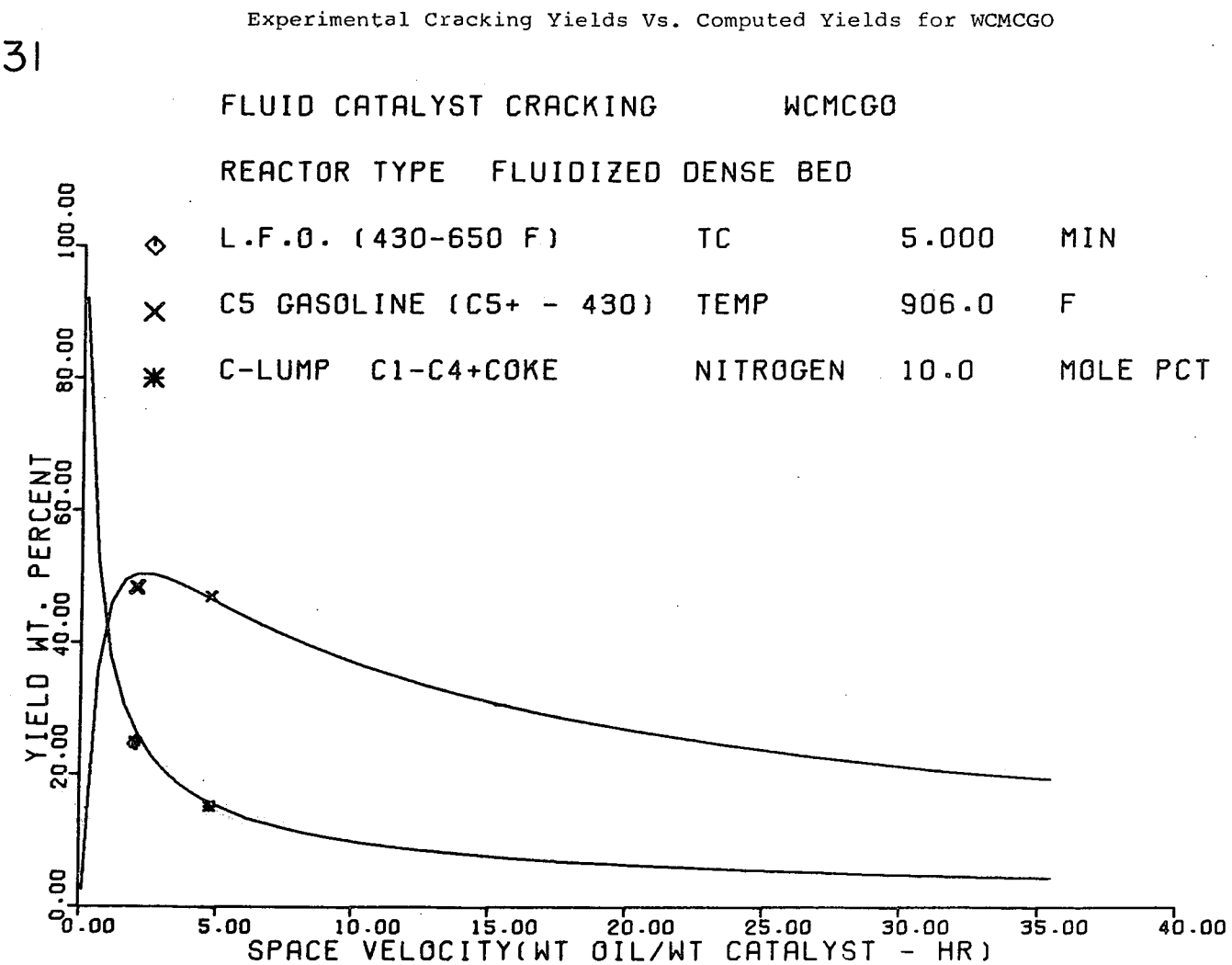

It is assumed, in the present model, that a single activation energy may be assigned to a group of reactions. However, updated activation energies can be integrated into the model, if necessary. The present model has six activation energies derived from temperature data at 900°, 950°, and 1000°F on Amal and WCMCGO. The results of fitting these activation energies to be the experimental data are shown in FIGS. 21 and 22 for Amal (P3) and in FIG. 29 for WCMCGO. The activation energies thus obtained are associated with the following groups of reactions:

| | Activation Energies (cal/g-mole) |
|---|---|
| 1. Gasoline (G lump) formation reactions from $P_h$, $P_l$, $N_h$, $N_l$ | 5,500 |
| 2. C lump formation reactions from $P_h$, $P_l$, $N_h$, $N_l$ | 8,500 |
| 3. Gasoline (G lump) formation reactions from $A_h$, $A_l$ | 14,500 |
| 4. C lump formation reactions from $A_h$, $A_l$, $C_{Ah}$, $C_{Al}$ | 17,500 |
| 5. C lump formation reactions from Gasoline | 20,000 |
| 6. LFO formation reactions from $P_h$, $N_h$, $A_h$, $C_{Ah}$ | 8,100 |

Nitrogen Poisoning

Basic nitrogen compounds are known to poison acidic cracking catalysts. It has been determined that quinoline added to WCMCGO gives the same effects on conversion and selectivity as the natural occurring nitrogen bases which occur in a typical FCC feedstock.

The effects of nitrogen poisoning have been incorporated into the lumped invariant kinetic model for catalytic cracking by the addition of a catalyst deactivation term related to nitrogen adsorption and the use of a scalar quantity on gasoline formation rate contents.

Catalyst deactivation is accounted for by a deactivation function f(N), given by:

$$f(N) = \frac{1}{1+K_n\ N/\text{gms of catalyst}} = \frac{1}{1+\frac{K_h}{100}\ \frac{\text{Wt. \% Basic } N \text{ in Charge}}{\text{CAT/OIL}}\ \theta}$$

where N = gms of BASIC N to which the catalyst has been exposed at catalyst residence time, $t_c$. The deactivation function chosen has the form such that at high CATALYST/OIL ratios there are small quantities of Basic N per cracking site and the deactivation is insignificant. $\theta$ is the normalized catalyst residence time.

A slight increase in selectivity is incorporated amounting to a scalar increase of all gasoline formation reactions.

Fourteen sets of data were fitted to give a SE = 1.98 on the G lump and SE = 1.16 on the C lump. the Basic N deactivation constant is $K_n$ = 3600.0 (gms Basic N/gms of catalyst)$^{-1}$ and the gasoline formation reaction scalar is such as to increase gasoline formation reactions by 8% for each 0.1 wt. % Basic N in the feed. Basic N effects are neglected, if the concentration is less than 0.04% in the feed.

The deactivation function is such that at the end of an experimental run ($\eta = 1$) where the Cat/Oil = 2.0 and the Basic N in the feedstock is 0.1 wt. % the catalyst activity is reduced by $$\text{a factor} = \frac{1}{1+\frac{3600}{100}\ \frac{0.1}{2.0}} = 1/2.8$$

Figure 23:
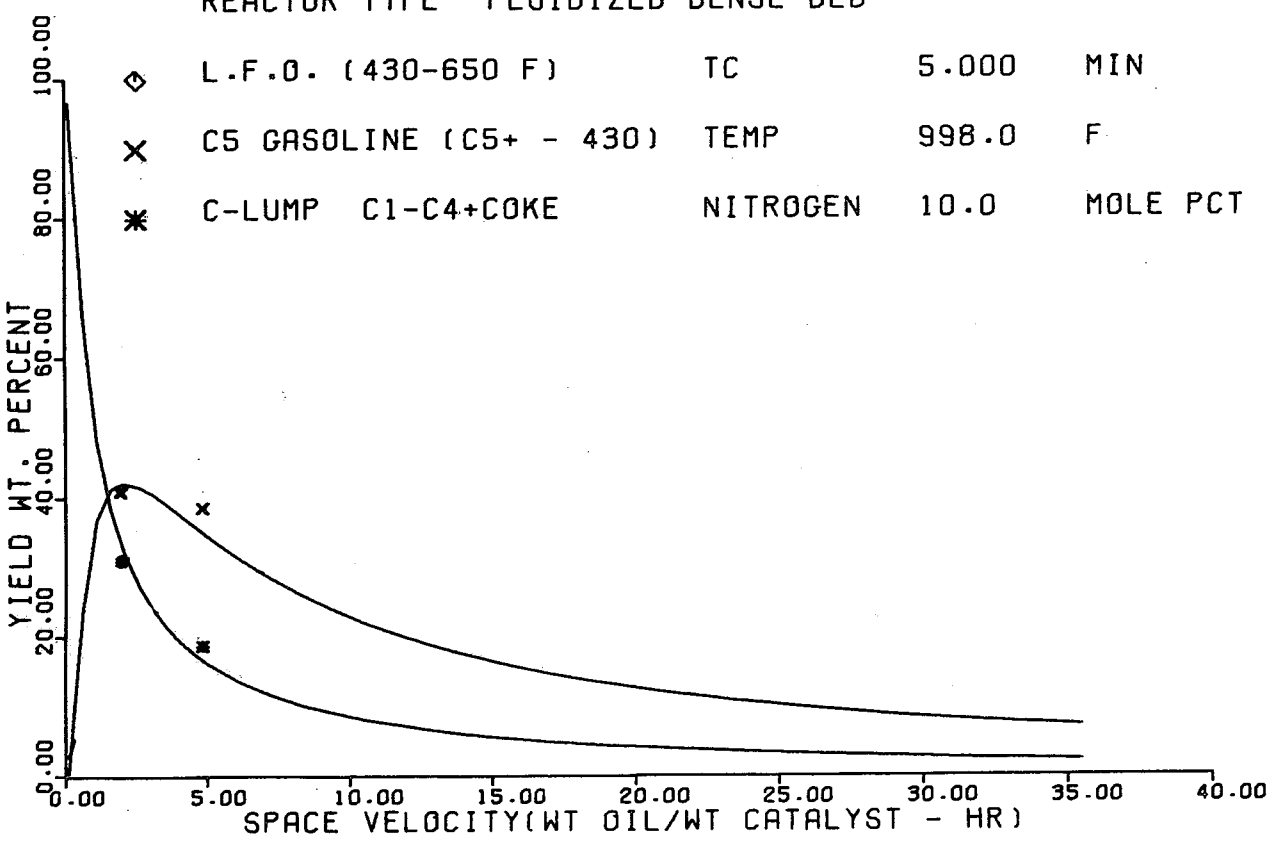
Figure 24:
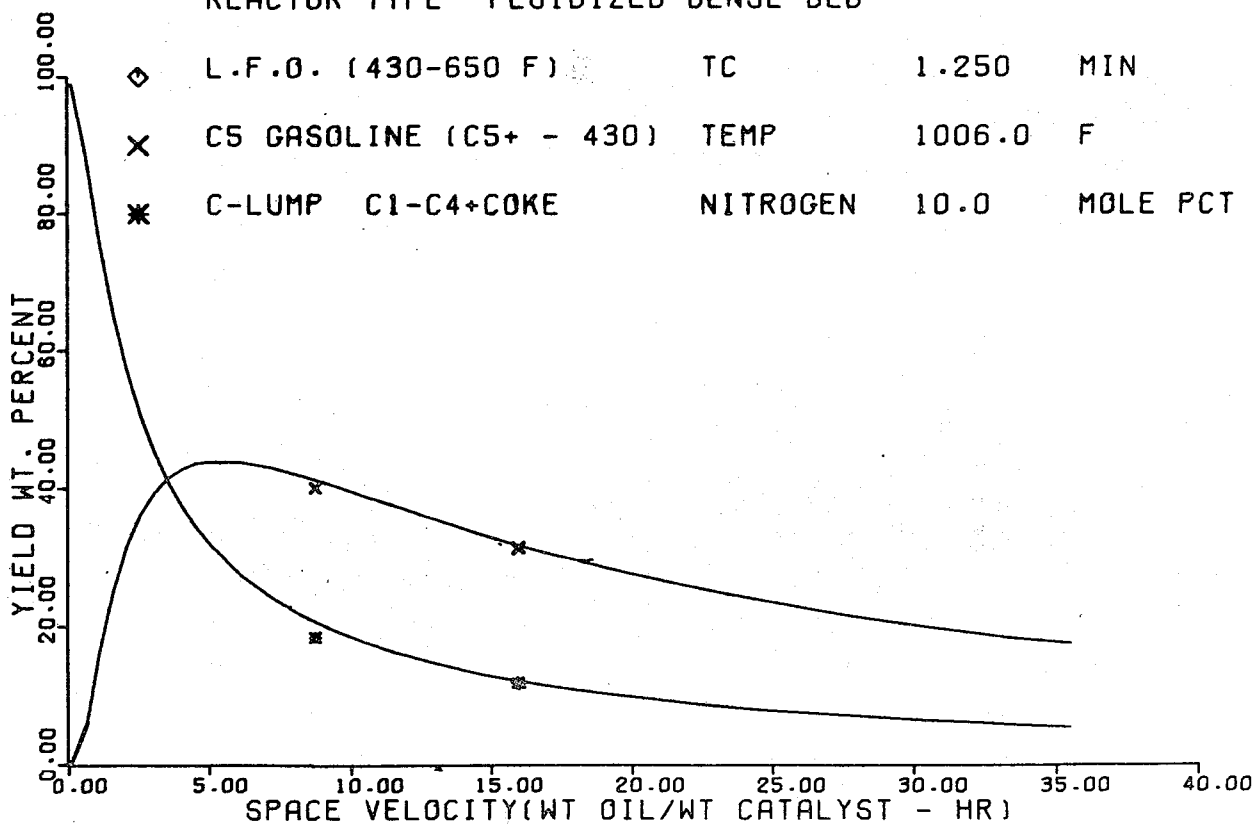

Detailed results for WCMCGO with 0.1 wt. % and 0.2 wt. % addition of nitrogen as quinoline at 1000°F are indicated in FIGS. 23 and 24.

Figure 25:
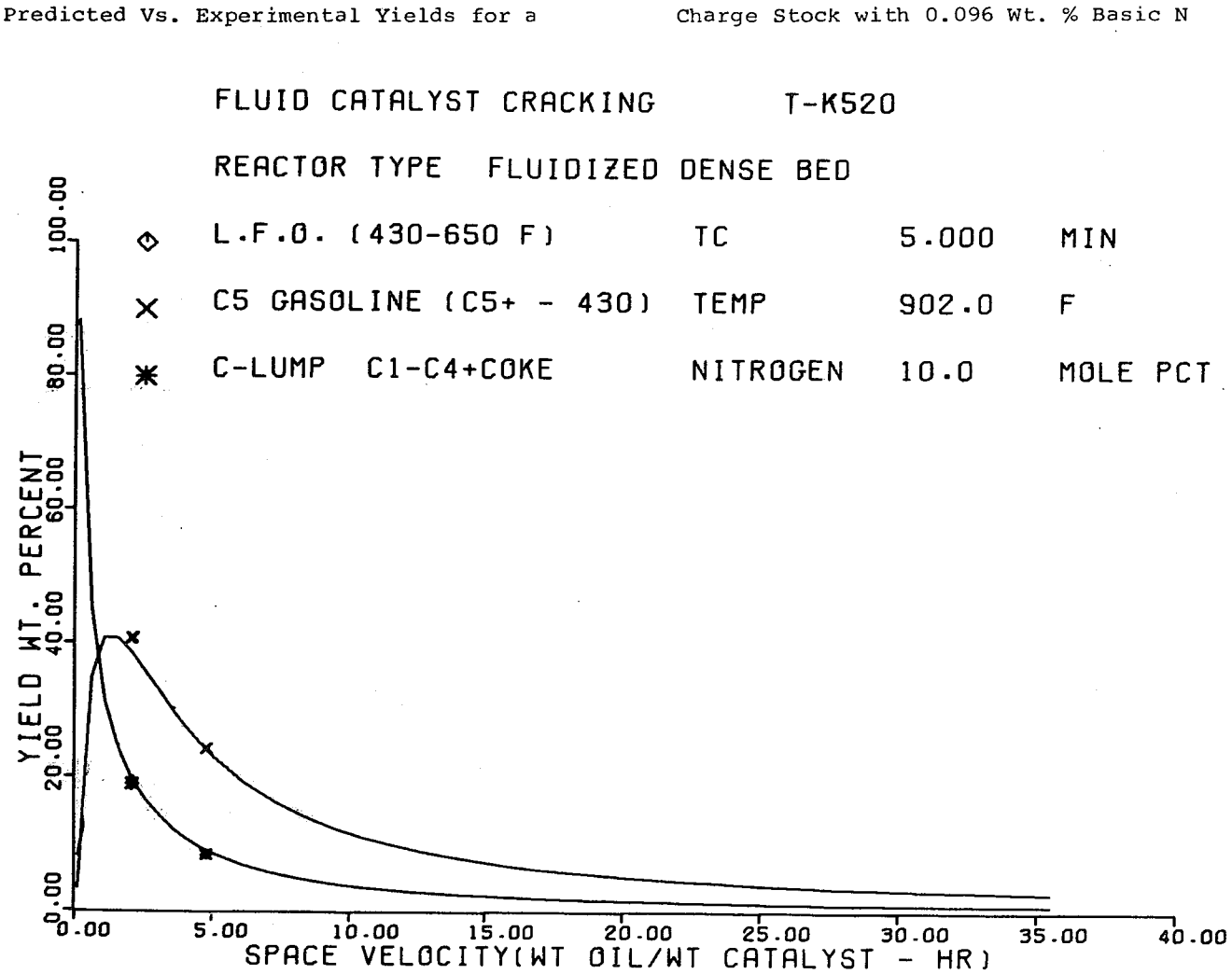

The model has been successfully tested on a gas oil (TK520) with 0.096% Basic N. The result provides a simultaneous test of lumping scheme, and the Basic N poison term. Comparisons between experimental and predicted yields are shown in FIG. 25 for this charge stock.

CATALYST EFFECTS

Figure 26:
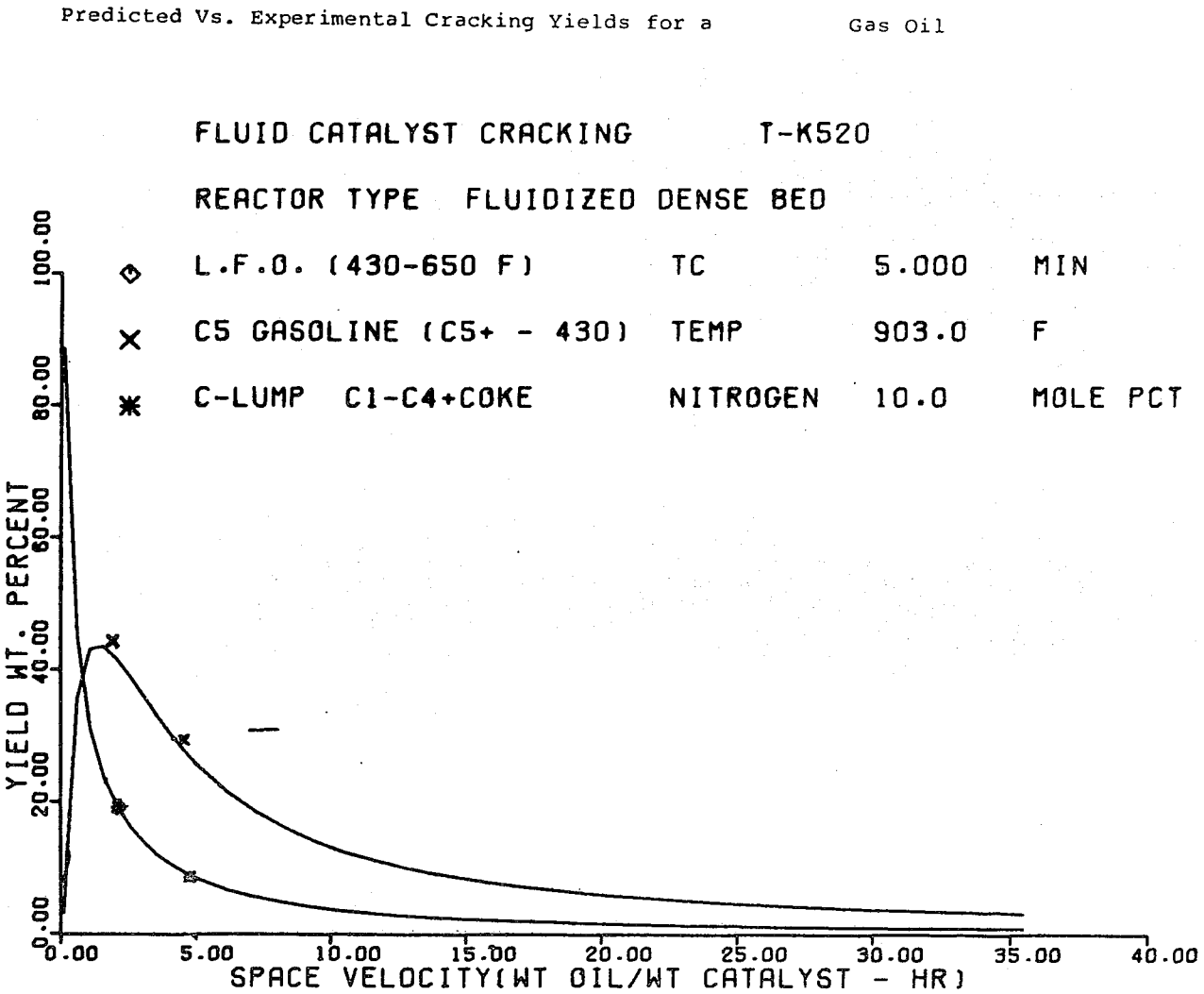

Rate constants listed in Table 2 were generated for a 10% rare earth exchanged zeolite Y aluminosilicate on a silica-alumina base. Catalysts will vary in both activity and selectivity. For example, a similar zeolite Y catalyst having a slightly different activity level was determined to require an alteration of the rate constants of Table 2 by increasing the gasoline formation rates by 20%, and by increasing the gasoline cracking rates by 2.5%. FIG. 26 shows comparisons between experimental and predicted yields for the similar zeolite Y catalyst with the altered model.

RESIDUAL CARBON ON CATALYST

The reactor model was prepared for fresh catalyst. However, since residual coke on the regenerated catalyst in the line 39 (FIG. 1) affects the catalytic properties of the catalyst, the effect of such residual coke on catalyst on the rate constants of the model are provided for experimental data for 0 through 0.5 weight % residual coke on a regenerated catalyst. A single matrix scaler cannot be used. Therefore, different factors must be applied to two groups of rate constants. For example, a 0.3 weight % of residual coke on regenerated catalyst requires that the gasoline formulation rate constants be decreased by 43%, and that the C lump formation rate constants be decreased by 35%. The model linearly interpolates these losses in activity between 0.3 weight % of residual coke on catalyst and a completely regenerated or fresh catalyst.

Light End and Coke Yields

Correlations are provided in the model to predict the yields of light ends from catalytic cracking. The correlation is based on gasoline and C lump yield and the lumped composition of the charge stock, and is in the following form.

$$L^i = (a^i G + b^i C)\,(a_{pl}{}^i P_{lo} + a_{nl}{}^i N_{lo} + a_{al}{}^i A_{lo} + a_{cal}{}^i C_{alo} + a_{ph}{}^i P_{ho} + a_{nh}{}^i N_{ho} + a_{ah}{}^i A_{ho} + a_{cah}{}^i C_{aho})$$

$L^i$ = light end i (wt. %)

$i = C_1, C_2, C_2'', C_3, C_3'', nC_4, iC_4, C_4'', nC_5, iC_5, C_5''$ $P_{lo}, N_{lo} \ldots, C_{aho}$ = Wt. % composition of the charge stock G, C = Wt. % G lump and Wt. % C lump $a^i, b^i, a_p{}^i \ldots a_{cah}{}^i$ = correlation constants used to fit 95 sets of data on each light end i.

Figure 32:
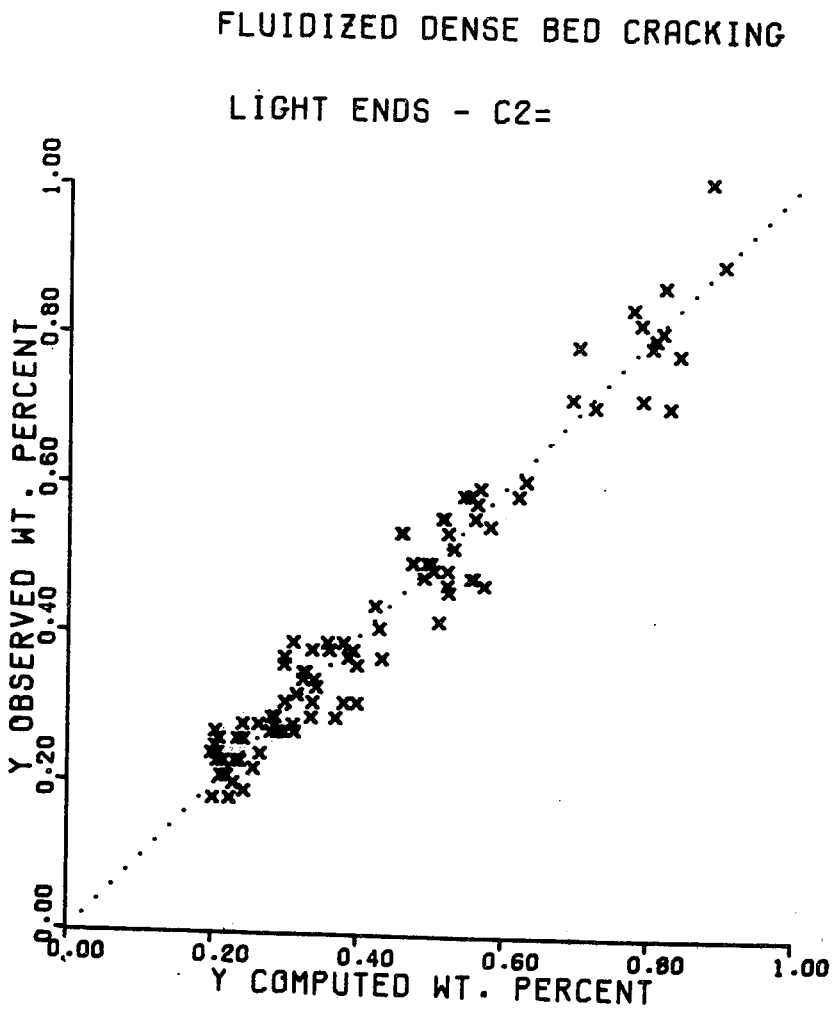
Figure 33:
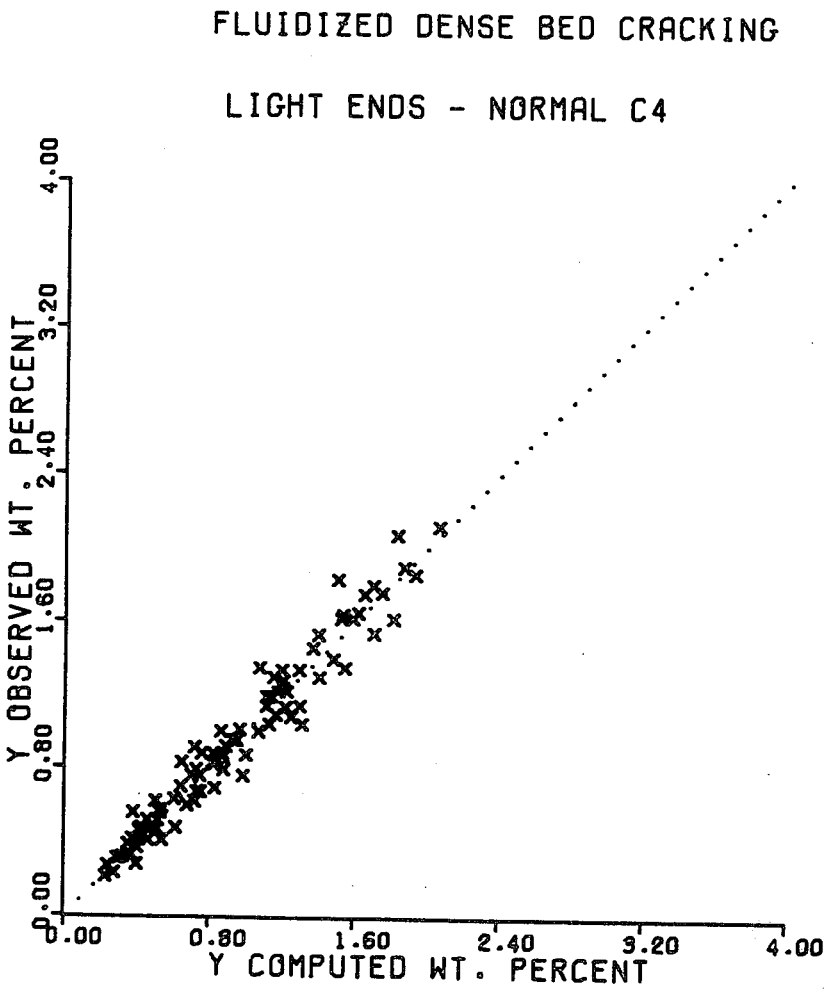

The results are summarized in Table 3, and some typical results for the individual light end yields are shown in FIGS. 32 and 33. Computed yields for $C_1$–$C_4$ are generally within 10% or less of the observed values.

Table 3

Light End Correlation Constants and Results

| | $a^i$ | $b^i$ | $a_{ph}{}^i$ | $a_{nh}{}^i$ | $a_{ah}{}^i$ | $a_{cah}{}^i$ | $a_{pl}{}^i$ | $a_{nl}{}^i$ | $a_{al}{}^i$ | $a_{cal}{}^i$ | Standard Error Absolute Wt. % | Average Error Absolute Wt. % | Average Values Wt. % | Range of Values Wt. % |
|---|---|---|---|---|---|---|---|---|---|---|---|---|---|---|
| $C_1$ | −0.0551 | 0.3270 | 0.0659 | 0.1522 | 0.2005 | 0.2263 | 0.0294 | 0.0817 | 0.0737 | 0.3570 | 0.0738 | 0.056 | 0.4 | 0.06–1.0 |
| $C_2$ | −0.0551 | 0.3270 | 0.0659 | 0.1522 | 0.2005 | 0.2263 | 0.0294 | 0.0817 | 0.0737 | 0.3570 | 0.0738 | 0.056 | 0.4 | 0.06–1.0 |
| $C_2''$ | −0.0258 | 0.2060 | 0.1622 | 0.2911 | 0.2683 | 0.0785 | 0.0415 | 0.2828 | 0.4451 | 0.0772 | 0.0445 | 0.032 | 0.5 | 0.19–1.0 |
| $C_3$ | −0.1673 | 1.0780 | 0.1033 | 0.2066 | 0.1356 | 0.0069 | 0.1199 | 0.2655 | 0.1921 | 0.0087 | 0.1339 | 0.104 | 1.5 | 0.40–3.3 |
| $C_3''$ | 0.2540 | 0.3564 | 0.2424 | 0.0846 | 0.1690 | 0.1299 | 0.1727 | 0.0798 | 0.1597 | 0.1602 | 0.1618 | 0.105 | 2.4 | 1.00–3.9 |
| $nC_4$ | −0.0394 | 0.3620 | 0.3199 | 0.2871 | 0.1333 | 0.0031 | 0.2687 | 0.3804 | 0.4823 | 0.0091 | 0.0862 | 0.065 | 1.1 | 0.20–2.2 |
| $iC_4$ | 0.0012 | 1.3950 | 0.1774 | 0.2893 | 0.1297 | 0.0041 | 0.2329 | 0.3271 | 0.2382 | 0.0065 | 0.2450 | 0.181 | 4.5 | 1.0–9.0 |
| $C_4''$ | 0.1288 | −0.0063 | 0.7972 | 0.3455 | 0.5440 | 0.5866 | 0.5726 | 0.2469 | 0.5466 | 0.4226 | 0.1720 | 0.122 | 2.6 | 1.2–3.8 |
| $nC_5$ | 0.0510 | −0.0011 | 0.2114 | 0.1973 | 0.1379 | 0.1608 | 0.3557 | 0.0831 | 0.1380 | 0.4561 | 0.1080 | 0.075 | 0.4 | 0.09–0.73 |
| $iC_5$ | 0.1803 | −0.0013 | 0.7797 | 0.6949 | 0.3467 | 0.2749 | 0.8779 | 0.5228 | 0.9388 | 0.3287 | 0.875 | 0.667 | 4.5 | 0.96–7.84 |
| $C_5''$ | 0.0896 | −0.0670 | 1.1540 | 0.0437 | 0.6362 | 1.0965 | 0.2829 | 0.0499 | 0.7844 | 0.5349 | 0.204 | 0.148 | 1.5 | 0.6–2.4 |

Carbon on catalyst is treated using the coking relation, $C = at_c{}^n$ where $C$ is wt. % carbon on catalyst $a$ is a function of charge stock $t_c$ is the catalyst residence time $n$ is an exponent which is a function of catalyst.

The equation below is a relation that is charge stock independent with a standard error SE of 0.24 (absolute wt. %) for wt. % coke produced on charge. Computed coke yields are generally within 6% or less of the observed values.

$$C = \frac{a}{100} \quad \frac{t_c}{5.0}^{0.2}$$

where $a = 0.631\ P_{lo} + 0.110\ N_{lo} + 1.475\ A_{lo} + 0.0727\ C_{Alo} + 0.631\ P_{ho} + 0.297\ N_{ho} + 0.773\ A_{ho} + 2.225\ C_{Aho}$ $t_c$ = catalyst residence time in minutes $P_{lo}, N_{lo}, A_{lo}, C_{Alo}$ = Wt. % paraffins, naphthenes, aromatic substituent groups and aromatic rings in LFO of charge $P_{ho}, N_{ho}, A_{ho}, C_{Aho}$ = Wt. % paraffins, naphthenes, aromatic substituent groups and aromatic rings in HFO of charge.

The coke yield in wt. % may then be calculated from

Coke Yield (wt. %) = 1.1 C (cat/oil)

where the factor 1.1 accounts for the carbon hydrogen ratio in the coke.

COMPUTER PROGRAM

The computer program of Appendix III facilitates the rapid treatment of experimental data. The program performs the following functions:

1. Searches for the best fit to the data (G lump, C lump, LFO) by means of a pattern search on the parameters of the system.
2. Goes into an output routine which prints the pertinent process variables for each run and then calculates the light end and coke yields.
3. The program then proceeds to produce plots of
   i. observed vs. computed yields for G lump, C lump, and LFO.
   ii. observed and computed yields vs. space velocity.
   iii. selectivity plots.
4. The program also allows for different reactor types to be called, (this is specified by the user in the input). The program is capable of treating data obtained from the following reactor types
   i. time-averaged fluidized dense bed data.
   ii. time-averaged fixed bed data using a scaler to account for more efficient catalyst utilization.
   iii. instantaneous data - pilot plant fluidized dense bed.

With reference to the program of Appendix III, PROGRAM MAIN reads in the input data and the initial guess for the rate constants associated with the kinetic scheme and proceeds to determine the best set of rate constants that fits the experimental data.

Beginning with SET ISEARCH, read in input data (1) yields from cracking operation, (2) charge stock properties, and (3) reactor conditions.

Beginning with READ 3, read in initial guess for rate constants.

Beginning with 70 OBJSTR, the program determines the best set of rate constants to fit the experimental data.

Beginning with C COMPUTE AVERAGE ERRORS AND SE, the program computes standard errors of the model fit for gasoline, conversion and light fuel oil.

SUBROUTINE REACTR primarily sets up the fluidized dense bed FCC reactor model and proceeds with the integration of the differential equations through the reactor bed. Outlet concentrations are time-averaged to account for catalyst deactivation. The time-averaged computer values for yields of gasoline, conversion and light fuel oil are then compared to the experimental data to determine how closely the model predicts the bed behaviour. The reactor model may be of three forms, (1) time-averaged fluidized dense bed, (2) instantaneous riser, (3) instantaneous fluidized dense bed. The reactor model is specified by the user in the input.

Beginning with Y(1) = F(J,16), set up initial conditions for the kinetic scheme. kinetics Beginning with H=TIM(K), for the time-averaged fluidized dense bed, integrate the differential equations through the reactor bed, and beginning with COMPUTE AVERAGED YIELDS, YBAR(J,L) compute time-averaged yields.

Beginning with RISER CALCULATION, the same integration scheme may be applied to a riser reactor model.

Beginning with INSTANTANEOUS FLUIDIZED BED REACTOR, the same integration scheme may be applied to an instantaneous fluidized bed reactor.

Beginning with 202 CONTINUE, the program computes the standard error for all the sets of experimental data provided.

SUBROUTINE GAUSS 6 allows the model yield spectrum to be time-averaged for the case where the time-averaged fluidized dense bed data is obtained with catalyst deactivation.

SUBROUTINE CONVERT takes the input data read in the main program and converts it to a more suitable format for computation and printout.

SUBROUTINE FOXY represents the differential equations describing the main kinetic framework in the reactor model. These equations describe the rate of change of each of the ten lumped species in the kinetic scheme shown in FIG. 2. It also computes the rate of formation of gasoline, conversion and light fuel oil. Furthermore, it computes the composition of paraffins, naphthenes, aromatic substituent groups and aromatic rings in the light fuel oil heavy fuel oil fractions.

SUBROUTINE OUTPUT uses correlations to predict light hydrocarbon yields ($C_1$–$C_5$), and coke. These predictions together with gasoline conversion (C lump + G lump) and LFO are printed-out in a suitable format and compared to the experimental yields.

Beginning with LIGHT END AND COKE CORRELATION on page 16, light ends correlative prediction is generated.

Beginning with CARBON ON CATALYST, the coke prediction is generated.

Beginning with 10 FORMAT, format statements for output are provided.

The program of Appendix III is written in FORTRAN and is suitable for a Control Data Corporation CDC 1604 computer.

The model and program are readily adaptable to any catalytic cracking operation such as a moving bed (e.g., thermofor catalytic cracking), and a fluid riser of a fluid catalytic cracking process for either lab system or a commercial unit. Prior art techniques can be used for the control or optimization of such a commercial unit to maximize yields therefrom in accordance with the model of this invention.

Appendix IV shows by way of example a comparison between predicted and observed yields for two feed stocks identified as WCMCGO and T-K520. Further Appendix V shows by way of example under PARAMETERS a $\underset{\approx}{K}$ which gives a maximum error (SE).

Appendix V shows by way of an example a printout of a best fit of yields for a WCMCGO charge stock in a fluidized dense bed or fixed bed reactor under the conditions stated thereon.

APPENDIX I
NOMENCLATURE

| Roman | |
|---|---|
| $a$ | Coking constant for Voorhies equation, $C = at_c^n$ |
| $a$ | Composition vector consisting of $j$ lumped species ($a_j$ = moles $j$/gm gas) |
| $a_j$ | Concentration of lump $j$ (moles $j$/gm gas) |
| $A_h$ | Wt. % aromatic substituent groups in HFO (650°F$^+$) |
| $A_{ho}$ | Wt. % aromatic substituent groups in HFO of charge |
| $A_l$ | Wt. % aromatic substituent groups in LFO (430–650°F) |
| $A_{lo}$ | Wt. % aromatic substituent groups in LFO of charge |
| C | "C lump", Wt. % $H_2$, $H_2S$, $C_1$–$C_4$ + coke |
| $C_{Ah}$ | Wt. % aromatic rings in HFO (650°F$^+$) |
| $C_{Aho}$ | Wt. % aromatic rings in HFO of charge |
| $C_{Al}$ | Wt. % aromatic rings in LFO (430–650°F) |
| $C_{Alo}$ | Wt. % aromatic rings in LFO of charge |
| G | "G lump", Wt. % gasoline ($C_5^+$–430°F) |
| K | Rate constant matrix |
| $K_{Ah}$ | Heavy aromatic ring adsorption coefficient (Wt. % $C_{Ah}$ )$^{-1}$ |
| $K_n$ | Basic nitrogen adsorption coefficient (gms Basic N/gm catalyst)$^{-1}$ |
| MW | Mean molecular weight of gas mixture = $\frac{1}{\sum_j a_j}$ |
| $N_h$ | Wt. % naphthenic molecules in HFO (650°F$^+$) |
| $N_{ho}$ | Wt. % naphthenic molecules in HFO of charge |
| $N_l$ | Wt. % naphthenic molecules in LFO (430–650°F) |
| $N_{Lo}$ | Wt. % naphthenic molecules in LFO of charge |
| P | Absolute pressure (atmospheres) |
| $P_h$ | Wt. % paraffin molecules in HFO (650°F$^+$) |

-continued

APPENDIX I
NOMENCLATURE

| | |
|---|---|
| $P_{ho}$ | Wt. % paraffin molecules in HFO of charge |
| $P_l$ | Wt. % paraffin molecules in LFO (430–650°F) |
| $P_{lo}$ | Wt. % paraffin molecules in LFO of charge |
| R | Gas constant (82.05 atm. cm³/g-mole °K) |
| $S_{WH}$ | True weight hourly space velocity (g feed/g catalyst-hr) |
| $t_c$ | Time from start of run, hr |
| T | Absolute temperature (°K) |
| X | Dimensionless reactor length |
| Greek | |
| $\beta$ | Catalyst deactivation constant |
| $\gamma$ | Catalyst deactivation constant |
| $\Phi(t_c)$ | Catalyst decay as a function of catalyst residence time, $\frac{1}{1+3t_c^{\gamma}}$, (dimensionless) |
| $\sigma_C^2$ | Sum of the square of the deviations for C lump |
| $\sigma_G^2$ | Sum of the square of the deviations for G lump |
| $\sigma_L^2$ | Sum of the square of the deviations for LFO |

APPENDIX II

Development of Reactor Model

When gaseous chemical reactions occur which produce a change in the molecular weight of the reacting mixture (e.g., cracking reactions), the gas density changes accordingly. If these reactions take place in a tubular flow reactor, then this density variation produces a corresponding change in the linear velocity of the flowing gas. This needs to be modeled into the reactor description.

If inert gases are present in the reaction mixture, they too will influence this linear velocity and the reactant concentrations.

To formulate a reactor model, several assumptions must be made concerning the flow in the reactor, both of gas and solids.

Assumptions in Reactor Model

1. Reactor cross section is uniform.
2. Void fraction is uniform.
3. Mass flow rate through reactor is steady and in plug flow.

From 1, 2, and 3 and the equation of continuity (i.e., mass balance) G, the mass velocity, is constant throughout the bed.

That is, $G = \rho u =$ constant where

G = Mass velocity, g/(cm² free cross section)(hr)
u = Gas velocity in the bed, cm/hr
$\rho$ = Gas density, g/cm³

A component material balance on a differential section of the reactor gives $$\left(\frac{\delta \rho a_j}{\delta t_c}\right) + G\left(\frac{\delta a_j}{\delta x}\right)_{t_c} = r_j$$

where $a_j$ = Concentration of component, j, moles j/g gas
$r_j$ = Rate of formation of component, j, moles j/(cm³ gas)(hr)
$t_c$ = Time from start of run, hr
$x$ = Distance into reactor from inlet, cm No assumptions have been made to this point about the reaction kinetics so the model is still perfectly general.

Rate of Reaction

It is assumed that the rate of disappearance of a chemical species, j, in a single reaction is proportional to the molar concentration of species j (i.e., $\rho a_j$), and the mass density of catalyst relative to the gas volume (i.e., $C_c/\epsilon$).

(NOTE: $C_c$ is defined as g catalyst/cm³ bed; $\epsilon$ is bed void fraction). It is further assumed that the adsorption of heavy inert aromatic rings on the catalyst surface will influence the availability of active sites and consequently the rate of reaction, thus $$r_j = -k_j'(\rho a_j)\left(\frac{C_c}{\epsilon}\right)\frac{1}{1+K_h C_{Ah}}$$

The rate of constant, $k_j'$, has units of (g catalyst/cm³)$^{-1}$ (hr)$^{-1}$. Combining the rate and material balance equation, $$\left(\frac{\delta \rho a_j}{\delta t_c}\right)_x + G\left(\frac{\delta a_j}{\delta x}\right)_{t_c} = -k_j'\delta a_j\frac{C_c}{\epsilon}\frac{1}{1+K_h C_{Ah}}$$

The rate constant need not be constant but can decay with time.

Conversion to Laboratory Units

Experimental data are not usually reported in the form used by the model equation. Mass fractions usually replace moles/g gas, space velocity replaces mass velocity and so on. To make this model more readily useful, therefore, we have changed it to accept usual laboratory data.

Let X = X/L = dimensionless distance into bed
$S_{WH}$ = g feed (oil + inerts)/(hr) (g catalyst)

NOTE: $S_{WH}$ is not the same as the weight hourly space velocity generally reported, i.e., g oil/hr g catalyst, which neglects the effect of inerts. In this discussion $S_{WH}$ will be used exclusively; it is the True Weight Hourly Space Velocity.

From the definitions of G and $S_{WH}$ $$G = \frac{S_{WH} C_c L}{\epsilon}$$

Assuming that the rate of concentration change with time, $$\left(\frac{\delta \rho a_j}{\delta t_c}\right)_x$$

is small relative to the rate of change with position in a fluidized dense bed this is tantamount to saying that the oil molecules traverse the bed so fast that they see catalyst of essentially the same age then our model becomes $$\frac{da_j}{dX} = -\frac{1}{1 + K_h C_{Ah}} \frac{K_j' \rho a_j}{S_{WH}}$$

Now introduce catalyst decay as a function of catalyst residence time, $t_c$. Assume, too, that the decay is non-selective:

$$k_j' = k_j \phi(t_c)$$

where $k_j$ are invariant rate constants With the ideal gas assumption $$\rho = \frac{P \overline{MW}}{RT}$$

then $$\frac{da_j}{dX} = -\frac{1}{1 + K_h C_{Ah}} \frac{\Phi(t_c) P \overline{MW} k_j a_j}{S_{WH} RT}$$

In matrix notation $$\frac{d\underset{\sim}{a}}{dX} = \frac{1}{1 + K_h C_{Ah}} \frac{P \overline{MW} \Phi(t_c)}{S_{WH} RT} \underset{\approx}{K} \underset{\sim}{a}$$

This system is not linear because MW is not constant. It changes with distance into the bed.
Note that $$\overline{MW} = \frac{\Sigma a_j M_j}{\Sigma a_j} = \frac{1}{\Sigma a_j}$$

since the units for $a_j$ is moles j/gm of gas. The computer program solves this system of ordinary differential equations numerically using an extrapolation to zero routine.

Coordinate Transformation in Fixed and Fluidized Dense Beds

Experimental runs using fluid and fixed beds often obtain products collected over the duration of a run. If catalyst decay is present, then this collected material represents the mixed average reactor effluent. To account for time-averaging it is necessary to integrate the model equations from bed inlet to outlet (X = 0 to X = 1) and then integrate the reactor effluent over the duration of the run ($t_c = 0$ to $t_c = t_{run}$).

To simplify greatly the calculational effort, the following coordinate transformation is performed.
Let $$dW = \frac{\Phi(t_c) P}{S_{WH} RT} dX$$

This transformation of the reaction coordinate, X, yields a "crazy clock time" W which incorporates into its definition the effect of $S_{WH}$ and $t_c$ and is given by:

$$W = \frac{\Phi(t_c) P}{S_{WH} RT} X$$

Note that this transformation holds only for fixed or fluidized dense beds (for a riser $\Phi(t_c) = f(X)$).

The model becomes simply $$\frac{d\underset{\sim}{a}}{dW} = \frac{1}{1 + K_h C_{Ah}} \frac{\underset{\approx}{K} \underset{\sim}{a}}{\sum_j a_j}$$

To see that this single result can be quite useful, determine the mixed average concentration for a particular run.

From the initial conditions (the specific feedstock) integrate the model equation to give a as a function of W.

Next evaluate W for X = 1 (reactor outlet)

$$W = \frac{\Phi(t_c) P}{S_{WH} RT}$$

where P, R, T, $S_{WH}$ are known from the run.

Next choose six times from 0 to $t_c$ according to a 6-point Gaussian quadrature integration formula. Using the equation above this specifies the six transformed coordinate values at which a(W) is evaluated and supplied to the Gaussian formula. This together with the appropriate weighting factors gives the time-averaged composition.

For any given feed composition, only one evaluation of $a_j$ vs. W is required, thus computation time is substantially reduced.

It is important that the significance of this coordinate change not be overlooked. With one set of solutions $\underset{\sim}{a}$ vs. W, we know the reactor effluent for all $S_{WH}$ and $t_c$ for both fixed and fluid beds.

APPENDIX III

```
      PROGRAM MAIN
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/MDATA,J,N,OBJ1,OBJ2,OBJCOM,NRATE,D98,STEP,N1,N2,NP
      TYPE REAL MWOILL,MWOILH,MWOIL,MWIN,LBAR
      CALL MEMLEFT
      PRINT 7
```

-continued

```
    7 FORMAT(40H1 INPUT DATA FOLLOWS                                    )
      READ 1 ,NDATA,NRATE,N,ISEARCH,IPLOT,NP,STEP,SSTOP,D98
      PRINT 1,NDATA,NRATE,N,ISEARCH,IPLOT,NP,STEP,SSTOP,D98
    1 FORMAT(6I3,12X,2F10.4,22X,A8)
C     SET ISEARCH=1 IF SEARCH IS REQUIRED
C     SET IPLOT=1   IF PLOT IS REQUIRED
C
      READ 3, (RK(J), J=1,NRATE)
      PRINT 3, (RK(J), J=1,NRATE)
    3 FORMAT(8F10.2)
      DO 5 I=1,NDATA
      READ 6, (PP(I,J), J=1,15)

      PRINT 6, (PP(I,J), J=1,15)
    6 FORMAT(3X,A7,7F10.4/10X,7F10.4)
      READ 2, (FF(I,J),J=2,14)
      PRINT 2, (FF(I,J),J=2,14)
      READ 201, (RR(I,J),J=1,9 )
      PRINT 201, (RR(I,J),J=1,9 )
  201 FORMAT(3X,A8,F9.4,6F10.4/10X,7F10.4)
    5 CONTINUE
    2 FORMAT(10X,7F10.4)
C
C     INPUT DATA HAS THE FOLLOWING FORM -
C  ARRAY PP(J,K) RELATES TO PRODUCT ANALYSIS, FF(J,K) TO FEED, AND
C RR(J,K) TO REACTOR CONDITIONS.  THE J REPRESENTS THE RUN NUMBER,
C  THE K REPRESENTS THE PARTICULAR ITEM OF DATA.


C
C     THUS, IN ARRAY F, FOR ANY RUN J
C
C FF(J,2)=WT PCT P-HEAVY IN HEAVY FUEL OIL
C       3 =WT PCT P-LIGHT IN LIGHT FUEL OIL
C       4 =WT PCT N-HEAVY IN HEAVY FUEL OIL
C       5 =WT PCT  N-LIGHT IN LIGHT FUEL OIL
C       6 =WT PCT  HEAVY FUEL OIL
C       7 =CP HEAVY, PCT
C       8 =CN HEAVY, PCT
C       9 =CP LIGHT, PCT
C      10 =CN LIGHT, PCT
C      11 =MW LIGHT FUEL OIL (P,N,A ASSUMED THE SAME)
C      12 =MW HEAVY FUEL OIL (P,N,A ASSUMED THE SAME)
C      13 =WT PCT SULPHUR IN FUEL OIL
C      14 =WT PCT NITROGEN IN FUEL OIL
C
C
C      IN ARRAY P, FOR ANY RUN J
C
C PP(J,2)=WT PCT GASOLINE IN PRODUCT HYDROCARBON
C       3 =WT PCT C LUMP IN PRODUCT HYDROCARBON
C       4 =WT PCT LIGHT FUEL OIL IN PRODUCT HYDROCARBON
C       5 =WT PCT C1
C       6 =        C2 PRIME
C       7 =        C3
C       8 =        C3 PRIME
C       9 =      N-C4
C      10 =      I-C4
C      11 =        C4 PRIME
C      12 =      N-C5
C      13 =      I-C5
C      14 =        C5 PRIME
C      15 =        COKE
C
C
C      IN ARRAY R
C
C RR(J,2)= REACTOR TYPE (1.0=DENSE FLUID BED)
C                       (2.0=RISER          )
C                       (3.0=PILOT PLANT- INSTANTANEOUS DATA)
C RR(J,3)= WEIGHT HOURLY SPACE VELOCITY,GRAMS OIL/HR GRAM CATALYS
C       4 = CATALYST RESIDENCE TIME,MIN
C       5 = NITROGEN, MOLE PCT,((MOLES N2 /(MOLES(N2+OIL))*100.)
```

-continued

```
C       6 = H20, WT PCT ((GRAMS H20/(GRAMS(H20+OIL)))(100.)
C       7 = TEMPERATURE, DEGREES F.
C       8 = PRESSURE, PSIG
C       9 = CARBON ON CATALYST
C
C
C     RK(1)=KALG     RK(2)=KALC     RK(3)=KNLG
C     RK(4)=KNLC     RK(5)=KPLG     RK(6)=KPLC
C     RK(7)=KGC      RK(8)=BETA     RK(9)=GAMMA
C     RK(10)=KAHAL   RK(11)=KNHNL   RK(12)=KPHPL
C     RK(13)=KAHG    RK(14)=KAHC    RK(15)=KNHG
C     RK(16)=KNHC    RK(17)=KPHG    RK(18)=KPHC


C     RK(19)=KCAHC  RK(20)=KCAHCAL      RK(21)=KAHCAL       RK(22)
C     RK(23)=SCALE FACTOR FOR P,N,A LIGHT AND HEAVY TO GASOLINE
C     RK(24)=SCALE FACTOR FOR P,N,A LIGHT AND HEAVY TO CLUMP
C     RK(25)=SCALE FACTOR FOR GASOLINE TO CLUMP
C     RK(26)=SCALE FACTOR FOR P,N,A HEAVY FUEL OIL TO LIGHT FUEL OI
C     RK(27)=NITROGEN POISON TERM
C     RK(30) EFFECT OF CARBON ON REGEN CAT- GASOLINE FORMATION REAC
C     RK(31) EFFECT OF CARBON ON REGEN CAT- CLUMP FORMATION REACTIC
C     RK(32) EFFECT OF CARBON ON REGEN CAT- GASOLINE CRACKING REACT
C     RK(33) SCALE FACTOR FOR ALL REACTIONS- ****UNIT FACTOR*******
C     RK(34)=ADSORBTION TERM FOR CATALYST POISONING DUE TO CA HEAVY
C     RK(35) ACTIVATION ENERGY FOR AH AND AL TO GASOLINE
C     RK(36) ACTIVATION ENERGY FOR AH,AL,CH,CL TO C LUMP
C     RK(37) ACTIVATION ENERGY FOR PH,PL,NH,NL TO GASOLINE
C     RK(38) ACTIVATION ENERGY FOR PH,PL,NH,NL TO C LUMP
C     RK(39) ACTIVATION ENERGY FOR ALL LFO FORMATION REACTIONS
C     RK(40) ACTIVATION ENERGY FOR GASOLINE TO C LUMP
      CALL CONVERT
      OBJCOM=1.0E+20
      N1=1
      N2=NDATA
      IF(ISEARCH.EQ.1) 105,120
  105 CONTINUE
      CALL REACTR
   70 OBJSTR=OBJCOM
      DO 100 L=33,33
   80 RK(L)=RK(L)*(1.0+STEP)
      CALL REACTR
      IF(OBJ2.LE.OBJ1) 100,90
   90 RK(L)=RK(L)*(1.0-STEP)/(1.0+STEP)
      CALL REACTR
      IF(OBJ2.LE.OBJ1) 100,91
   91 RK(L)=RK(L)/(1.0-STEP)
  100 CONTINUE
      COMP=OBJSTR*0.999
      IF(OBJCOM.LT.COMP) 70,71
   71 CONTINUE
      IF(STEP.LE.SSTOP) 120,121
  121 STEP=STEP/2
      GO TO 70
  120 CONTINUE
C     COMPUTE AVERAGE ERRORS AND SE ON EACH OF G,C,L
      SUM1=0.0
      SUM2=0.0
      SUM3=0.0
      SUM4=0.0
      SUM5=0.0
      SUM6=0.0
      CALL REACTR
      DO 1000  J=1,NDATA
      SUM1=SUM1+ABS(PP(J,2)-GBAR(J))
      SUM2=SUM2+ABS(PP(J,3)-CBAR(J))
      SUM3=SUM3+ABS(PP(J,4)-LBAR(J))
      SUM4=SUM4+   (PP(J,2)-GBAR(J))**2
      SUM5=SUM5+   (PP(J,3)-CBAR(J))**2
      SUM6=SUM6+   (PP(J,4)-LBAR(J))**2
```

-continued

```
1000 CONTINUE
     SUM1=SUM1/NDATA
     SUM2=SUM2/NDATA
     SUM3=SUM3/NDATA
     SUM4=SQRT(SUM4/(NDATA))
     SUM5=SQRT(SUM5/(NDATA))
     SUM6=SQRT(SUM6/(NDATA))
     PRINT 98
     PRINT 99
  98 FORMAT(//,51H      AVERAGE ERRORS                STANDARD ERRORS    )
  99 FORMAT(     60H  G LUMP     C LUMP     LFO      G LUMP     C LUMP
    1LFO            )
     PRINT 101, SUM1,SUM2,SUM3,SUM4,SUM5,SUM6
 101 FORMAT(10E10.2)
     CALL OUTPUT
     IF (IPLOT.EQ.1) 109,111
 109 CONTINUE
     CALL PLOTTING
 111 CONTINUE
     STOP
     END
```

```
PROGRAM          MAIN
                                IDENT     MAIN
RANGE                FWA   -   LWA+1
                    32555      33255
ENTRY POINTS
                    32627       MAIN
EXTERNAL SYMBOLS
                    00001   Q1005100
                    00002   Q1010010
                    00003    MEMLEFT
                    00004    CONVERT
                    00005     REACTR
                    00006        ABS
                    00007       SQRT
                    00010     OUTPUT
                    00011   PLOTTING
                    00012   QBOSTOPS
                    00013   QBQINGIN
                    00014   QBQENGIN
                    00015   QBQGINTY
                    00016   QBQINGOT
                    00017   QBQENGOT
                    00020   QBQGOTTY
                    00021   QBQENTRY
  NO DOUBLY DEFINED                          000
  NO UNDEFINED SYMBOLS
  NO ASSEMBLY ERRORS
     NULLS
                          BETA1       BETA2       BETA3       BETA4      NREACT
                            RK8         RK9        RK10        RK11        RK12
                           RK13      MWOILL      MWOILB       MWIN           Z
                          RATHL       RATHG       RATLG          R       MWOIL
                              F        TIME         TIM       GOGTO           P
                             YY        YBAR           S          CH          CL
                        ENDING.          .5        .105         .80       .1000
                           .109
```

-continued

-continued

```
      SUBROUTINE REACTR
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D96,STEP,N1,N2,NP
      TYPE REAL MWOILL,MWOILH,MWOIL,MWIN,LBAR
      DIMENSION Y(50)
      DIMENSION RKS(25)
      IF(N1.EQ.N2) 9,994
  994 PRINT 995
  995 FORMAT(1H1)
      PRINT 996
  996 FORMAT(8X,112H    G_LUMP   G_LUMP    C_LUMP   C_LUMP     LFO     LFO
     1   AH      NH      PH      CH      AL      NL      PL      CL          )
      PRINT 997
  997 FORMAT(8X, 56H      PRED   OBS        PRED   OBS        PRED    OBS )
    9 OBJ1=OBJCOM
   10 OBJ2=0.0
      NTIME=6
      EPS=1.0E-06
      FUNC=0.0
      DO 981 K1=1,22
  981 RKS(K1)=RK(K1)
      DO 40 J=N1,N2
      TTERM=1.0/R(J,7)-1.0/755.2
C     ADJUST FOR ACTIVATION ENERGIES
      E1=EXP(-RK(35)*TTERM/1.987)                                    A    TO C
      E2=EXP(-RK(36)*TTERM/1.987)                                    A,CATO C
      E3=EXP(-RK(37)*TTERM/1.987)                                    P,N TO C
      E4=EXP(-RK(38)*TTERM/1.987)                                    P,N TO C
      E5=EXP(-RK(39)*TTERM/1.987)                                    ALL LFO
      E6=EXP(-RK(40)*TTERM/1.987)                                    G    TO C
      RK(1)=RK(1)*E1
      RK(13)=RK(13)*E1
      RK(2)=RK(2)*E2
      RK(14)=RK(14)*E2
      RK(19)=RK(19)*E2
      RK(22)=RK(22)*E2
      RK(3)=RK(3)*E3
      RK(5)=RK(5)*E3
      RK(15)=RK(15)*E3
      RK(17)=RK(17)*E3
      RK(4)=RK(4)*E4
      RK(6)=RK(6)*E4
      RK(16)=RK(16)*E4
      RK(18)=RK(18)*E4
      RK(10)=RK(10)*E5
      RK(11)=RK(11)*E5
      RK(12)=RK(12)*E5
      RK(20)=RK(20)*E5
      RK(21)=RK(21)*E5
      RK(7)=RK(7)*E6
      ADJUST SCALE FACTORS IF ASKED FOR
```

-continued

```
      BETA1=RK(23)*RK(33)
      BETA2=RK(24)*RK(33)
      BETA3=RK(25)*RK(33)
      BETA4=RK(26)*RK(33)
C     ADJUST RATE CONSTANTS FOR CARBON ON REGENERATED CATALYST
      BETA1=BETA1*(1.0-RK(30)*RR(J,9))
      BETA2=BETA2*(1.0-RK(31)*RR(J,9))
      BETA3=BETA3*(1.0-RK(32)*RR(J,9))
      BETA4=BETA4*(1.0-RK(30)*RR(J,9))
C     ADJUST IF CATALYST IS D9B
      IF(RR(J,1).EQ.D9B)  350,351
  350 BETA1=BETA1*1.20
      BETA3=BETA3*1.025
  351 CONTINUE
C
C  FORM INITIAL CONDITIONS OF P,N,AND A LUMPS
C
      Y(1)=F(J,16)
      Y(2)=F(J,5)
      Y(3)=F(J,3)
      Y(4)=0.0
      Y(5)=F(J,15)
      Y(6)=F(J,4)
      Y(7)=F(J,2)
      Y(8)=F(J,17)
      Y(9)=F(J,18)
      Z(5)=0.0                                                    C
      Z(6)=0.0                                                    ******
      Z(6)=R(J,5)+R(J,6)                                          I
C
      DO 100 K=1,N
  100 S(K)=0.0
C
      NREACT=RR(J,2)+0.1
      IF(NREACT.EQ.3) 302,301
  301 CONTINUE
      IF(NREACT.EQ.1) 200,201
  201 CONTINUE
C *** TIME AVERAGED FLUIDISED DENSE BED *****
      CALL GAUSS6
      X=0.0
      H=TIM(1)
      DO 108 K=1,NTIME
      T=TIM(K)
  105 CALL DEXTRA(N,X,Y,H,EPS,S)
      IF(X.LT.T) 106,110
  106 H=AMIN1(H,T-X)
      GO TO 105
  110 H=AMIN1(H,TIM(K+1)-X)
C    STORE OUTPUT CONC,S IN YY
      YY(1,K)=Y(1)                                                AL
      YY(2,K)=Y(2)                                                NL
      YY(3,K)=Y(3)                                                PL
      YY(4,K)=Y(4)                                                GAS
      YY(5,K)=Z(5)                                                CLU
      YY(6,K)=Y(1)+Y(2)+Y(3)+Y(9)                                 LFC
```

-continued

```
      YY(7,K)=Y(5)
      YY(8,K)=Y(6)
      YY(9,K)=Y(7)
      YY(10,K)=Y(8)                                                    CAL
      YY(11,K)=Y(9)                                                    CAL
  108 CONTINUE
C NOW HAVE COMPLETED    FULL RUN ON FEED J
C
C COMPUTE  AVERAGED YIELDS,YBAR(J,L)
      DO 155 L=1,11
      YBAR(1,L)=0.08566225*(YY(L,1)+YY(L,6))+0.1803808*(YY(L,2)+YY(L,5))
      YBAR(1,L)=    (YBAR(1,L)+0.2339570*(YY(L,3)+YY(L,4)))
  155 CONTINUE
      YBAR(1,1)=YBAR(1,1)*MWOILL(J)/GOGTO(J)*100.0
      YBAR(1,2)=YBAR(1,2)*MWOILL(J)/GOGTO(J)*100.0
      YBAR(1,3)=YBAR(1,3)*MWOILL(J)/GOGTO(J)*100.0
      YBAR(1,11)=YBAR(1,11)*MWOILL(J)/GOGTO(J)*100.0
      YBAR(1,7)=YBAR(1,7)*MWOILH(J)/GOGTO(J)*100.0
      YBAR(1,8)=YBAR(1,8)*MWOILH(J)/GOGTO(J)*100.0
      YBAR(1,9)=YBAR(1,9)*MWOILH(J)/GOGTO(J)*100.0
      YBAR(1,10)=YBAR(1,10)*MWOILH(J)/GOGTO(J)*100.0
      GBAR(J)=YBAR(1,4)*10000./GOGTO(J)
      CBAR(J)=YBAR(1,5)*4000./GOGTO(J)
      LBAR(J)=YBAR(1,6)*MWOILL(J)/GOGTO(J)*100.0
      GO TO 202
C ***********************************************
  201 CONTINUE
C *** RISER CALCULATION ********************
      T=1.0
      X=0.0
      H=0.5
  205 CALL DEXTRA(N,X,Y,H,EPS,S)
      IF(X.LT.T) 206,210
  206 H=AMIN1(H,T-X)
      GO TO 205
  210 CONTINUE
      GBAR(J)=Y(4)*10000./GOGTO(J)
      CBAR(J)=Z(5)*4000./GOGTO(J)
      LBAR(J)=(Y(1)+Y(2)+Y(3)+Y(9))*MWOILL(J)/GOGTO(J)*100.0
C ***********************************************
      GO TO 202
C *** INSTANTANEOUS FLUIDISED BED REACTOR  ***************
  302 X=0.0
      T=R(J,6)/(R(J,3)*0.082*R(J,7))*1.0/(1.+RK(8)*(R(J,4))**RK(9))
      H=0.5*T
  305 CALL DEXTRA(N,X,Y,H,EPS,S)
      IF(X.LT.T) 306,310
  306 H=AMIN1(H,T-X)
      GO TO 305
  310 CONTINUE
      GBAR(J)=Y(4)*10000./GOGTO(J)
      CBAR(J)=Z(5)*4000./GOGTO(J)
      LBAR(J)=(Y(1)+Y(2)+Y(3)+Y(9))*MWOILL(J)/GOGTO(J)*100.0
C ***********************************************
  202 CONTINUE
      FUNC=FUNC+(PP(J,2)-GBAR(J))**2+(PP(J,3)-CBAR(J))**2
```

—Continued

```
      PRINT 90,PP(J,1), GBAR(J),PP(J,2),CBAR(J),PP(J,3),LBAR(J),PP(J,4),
     1YBAR(1,7),YBAR(1,8),YBAR(1,9),YBAR(1,10),YBAR(1,1),YBAR(1,2),
     2YBAR(1,3),YBAR(1,11)
   90 FORMAT(1X,A7,3(5X,F5.2,2X,F5.2),8(2X,F5.2))
      DO 980 K1=1,22
  980 RK(K1)=RKS(K1)
   40 CONTINUE
      OBJ2=SQRT(FUNC/(NDATA))
      IF(OBJ2.LE.OBJCOM) 131,141
  131 OBJCOM=OBJ2
  141 CONTINUE
      IF(N1.EQ.N2) 101,993
  993 PRINT 998,OBJCOM,OBJ2,FUNC,STEP
  998 FORMAT(//,5H SF= ,E12.4,10X,18HSE FOR TRIAL STEP=,E12.4,10X,5H PHI
     1=,E12.4,10X, 10HSTEP SIZE=, F6.4,//,12H PARAMETERS )
      PRINT 999,(RK(J), J=1,NRATE)
  999 FORMAT(10E12.4)
  101 RETURN
      END
```

```
SUBROUTINE      REACTR

                          IDENT     REACTR
RANGE              FWA -  LWA+1
                  32555    33532
ENTRY POINTS
                  32746    REACTR
EXTERNAL SYMBOLS
                  00001  Q1Q10100
                  00002  Q2Q07111
                  00003  Q1Q10010
                  00004       EXP
                  00005    GAUSS6
                  00006    DEXTRA
                  00007     AMIN1
                  00010      SQRT
                  00011  Q80INGOT
                  00012  Q80ENGOT
                  00013  Q80GOTTY
                  00014  Q80ENTRY
   NO DOUBLY DEFINED                          000
   NO UNDEFINED SYMBOLS
   NO ASSEMBLY ERRORS
     NULLS                      RK8        RK9       RK10       RK11       RK12
                               RK13       MWIN      RATHL      RATHG      RATLG
                              MWOIL         FF       TIME          P         CH
                                 CL         NP        .10       .981       .350
                               .100       .200       .106       .108       .155
                               .206       .306       .980        .40
```

—Continued

```
      SUBROUTINE GAUSS6
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,C9B,STEP,N1,N2,NP
      TYPE REAL MWOILL,MWOILH,MWOIL,MWIN,LBAR
C     RK(8)=BETA
C     RK(9)=GAMMA
      PHI(XXX)=1.0/(1.0+RK(8)*XXX**RK(9))
     1*1.0/(1.0+(RK(27)*GMSN2            *XXX)**2.0)
      GMSN2=FF(J,14)*  R(J,3)*GOGTO(J)
      C1=0.4662348
      C2=0.3306047
      C3=0.1193096
      TC=R(J,4)
  100 A=0.5*(TC)
      B=TC
  300 TIME(1)=A-C1*B
      TIME(2)=A-C2*B
      TIME(3)=A-C3*B
      TIME(4)=A+C3*B
      TIME(5)=A+C2*B
      TIME(6)=A+C1*B
      DO 400 K=1,6
      TIM(K)=PHI(TIME(7-K))/RR(J,3)                                  ********
      TIM(K)=PHI(TIME(7-K))*R(J,8)/(R(J,3)*0.082*R(J,7))
  400 CONTINUE
      RETURN
      END
```

– Continued

```
SUBROUTINE      GAUSS6
                                IDENT     GAUSS6
RANGE                FWA   -   LWA+1
                    32555      32713
ENTRY POINTS
                    32601     GAUSS6
EXTERNAL SYMBOLS
                    00001   02007111
                    00002   08QENTRY
      NO DOUBLY DEFINED                          443
      NO UNDEFINED SYMBOLS
      NO ASSEMBLY ERRORS
        NULLS
                                BETA1       BETA2       BETA3       BETA4      NREACT
                                  RK8         RK9        RK10        RK11       RK12
                                 RK13      MWOILL      MWOILH        MWIN           Z
                                RATHL       RATHG       RATLG       MWOIL           F
                                 LBAR        GBAR        CBAR          PP           P
                                   YY        YBAR           S          CH          CL
                                NDATA           N        OBJ1        OBJ2      OBJCOM
                                NRATE        D98        STEP          N1          N2
                                   NP        .100        .300        .400
```

—Continued

```
      SUBROUTINE CONVERT
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CPAR(100),PP(100,20),P(100,20)
     1,YY(20,10),YBAR(1,20),S(50),CH(100),CL(100)
      COMMON/SEARCH/NDATA,J,N,OBJ1,OBJ2,CRJCOM,NRATE,D9B,STEP,N1,N2,NP
      TYPE REAL MWOILL,MWOILH,MWOIL,MWIN,LBAR
C  CONVERT TO A TOTAL FEED BASIS
C
      DO 1 J=1,NDATA
      RATHL(J)=FF(J,12)/FF(J,11)
      RATHG(J)=FF(J,12)/100.
      RATLG(J)=FF(J,11)/100.
      MWOILH(J)=FF(J,12)
      MWOILL(J)=FF(J,11)
      MWOIL(J)=100.                                                    *******
      MWOIL(J)=100./((100.-FF(J,6))/FF(J,11)+FF(J,6)/FF(J,12))
      GH20 = (RR(J,6)/(100.-RR(J,6)))*(1.0+(RR(J,5)/(100.-RR(J,5))))/
     1        (1.0-((RR(J,6)/(100.-RR(J,6)))*(RR(J,5)/(100.-RR(J-5)))
     2        *28./18.))
      GN2      =RR(J,5)*((28./MWOIL(J))+((28.*GH20/18.)))/(100.-RR(J,5))
      GOGTO(J)=1.0                                                     *******
      GOGTO(J)=1.0/(1.0+GH20+GN2)
      MWIN(J)=0.0                                                      *******
      MWIN(J)=(GH20+GN2)/(GH20/18.+GN2/28.)
C
C  CONVERSION TO MOLES PER GRAM FOR HEAVY AND LIGHT FEED
      CH(J)=FF(J,6)/1000000.                                           *******
      CH(J)=FF(J,6)*GOGTO(J)/(FF(J,12)*10000.)
      CL(J)=(100.-FF(J,6))/1000000.                                    *******
      CL(J)=(100.-FF(J,6))*GOGTO(J)/(FF(J,11)*10000.)
      F(J,2)= FF(J,2)*CH(J)                                            PH
      F(J,3)= FF(J,3)*CL(J)                                            PL
      F(J,4)= FF(J,4)*CH(J)                                            NH
      F(J,5)= FF(J,5)*CL(J)                                            NL
      F(J,15)=(100.-FF(J,2)-FF(J,4))*CH(J)                             AH
      F(J,16)=(100.-FF(J,3)-FF(J,5))*CL(J)                             AL
      F(J,17)=(100.-FF(J,7)-FF(J,8))*CH(J)                             CAH
      F(J,18)=(100.-FF(J,9)-FF(J,10))*CL(J)                            CAL
      F(J,15)=F(J,15)-F(J,17)                                          AH-CAH
      F(J,16)=F(J,16)-F(J,18)                                          AL-CAL
C     IF BASIC NITROGEN IS LESS THAN 0.04 PERCENT NEGLECT N POISONING
      IF(FF(J,14).LT.0.05) 998,999
  998 FF(J,14)=0.00
  999 CONTINUE
C
C
C  CONVERSION OF REACTOR VARIABLES
C
      R(J,3) =RR(J,3)/GOGTO(J)                                         SWH
      R(J,4) =RR(J,4)/60.                                              TC
      R(J,5) =GN2*GOGTO(J)/28.                                         N2
      R(J,6) =GH20*GOGTO(J)/18.                                        H20
      R(J,7) =(RR(J,7)+460.)*5./9.                                     TEMP
```

—Continued

```
      R(J,8) =(RR(J,8)+14.7)/14.7                                    PRESS
    1 CONTINUE
      RETURN
      END
```

```
SUBROUTINE      CONVERT

                                IDENT     CONVERT
RANGE                FWA   -   LWA+1
                    32555     32755
ENTRY POINTS
                    32555   CONVERT
EXTERNAL SYMBOLS
                    00001   QBUENTRY
     NO DOUBLY DEFINED                          463
     NO UNDEFINED SYMBOLS
     NO ASSEMBLY ERRORS
       NULLS                    BETA1        BETA2        BETA3        BETA4       NREACT
                                  RK8          RK9         RK10         RK11         RK12
                                 RK13           RK            Z         TIME          TIM
                                 LBAR         GBAR         CBAR           PP            P
                                   YY         YBAR            S            N         OBJ1
                                 OBJ2       OBJCOM        NRATE          D98         STEP
                                   N1           N2           NP         .998           .1
```

—Continued

—Continued

```
      SUBROUTINE FOXY(X,Y,DY,NUMYS)
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YHAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION DY(50),Y(50)
C  FOR SIMPLE P,N,A LUMPING
      Z(5)=(1.0-((Y(1)+Y(2)+Y(3)+Y(9))*MWOILL(J)+(Y(5)+Y(6)+Y(7)+Y(8))*   C LUMP
     1 MWOILH(J)+Y(4)*100.0+Z(6)*MWIN(J)))/40.0
      EANMW=1.0                                                          ********
      EANMW=1.0/(Y(1)+Y(2)+Y(3)+Y(4)+Y(5)+Y(6)+Y(7)+ Y(8)+Y(9)+0.75*Z(5)
     1+Z(6))*1.0/(1.0+RK(34)*(Y(8)*MWOILH(J)))
      IF(NREACT.EQ.2) 2,1
    2 EANMW=EANMW/(1.+RK(8)*(X*R(J,4))**RK(9))*R(J,8)/(R(J,3)*0.082*
     1R(J,7))
    1 CONTINUE
      DY(5)=-EANMW*(RK(10)*BETA4+RK(13)*BETA1+RK(14)*BETA2+RK(21)*BETA4)
     1*Y(5).
      DY(6)=-EANMW*(RK(11)*BETA4+RK(15)*BETA1+RK(16)*BETA2 )*Y(6)
      DY(7)=-EANMW*(RK(12)*BETA4+RK(17)*BETA1+RK(18)*BETA2 )*Y(7)
      DY(8)=-EANMW*(RK(20)*BETA4+RK(19)*BETA2)*Y(8)                      CAH
      DY(9)= EANMW*(RK(20)*BETA4*Y(8)*RATHL(J)+RK(21)*BETA4*Y(5)*RATHL(J  CAL
     1)-RK(22)*BETA2*Y(9))
      DY(1)= EANMW*(RK(10)*BETA4*Y(5)*RATHL(J)-(RK(1)*BETA1+RK(2)*BETA2
     1 )*Y(1))
      DY(2)= EANMW*(RK(11)*BETA4*Y(6)*RATHL(J)-(RK(3)*BETA1+RK(4)*BETA2
     1 )*Y(2))
      DY(3)= EANMW*(RK(12)*BETA4*Y(7)*RATHL(J)-(RK(5)*BETA1+RK(6)*BETA2
     1 )*Y(3))
      DY(4)= EANMW*((RK(13)*BETA1*Y(5)+RK(15)*BETA1*Y(6)+RK(17)*BETA1*
     1 Y(7))*RATHG(J)+(RK(1)*BETA1*Y(1)+RK(3)*BETA1 *Y(2)+RK(5)*BETA1 *
     2 Y(3))*RATLG(J)-RK(7)*BETA3*Y(4))
      RETURN
      END
```

—Continued

```
SUBROUTINE      FOXY
                                IDENT     FOXY
RANGE              FWA   -   LWA+1
                   32555     33027
ENTRY POINTS
                   32555      FOXY
EXTERNAL SYMBOLS
                   00001   Q2Q07111
                   00002   QBQENTRY
     NO DOUBLY DEFINED                          777
     NO UNDEFINED SYMBOLS
     NO ASSEMBLY ERRORS
        NULLS                  RK8        RK9       RK10       RK11       RK12
                              RK13         RR      MWOIL         FF          F
                              TIME        TIM      GOGTO       LBAR       GBAR
                              CBAR         PP          P         YY       YBAR
                                 S         CH         CL      NDATA          N
                              OBJ1       OBJ2     OBJCOM      NRATE        D9B
                              STEP         N1         N2         NP      NUMYS
                                ,2
```

—Continued

```
      SUBROUTINE OUTPUT
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION COEF(11,8),CLIGHT(11),RNAME(11)
      DIMENSION TEMPG(12)
      DATA((TEMPG(J), J=1,11)= 0.000,0.00,-0.325, 0.600,-0.34,-0.325,
     1 1.00,0.00,0.00, 2.15,0.00)
      DATA ((COEF(1,J), J=1,8)=
     1-0.05515, 0.3270,0.0938,0.1350,0.2057,0.0530,0.0743,0.1514          ) C1O5
      DATA ((COEF(2,J), J=1,8)=
     2-0.02346, 0.2060,0.1447,0.2911,0.1961,0.0598,0.2776,0.2636          ) C2=
      DATA ((COEF(3,J), J=1,8)=
     3-0.16730, 1.0780,0.0679,0.2296,0.0913,0.1360,0.2655,0.1153          ) C3
      DATA ((COEF(4,J), J=1,8)=
     4 0.25400, 0.3564,0.2424,0.0846,0.1523,0.1818,0.0822,0.1489          ) C3=
      DATA ((COEF(5,J), J=1,8)=
     5-0.03580, 0.3620,0.2909,0.3020,0.0935,0.2575,0.3804,0.2715          ) NC4
      DATA ((COEF(6,J), J=1,8)=
     6 0.00353, 1.3950,0.1551,0.3043,0.0901,0.2392,0.3271,0.1438          ) IC4
      DATA ((COEF(7,J), J=1,8)=
     7 0.12880,-0.0062,0.7972,0.3455,0.5723,0.5450,0.2469,0.5333          ) C4=
      DATA ((COEF(8,J), J=1,8)=
     8 0.05667,-0.0028,0.1747,0.1515,0.1590,0.2940,0.0687,0.2832          ) NC5
      DATA ((COEF(9,J), J=1,8)=
     9 0.18030,-0.0024,0.6819,0.7170,0.4393,0.8396,0.5500,0.7205          ) IC5
      DATA ((COEF(10,J), J=1,8)=
     A 0.08959,-0.0668,1.1540,0.0802,0.7801,0.1975,0.0515,0.7288          ) C5=
      DATA ((COEF(11,J), J=1,8)=
     1-0.06019, 0.3650,0.2812,0.4102,1.5260,0.6380,0.1906,0.9007          ) COKE
      DATA ((RNAME(L), L=1,10)=4HC2  ,4HC2= ,4HC3  ,4HC3= ,4HNC4 ,
     14HIC4 ,4HC4= ,4HNC5 ,4HIC5 ,4HC5=     )
      DO 1000  J=1,NDATA
      PRINT 5
    5 FORMAT(33H1 * FCC-OPERATING CONDITIONS *       ,//)
C *** LIGHT END AND COKE CORRELATION  ***
      AL=100.0-FF(J,3)-FF(J,5)
      AH=100.0-FF(J,2)-FF(J,4)
      ALR=(100.0-FF(J,6))/100.0
      AHR=FF(J,6)/100.0
      DO 9  L=1,11
      CLIGHT(L)=(COEF(L,1)*GBAR(J)+COEF(L,2)*CBAR(J))*((FF(J,2)*COEF(L,3
     1)+FF(J,4)*COEF(L,4)+AH*COEF(L,5))*AHR+(COEF(L,6)*FF(J,3)+COEF(L,7)
     2*FF(J,5)+COEF(L,8)*AL)*ALR)/100.0
C     TEMP CORRECTION FOR LIGHT ENDS
      CLIGHT(L)=CLIGHT(L)*(1.0+TEMPG(L)*(RR(J,7)-900.0)*0.01)
    9 CONTINUE
C *** CARBON ON CATALYST  C=A*TC**N   ***
      A   =(0.5200*FF(J,2)+.344*FF(J,4)+1.290*AH)*AHR+(0.5200*FF(J,3)+
     10.1680*FF(J,5)+0.8076*AL)*ALR
      CARB=A/100.0*(RR(J,4)/5.0)**0.1964
```

60

65

—Continued

```
      ECC=3700.0
      TTERM=1:0/R(J,7)-1.0/755.2
      CARB=CARB*EXP(-ECC*TTERM/1.987)
      CARB1=PP(J,15)*RR(J,3)*RR(J,4)/(60.0*1.15)
      COKE=CARB*60.0*1.15/(RR(J,3)*RR(J,4))
      PRINT 10, PP(J,1)
   10 FORMAT(14H CHARGE STOCK  ,A7,/)
      IF(RR(J,2).GT.1.0) 13,11
   11 PRINT 12
   12 FORMAT(47H REACTOR TYPE-FLUIDISED DENSE BED OR FIXED BED      ,/)
      GO TO 18
   13 CONTINUE
      IF(RR(J,2).GT.2.0) 16,14
   14 PRINT 15
   15 FORMAT(35H REACTOR TYPE-LABORATORY RISER        ,/)
      GO TO 18
   16 PRINT 17
   17 FORMAT(38H REACTOR TYPE-PILOT PLANT DENSE BED      ,/)
   18 CONTINUE
      PRINT 20, RR(J,3)
   20 FORMAT(35H WT OIL/HR/WT CATALYST                  ,F8.3 )
      PRINT 21, R(J,3)
   21 FORMAT(35H TRUE WHSV-WT FEED/HR/WT CATALYST       ,F8.3 )
      PRINT 22, RR(J,4)
   22 FORMAT(35H CATALYST RESIDENCE TIME MINUTES        ,F8.3 )
      PRINT 23, RR(J,5)
   23 FORMAT(35H NITROGEN-MOLE PCT                      ,F8.3 )
      PRINT 24, RR(J,6)
   24 FORMAT(35H STEAM-WT PCT                           ,F8.3 )
      PRINT 25, RR(J,7)
   25 FORMAT(35H REACTOR TEMPERATURE-DEG F              ,F8.3 )
      PRINT 26, RR(J,8)
   26 FORMAT(35H REACTOR PRESSURE-PSIG                  ,F8.3 )
      PRINT 27, RR(J,9)
   27 FORMAT(35H CARBON ON REGEN CATALYST-WT PCT        ,F8.3 )
      PRINT 30
   30 FORMAT(///,51H * YIELDS *                       OBSERVED   PREDICTED )
      PRINT 31
   31 FORMAT(     48H                                  WT PCT     WT PCT ,/)
      PRINT 35, PP(J,5),CLIGHT(1)
   35 FORMAT(30H C1                                 ,1X,F7.3,5X,F7.3)
      DO 36 L=1,10
   36 PRINT 37, RNAME(L),PP(J,L+4),CLIGHT(L)
   37 FORMAT(1X,A7,23X,F7.3,5X,F7.3)
      PRINT 38, PP(J,3),CBAR(J)
   38 FORMAT(30H C LUMP (C4- + COKE)                ,1X,F7.3,5X,F7.3)
      PRINT 39, PP(J,2),GBAR(J)
   39 FORMAT(30H G LUMP (C5 -430 DEG F)             ,1X,F7.3,5X,F7.3)
      PRINT 40, PP(J,4),LBAR(J)
   40 FORMAT(30H LFO    (430-650 DEG F)             ,1X,F7.3,5X,F7.3)
      HFOO=100.0-PP(J,3)-PP(J,2)-PP(J,4)
      HFOP=100.0-CBAR(J)-GBAR(J)-LBAR(J)
      PRINT 41, HFOO,HFOP
   41 FORMAT(30H HFO    (650+ )                     ,1X,F7.3,5X,F7.3)
      PRINT 45, CARB1,CARB
   45 FORMAT(30H CARB ON CAT-WT PCT-VOORHEES          ,1X,F7,3,5X,F7.3)
```

– Continued

```
      PRINT 46,        PP(J,15),COKE
   46 FORMAT(30H COKE WT PCT-VOORHEES                ,1X,F7.3,5X,F7.3)
      PRINT 47,              PP(J,15),CLIGHT(11)
   47 FORMAT(30H COKE WT PCT-CORRELATION             ,1X,F7.3,5X,F7.3)
 1000 CONTINUE
      RETURN
      END
```

—Continued

```
                                IDENT     OUTPUT
RANGE                 FWA  -  LWA+1
                     32555     33625
ENTRY POINTS
                     33203    OUTPUT
EXTERNAL SYMBOLS
                     00001  02007111
                     00002       EXP
                     00003  QBQINGOT
                     00004  QBQENGOT
                     00005  QBQGOTTY
                     00006  QBQENTRY
      NO DOUBLY DEFINED                          000
      NO UNDEFINED SYMBOLS
      NO ASSEMBLY ERRORS
         NULLS
                          BETA1        BETA2        BETA3        BETA4       NREACT
                           RK8          RK9         RK10         RK11         RK12
                          RK13           RK        MWOILL       MWOILH         MWIN
                             Z       RATHL        RATHG        RATLG        MWOIL
                             F        TIME          TIM        GOGTO            P
                            YY        YBAR            S           CH           CL
                             N        OBJ1         OBJ2       OBJCOM        NRATE
                           D9B        STEP           N1           N2           NP
                            .9         .36        .1000
```

– Continued

```
      SUBROUTINE PLOTTING
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION U(2),V(2),CBUR(100),GBUR(100),LBUR(100),IBUF(1000)
     1,RTEMP(100),RX(100),RS(100),QQQ(100),RZ(100),QP2(1),QP3(1),QP4(1),
     1RRR(1)
      TYPE REAL LBUR
      CALL PLOTS(IBUF,1000,28)
      CALL LIMITS(11.)
      PRINT 306
  306 FORMAT(40H1 PLOTTING IN PROGRESS                                  )
  307 N1=1
      N2=NDATA
      DO 303 I=1,NDATA
      GBUR(I)=PP(I,2)
      CBUR(I)=PP(I,3)
      LBUR(I)=PP(I,4)
  303 CONTINUE
      DXN=10.
      DYN=10.
      SY=5.
      SX=5.
      XO=10.
      YO=10.
      CALL AXIS(0.,0.,11H Y COMPUTED,-11,SX,0.,XO,DXN)
      CALL AXIS(0.,0.,11H Y OBSERVED,11,SY,90.,YO,DYN)
      U(1)=10.
      V(1)=10.
      U(2)=60.
      V(2)=60.
      CALL LINE(U,V,2,1,0,1, XO,DXN,YO,DYN)
      CALL LINE(LBUR, LBAR  ,NDATA,1,-1,4,XO,DXN,YO,DYN)
      CALL SYMBOL(.75,5.5,.14,29H FLUIDIZED DENSE BED CRACKING,0.,29 )
      CALL SYMBOL(.75,5.0,.14,29H LFO (430 - 650 F)            ,0.,29)
      CALL NXTPLT(SX)
      XO=5.
      YO=5.
      SY=5.
      SX=5.
      DXN=5.
      DYN=5.
      CALL AXIS(0.,0.,11H Y COMPUTED,-11,SX,0.,XO,DXN)
      CALL AXIS(0.,0.,11H Y OBSERVED,11,SY,90.,YO,DYN)
      U(1)=5.
      V(1)=5.
      V(2)=30.
      U(2)=30.
      CALL LINE(U,V,2,1,0,1, XO,DXN,YO,DYN)
      CALL LINE(CBUR, CBAR  ,NDATA,1,-1,4.XO,DXN,YO,DYN)
      CALL SYMBOL(.75,5.5,.14,29H FLUIDIZED DENSE BED CRACKING,0.,29)
```

– Continued

```
      CALL SYMBOL(.75,5.0,.14,29H C LUMP (C1 -C4 + COKE)        ,0.,29 )
      CALL NXTPLT(SX)
      XO=20.
      YO=20.
      SX=5.
      SY=5.
      DXN=10.
      DYN=10.
      CALL AXIS(0.,0.,11H Y COMPUTED,-11,SX,0.,XO,DXN)
      U(1)=20.
      V(1)=20.
      U(2)=70.
      V(2)=70.
      CALL AXIS(0.,0.,11H Y OBSERVED,11,SY,90.,YO,DYN)
      CALL LINE(U,V,2,1,0,1,XO,DXN,YO,DYN)
      CALL LINE(GBUR, GBAR  ,NDATA,1,-1,4,XO,DXN,YO,DYN)
      CALL SYMBOL(.75,5.5,.14,29H FLUIDIZED DENSE BED CRACKING,0.,29)
      CALL SYMBOL(.75,5.0,.14,29H C LUMP (C5 - 430 F)           ,0.,29)
      CALL NXTPLT(SX)
      MAM=N
      DO 117 J=1,NDATA
      RTEMP(J)=R(J,3)
C        RX OBSERVED C+G
C        RS CALCULATED C+G
      RX(J)=PP(J,2)+PP(J,3)
  117 CONTINUE
      DELSV=1
      NPOINT=39
      M=39
      DO 111 K=1,NP
      N=MAM
      NPART=3
      N1=K
      N2=K
      SINNN=.01
      SINNN=.09
      DO 159 J1=1,NPOINT
      IF(J1.LE.10) 501,503
  501 DELSV=.5
      GO TO 505
  503 DELSV=1.3
      DELSV=1.1
  505 CONTINUE
      R(K ,3)=SINNN
      CALL REACTR
      QQQ(J1)=R(K,3)*GOGTO(K)
      CBUR(J1)=CBAR(K)
      LBUR(J1)=LBAR(K)
      GBUR(J1)=GBAR(K)
      SINNN=SINNN+DELSV
  159 CONTINUE
      M=39
      DO 131 I=1,M
      RS(I)=GBUR(I)+CBUR(I)
  131 CONTINUE
      QP2(1)=PP(K,2)
```

– Continued

```
      QP3(1)=PP(K,3)
      QP4(1)=PP(K,4)
      RRR(1)=RR(K,3)
      N=39
      XO=0.
      YO=0.
      DXN=4.
      DYN=10.
      SX=12.5
      SY=10.
      SX=8.
      SY=5.
      DXN=5.
      DYN=20.
      CALL AXIS(0.,0.,20HYIELD WT. PERCENT    ,20,SY, 90.,YO,DYN)
      CALL AXIS(0.,0.,39HSPACE VELOCITY(WT OIL/WT CATALYST - HR),-39,SX,
     10., XO,DXN)
      CALL LINE( QQQ    ,LBUR,M,1,0,5,XO,DXN,YO,DYN)
      CALL LINE( QQQ    ,GBUR,M,1,0,4,XO,DXN,YO,DYN)
      CALL LINE( QQQ    ,CBUR,M,1,0,11,XO,DXN,YO,DYN)
      CALL LINE(RRR     ,QP2     , 1,1,-1,4,XO,DXN,YO,DYN)
      CALL LINE(RRR     ,QP3     , 1,1,-1,11,XO,DXN,YO,DYN)
      CALL LINE(RRR     ,QP4     , 1,1,-1,5,XO,DXN,YO,DYN)
      J=K
      CALL SYMBOL(1.,6.,.14,23HFLUID CATALYST CRACKING, 0.0,23)
      CALL SYMBOL(1.,5.5,.14,23HREACTOR TYPE            , 0.0,23)
      CALL SYMBOL(5.,6.,.14,PP(J,1),0.0,7)
      IF (RR(J,2)-2.)171,173,175
  171 CALL SYMBOL(3.0,5.5,.14,32HFLUIDIZED DENSE BED                ,0.,32)
      GO TO 179
  173 CALL SYMBOL(3.0,5.5,.14,31HLABORATORY RISER                   ,0.0,31)
      GO TO 179
  175 CALL SYMBOL(3.0,5.5,.14,31HPILOT PLANT                        ,0.0,31)
  179 CONTINUE
      CALL SYMBOL(.5,5.0,.14,5,0.0,-1)
      CALL SYMBOL(1.0,5.0,.14,18HL.F.O. (430-650 F),0.,18)
      CALL SYMBOL(4.5,5.0,.14,39HTC                    MIN
     1,0.,39)
      TC=RR(J,4)
      CALL NUMBER(6.0,5.,.14,TC      ,0.0,3)
      CALL SYMBOL(.5,4.5,.14,4,0.0,-1)
      CALL SYMBOL(1.0,4.5,.14,23HC5 GASOLINE (C5+ - 430),0.,23)
      CALL SYMBOL(4.5,4.5,.14,39HTEMP                   F
     1,0.,39)
      CALL NUMBER(6.0,4.5,.14,RR(J,7),0.0,3)
      CALL SYMBOL(1.0,4.0,.14,18HC-LUMP  C1-C4+COKE,0.,18)
      CALL SYMBOL(.5,4.0,.14,11,0.0,-1)
      CALL SYMBOL(4.5,4.0,.14,39HNITROGEN               MOLE PCT
     1,0.,39)
      CALL NUMBER(6.0,4.,.14,RR(J,5),0.0,3)
      CALL SYMBOL(4.5,3.5,.14,39HSTEAM                  WT PCT
     1,0.,39)
      CALL NUMBER(6.0,3.5,.14,RR(J,6),0.0,3)
      CALL SYMBOL(4.5,3.0,.14,39HPRESS                  PSIG
     1,0.,39)
      CALL NUMBER(6.0,3.,.14,RR(J,8),0.0,3)
```

– Continued

```
      CALL SYMBOL(4.5,2.5,.14,39HREGEN. CAT          LB C/LB CAT
     1,0.,39)
      CALL NUMBER(6.0,2.5,.14,RR(J,9),0.0,3  )
      SX=12.
  705 CALL NXTPLT(SX)
      XO=0.
      YO=0.
      DXN=20.
      SX=5.
      SY=5.
      DYN=20.
      CALL AXIS(0.,0.,14HCONVERSION     ,-14,SX,0.,XO,DXN)
      CALL AXIS(0.,0.,20HYIELD WT. PERCENT    ,20,SY. 90.,YO,DYN)
      CALL LINE( RS     ,LBUR,M,1,0,5,XO,DXN,YO,DYN)
      CALL LINE( RS     ,GBUR,M,1,0,4,XO,DXN,YO,DYN)
      CALL LINE( RS     ,CBUR,M,1,0,11,XO,DXN,YO,DYN)
      RZ(1)=RX(K)
      CALL LINE( RZ,GP2       ,1,1,-1,4,XO,DXN,YO,DYN)
      CALL LINE( RZ,GP3       ,1,1,-1,11,XO,DXN,YO,DYN)
      CALL LINE( RZ,GP4       ,1,1,-1,5,XO,DXN,YO,DYN)
      CALL SYMBOL(1.,6.,.14,23HFLUID CATALYST CRACKING, 0.0,23)
      CALL SYMBOL(1.,5.5,.14,23HREACTOR TYPE          , 0.0,23)
      CALL SYMBOL(5.,6.,.14,PP(J,1),0.0,7)
      IF (RR(J,2)-2.)191,193,195
  191 CALL SYMBOL(3.0,5.5,.14,32HFLUIDIZED DENSE BED          ,0.,32)
      GO TO 199
  193 CALL SYMBOL(3.0,5.5,.14,31HLABORATORY RISER            ,0.0,31)
      GO TO 199
  195 CALL SYMBOL(3.0,5.5,.14,31HPILOT PLANT                 ,0.0,31)
  199 CONTINUE
      SX=6.
      CALL NXTPLT(SX)
  111 CONTINUE
      CALL ENDPLT(SX)
      RETURN
      END
```

—Continued

```
SUBROUTINE      PLOTTING

                                IDENT     PLOTTING
RANGE                 FWA  -  LWA+1
                    32555     37442
ENTRY POINTS
                    36401  PLOTTING
EXTERNAL SYMBOLS
                    00001      PLOTS
                    00002     LIMITS
                    00003       AXIS
                    00004       LINE
                    00005     SYMBOL
                    00006     NXTPLT
                    00007     REACTR
                    00010     NUMBER
                    00011     ENDPLT
                    00012   Q8QINGOT
                    00013   Q8QENGOT
                    00014   Q8QGOTTY
                    00015   Q8QENTRY
     NO DOUBLY DEFINED                          000
     NO UNDEFINED SYMBOLS
     NO ASSEMBLY ERRORS
        NULLS                     BETA1       BETA2       BETA3       BETA4      NREACT
                                   RK8         RK9        RK10        RK11        RK12
                                  RK13          RK        MWOILL      MWOILH        MWIN
                                     Z       RATHL        RATHG       RATLG       MWOIL
                                    FF           F         TIME         TIM           P
                                    YY        YBAR            S          CH          CL
                                  OBJ1        OBJ2       OBJCOM       NRATE         D9B
                                  STEP        .307        .303        .117        .159
                                  .131        .705        .111    Q8QGOTTY

          END
                                END
EXECUTE.
```

PROGRAM NAMES

| | | | | | |
|---|---|---|---|---|---|
| 00000 | RESIDENT | 02113 | ERRDUMP* | 02746 | XITDUMP* |
| 41470 | MAIN | 41347 | Q1QRE NT | 41021 | Q1QSTORE |
| 40712 | MEMLEFT | 40706 | ABSF | 40651 | SQRTF |
| 40646 | Q80PAUSE | 37471 | Q80GINTY | 36333 | Q80GOTTY |
| 36163 | Q80ENTRY | 36146 | MEM | 36134 | Q80LOADA |
| 36062 | Q80IBJOB | 35575 | Q80FORMS | 02043 | REACTR |
| 34500 | POWRF | 34435 | EXPF | 31127 | DEXTRA |
| 31057 | MAX1F | 31045 | Q20LOADA | 31036 | FLOATF |
| 31016 | XFIXF | 76102 | GAUSS6 | 75702 | CONVERT |
| 75430 | FOXY | 74360 | OUTPUT | 67473 | PLOTTING |
| 21365 | PLOT470 | 21032 | AXIS | 20615 | LINE |
| 20577 | SYMBOL | 17643 | NUMBER | 17615 | INTF |
| 17517 | Q80TAPES | 17332 | Q80BUFFS | 17131 | SINF |
| 17043 | LOGF | 17003 | XTOI | | |

LABELED COMMON

| | | | | | |
|---|---|---|---|---|---|
| 63002 | FOXY | 52746 | GAUSS6 | 41504 | CONVERT |
| 41470 | SEARCH | | | | |

NUMBERED COMMON NONE

PROGRAM ENTRY POINTS

| | | | | | |
|---|---|---|---|---|---|
| 01263 | READ* | 01270 | WRITE* | 00737 | SELECT* |
| 01216 | REMOVE* | 01025 | DETECT* | 02072 | GETCH* |
| 02077 | CHKSTD* | 03175 | LOADER* | 03176 | RELOCOM* |
| 03147 | RELOAD* | 03063 | LIBREW* | 03002 | CLBMRCD* |
| 02737 | EXIT* | 02106 | ERROR* | 01252 | MODIRET* |
| 00463 | HCDBN* | 00371 | OPCOM* | 02340 | RECREF* |
| 02361 | RECLIM* | 00606 | FLAGTST* | 00253 | MEMREC* |
| 02051 | CBF* | 02052 | CBF1* | 02053 | CBF2* |
| 02060 | CBF7* | 00776 | IOSLECT* | 01577 | MR*600* |
| 05516 | LOK1* | 05114 | LMSRCH* | 01177 | ILMF* |
| 02061 | FCH* | 01112 | EXSEN* | 00223 | SETCLK* |
| 00130 | DATE* | 00063 | SIFOF* | 03055 | LIBPSIT* |
| 74317 | MAIN | 41351 | 01000100 | 41354 | 01001100 |
| 41357 | 03000140 | 41362 | 03001140 | 41430 | 03000040 |
| 41434 | 03001040 | 41363 | 01002100 | 41373 | 01003100 |
| 41367 | 03002140 | 41377 | 03003140 | 41435 | 03002040 |
| 41442 | 03003040 | 41403 | 01004100 | 41413 | 01005100 |
| 41407 | 03004140 | 41420 | 03005140 | 41447 | 03004040 |
| 41454 | 03005040 | 41201 | 01010000 | 41210 | 01010100 |
| 41216 | 01010200 | 41210 | 01010300 | 41202 | 01010400 |
| 41171 | 01010010 | 41151 | 01010110 | 41160 | 01010210 |
| 41151 | 01010310 | 41152 | 01010410 | 41135 | 01010020 |
| 41115 | 01010120 | 41125 | 01010220 | 41115 | 01010320 |
| 41105 | 01010420 | 41042 | 01010030 | 41052 | 01010130 |
| 41061 | 01010230 | 41075 | 01010330 | 41105 | 01010430 |
| 41021 | 03010040 | 41021 | 03010140 | 41021 | 03010240 |
| 41021 | 03010340 | 41021 | 03010440 | 41237 | 070LDDIC |
| 41251 | 070LDDRC | 41261 | 070LDDDC | 41270 | 070LDDCC |
| 41277 | 070LDDLC | 41314 | 070LDDID | 41323 | 070LDDRD |
| 41244 | 070FLOAT | 41241 | 070LDIC2 | 41253 | 070LDRC2 |
| 41264 | 070LDDC3 | 41273 | 070LDDC3 | 41303 | 070LDLC4 |

– Continued

—Continued

| | | | | | |
|---|---|---|---|---|---|
| 41316 | Q70LDID2 | 41325 | Q70LDRD2 | 40743 | MEMLEFT |
| 30460 | CONVERT | 35011 | REACTR | 40707 | ABSF |
| 40706 | ABS | 40706 | Q80ABSF | 40706 | Q80XABSF |
| 40707 | XABSF | 40706 | IABS | 40652 | SQRTF |
| 40651 | SQRT | 40651 | Q80SQRTF | 27564 | OUTPUT |
| 26075 | PLOTTING | 40647 | Q80STOPS | 40646 | Q80PAUSE |
| 37471 | Q80INGIN | 37555 | Q80GINTY | 40330 | Q80ENGIN |
| 36433 | Q80INGOT | 36410 | Q80GOTTY | 37250 | Q80ENGOT |
| 36163 | Q80ENTRY | 36166 | Q80EXITS | 36211 | Q80LPSEN |
| 36212 | Q80GNSET | 36215 | Q80PTSEN | 36216 | Q80PTSET |
| 36221 | Q80IOSEN | 36222 | Q80IOSET | 36225 | Q80GNSEN |
| 36244 | Q80LPSET | 36311 | Q80GNTAB | 36322 | Q80GTTAB |
| 36325 | Q80BUTAB | 36146 | HEX | 36134 | Q80LOADA |
| 35062 | Q80IBJOB | 35575 | Q80IFORM | 35615 | Q80FORMS |
| 36310 | Q80GLIST | 34502 | POWRF | 34501 | Q80POWRF |
| 34500 | Q2007111 | 34436 | EXPF | 34435 | EXP |
| 34435 | Q80EXPF | 30704 | GAUSS6 | 33726 | DEXTRA |
| 31057 | MAX1F | 31057 | AMAX1 | 31057 | XMAX0F |
| 31057 | MAX0 | 31062 | MAX0F | 31062 | AMAX0 |
| 31066 | XMAX1F | 31066 | MAX1 | 31072 | MIN1F |
| 31072 | AMIN1 | 31072 | XMIN0F | 31072 | MIN0 |
| 31075 | MIN0F | 31075 | AMIN0 | 31101 | XMIN1F |
| 31101 | MIN1 | 31045 | Q20LOADA | 31037 | FLOATF |
| 31036 | FLOAT | 31036 | Q80FLOAT | 30206 | FOXY |
| 31017 | XFIXF | 31016 | IFIX | 31016 | Q80XFIXF |
| 31017 | XINTF | 31016 | INT | 31016 | Q80XINTF |
| 21365 | PLOTS | 22046 | PLOT | 22043 | PLOTTT |
| 21446 | WHERE | 21427 | FACTOR | 22147 | LIMITS |
| 22165 | NXTPLT | 22206 | ENDPLT | 21032 | AXIS |
| 20415 | LINE | 20077 | SYMBOL | 17643 | NUMBER |
| [illegible] | INTF | 17615 | AINT | 17615 | Q80INTF |
| 17546 | Q80FILES | 17555 | Q80REWND | 17520 | Q80BACKS |
| 17332 | Q80INBFI | 17335 | Q80INBFO | 17461 | Q80HUNCH |
| 17473 | LENGTHF | 17147 | Q80SINF | 17131 | Q80COSF |
| 17150 | SINF | 17147 | SIN | 17132 | COSF |
| 17131 | COS | 17050 | LOGF | 17047 | ALOG |
| 17043 | LOG10F | 17047 | Q80LOGF | 17005 | XTOI |
| 17003 | Q2007110 | 17004 | Q80XTOI | | |

* * * * * * * * * * *

* AVAILABLE *
* MEMORY *
* 2426 *
* CELLS *

—Continued

| | G LUMP PRED | G LUMP OBS | C LUMP PRED | C LUMP OBS | LFO PRED | LFO OBS | AH | NH | PH | CH | AL | NL | PL | CL |
|---|---|---|---|---|---|---|---|---|---|---|---|---|---|---|
| *CMCOO | 46.70 | 46.97 | 15.88 | 15.13 | 24.58 | -0 | 1.17 | 2.36 | 2.98 | 6.33 | 2.75 | 3.91 | 7.39 | 10.54 |
| *CMCOO | 50.59 | 47.74 | 26.41 | 24.62 | 17.86 | -0 | .10 | .29 | .65 | 4.10 | 1.71 | 1.86 | 3.91 | 11.18 |
| *CMCOO | 43.52 | 49.16 | 12.51 | 11.84 | 27.02 | -0 | 1.97 | 3.69 | 4.17 | 7.12 | 3.08 | 5.16 | 8.60 | 10.17 |
| *CMCOO | 49.91 | 50.91 | 17.84 | 17.83 | 22.59 | -0 | .58 | 1.31 | 1.97 | 5.79 | 2.52 | 2.79 | 3.44 | 10.84 |
| *CMCOO | 29.56 | 29.50 | 11.81 | 10.24 | 29.67 | -0 | 5.82 | 9.04 | 7.37 | 7.53 | 3.07 | 7.76 | 9.62 | 9.23 |
| *CMCOO | 39.50 | 42.45 | 17.09 | 17.60 | 26.46 | -0 | 2.32 | 4.17 | 4.14 | 6.22 | 2.86 | 5.13 | 7.54 | 10.52 |
| *CMCOO | 44.75 | 40.54 | 23.98 | 20.56 | 22.37 | -0 | .64 | 1.49 | 1.95 | 4.81 | 2.33 | 2.89 | 5.89 | 11.26 |
| *CMCOO | 45.51 | 47.55 | 24.51 | 22.47 | 21.84 | -0 | .53 | 1.23 | 1.70 | 4.68 | 2.28 | 2.58 | 5.57 | 11.40 |
| *CMCOO | 28.12 | 28.76 | 8.96 | 8.26 | 30.93 | -0 | 6.27 | 9.76 | 7.97 | 7.99 | 3.24 | 8.39 | 10.29 | 9.01 |
| *CMCOO | 42.53 | 42.83 | 16.76 | 15.50 | 26.26 | -0 | 1.59 | 3.18 | 3.50 | 6.17 | 2.92 | 4.67 | 7.81 | 10.56 |
| T-4520 | 25.00 | 24.52 | 9.81 | 8.45 | 31.23 | -0 | 8.77 | 9.20 | 3.99 | 12.00 | 5.17 | 9.07 | 4.40 | 12.58 |
| T-4520 | 39.18 | 41.22 | 21.25 | 19.08 | 26.60 | -0 | 1.39 | 2.02 | 1.30 | 8.26 | 4.12 | 3.90 | 3.00 | 15.58 |
| T-4520 | 22.97 | 22.74 | 7.75 | 7.27 | 32.20 | -0 | 9.75 | 10.20 | 4.39 | 12.74 | 5.44 | 9.93 | 4.71 | 12.12 |
| T-4520 | 35.39 | 33.09 | 14.13 | 12.37 | 29.89 | -0 | 3.43 | 4.33 | 2.34 | 10.48 | 5.06 | 6.30 | 3.90 | 14.64 |
| T-4520 | 27.83 | 30.08 | 9.66 | 8.70 | 29.88 | -0 | 8.31 | 8.53 | 3.77 | 12.01 | 4.94 | 8.38 | 4.22 | 12.34 |
| T-4520 | 42.27 | 45.00 | 21.03 | 19.32 | 24.60 | -0 | 1.16 | 1.58 | 1.10 | 8.26 | 3.71 | 3.11 | 2.68 | 15.11 |
| T-4520 | 26.73 | 27.23 | 7.90 | 7.60 | 30.79 | -0 | 8.82 | 9.08 | 4.03 | 12.65 | 5.23 | 8.99 | 4.49 | 12.07 |
| T-4520 | 38.88 | 41.12 | 13.75 | 13.16 | 27.97 | -0 | 3.09 | 3.69 | 2.09 | 10.53 | 4.71 | 5.39 | 3.62 | 14.24 |

SE= 2.2628E 00 SE FOR TRIAL STEP= 2.2628E 00 PHI= 9.2168E 01 STEP SIZE= .1000

PARAMETERS

| | | | | | | | | | |
|---|---|---|---|---|---|---|---|---|---|
| 1.8510E 01 | 3.6300E 00 | 6.6150E 01 | 8.1840E 00 | 2.3850E 01 | 9.4400E 00 | 4.4000E 00 | 1.6215E 02 | 7.6000E-01 | 1.9900E 01 |
| 2.2500E 01 | 2.0700E 01 | 6.3000E 01 | 2.1000E 01 | 8.4700E 01 | 1.4870E 01 | 5.5000E 01 | 7.8500E 00 | 1.4630E 01 | 5.8630E 00 |
| 5.4000E 01 | 1.0000E 00 | 1.0000E 00 | 1.0000E 00 | 1.0000E 00 | 1.0000E 00 | 6.4420E 01 | -0 | -0 | 1.0000E 00 |
| 6.6000E-01 | 6.6000E-01 | 1.1000E 00 | 1.2800E 01 | 1.4500E 04 | 1.7500E 04 | 5.5000E 03 | 8.5000E 03 | 8.1000E 03 | 2.0000E 04 |

| AVERAGE ERRORS | | | STANDARD ERRORS | | |
|---|---|---|---|---|---|
| | C LUMP | LFO | G LUMP | C LUMP | LFO |
| [illegible] | 1.18E 00 | 2.68E 01 | 1.75E 00 | 1.44E 00 | 2.71E 01 |

* FCC-OPERATING CONDITIONS *

CHARGE STOCK WCMCGO

REACTOR TYPE-FLUIDISED DENSE BED OR FIXED BED

| | |
|---|---|
| WT OIL/HR/WT CATALYST | 4.750 |
| TRUE WHSV-WT FEED/HR/WT CATALYST | 4.802 |
| CATALYST RESIDENCE TIME MINUTES | 5.000 |
| NITROGEN-MOLE PCT | 10.000 |
| STEAM-WT PCT | -0 |
| REACTOR TEMPERATURE-DEG F | 906.000 |
| REACTOR PRESSURE-PSIG | -0 |
| CARBON ON REGEN CATALYST-WT PCT | -0 |

| * YIELDS * | OBSERVED WT PCT | PREDICTED WT PCT |
|---|---|---|
| C1 | .370 | .345 |
| C2 | .370 | .345 |
| C2= | .420 | .456 |
| C3 | 1.360 | 1.371 |
| C3= | 2.630 | 2.625 |
| NC4 | .910 | .976 |
| IC4 | 4.320 | 4.467 |
| C4= | 3.000 | 3.169 |
| NC5 | .480 | .452 |
| IC5 | 4.660 | 5.261 |
| C5= | 1.650 | 1.772 |
| C LUMP (C4- + COKE) | 15.130 | 15.880 |
| G LUMP (C5 -430 DEG F) | 46.970 | 46.699 |
| LFO (430-650 DEG F) | -0 | 24.583 |
| HFO (650+ ) | 37.900 | 12.838 |
| CARB ON CAT-WT PCT-VOORHEES | .585 | .677 |
| COKE WT PCT-VOORHEES | 1.700 | 1.968 |
| COKE WT PCT-CORRELATION | 1.700 | 2.203 |

We claim:

1. In the catalytic cracking of a feed stream having a multiplicity of hydrocarbons having various boiling ranges by contacting such hydrocarbons with an active hydrocarbon cracking catalyst under catalytic cracking conditions to convert said hydrocarbons to cracked product and to contaminate said catalyst with coke deposited thereon; and controlling the product produced responsive to the boiling range of said multiplicity of hydrocarbons; the improvement which comprises lumping said hydrocarbons both kinetically and according to boiling range as:

$P_l$ = Wt. % paraffinic molecules, (mass spec analysis), 430°–650°F $N_l$ = Wt. % naphthenic molecules, (mass spec analysis), 430°–650°F $C_{Al}$ = Wt. % carbon atoms among aromatic rings, (n-d-M method), 430°–650°F $A_l$ = Wt. % aromatic substituent groups (430°–650°F)

$P_h$ = Wt. % paraffinic molecules, (mass spec analysis), 650°F+

$N_h$ = Wt. % naphthenic molecules, (mass spec analysis), 650°F+

$C_{Ah}$ = Wt. % carbon atoms among aromatic rings, n-d-M method, 650°F+

$A_h$ = Wt. % aromatic substituent groups (650°F+) and wherein the yields of said products are lumped as:

G = G lump ($C_5$+ – 430°F)

C = C lump ($C_1$–$C_4$ + coke) and controlling the reaction conditions of said catalytic cracking reaction responsive to the invariant predetermined simultaneous and consecutive reactions characteristic of said proportions in said lumps to maximize yields therefrom.

2. The invention recited in claim 1 wherein said yields are gasoline, light fuel oil, and light ends + coke (C lump).

3. The invention recited in claim 1 wherein the lumps of hydrocarbons react in accordance with the following reaction rate constants:

MATRIX OF RATE CONSTANTS K

| | $P_h$ | $N_h$ |
|---|---|---|
| $P_h$ | $-(K_{phpl}+K_{phg}+K_{phc})$ | |
| $N_h$ | | $-(K_{nhnl}+K_{nhg}+K_{nhc})$ |
| $A_h$ | | |
| $C_{Ah}$ | | |
| $P_l$ | $V_{hl}\ K_{phpl}$ | |
| $N_l$ | | $V_{hl}\ K_{nhnl}$ |
| $A_l$ | | |
| $C_{Al}$ | | |
| G | $V_{hg}\ K_{phg}$ | $V_{hg}\ K_{nhg}$ |
| C | $V_{hc}\ K_{phc}$ | $V_{hc}\ K_{nhc}$ |

-continued

MATRIX OF RATE CONSTANTS K

| | $A_h$ | $C_{Ah}$ |
|---|---|---|
| $A_h$ | $-(K_{ahal}+K_{ahg}+K_{ahc}+K_{aheal})$ | |
| $C_{Ah}$ | | $-(K_{cahcal}+K_{cahc})$ |
| $P_l$ | | |
| $N_l$ | | |
| $A_l$ | $V_{hl}\ K_{ahal}$ | |
| $C_{Al}$ | $V_{hl}\ K_{aheal}$ | $V_{hl}\ K_{caheal}$ |
| G | $V_{hg}\ K_{ahg}$ | o |
| C | $V_{hc}\ K_{ahc}$ | $V_{hc}\ K_{cahc}$ |

| | $P_l$ | $N_l$ | $A_l$ |
|---|---|---|---|
| $P_l$ | $-(K_{plg}+K_{plc})$ | | |
| $N_l$ | $-(K_{nlg}+K_{nlc})$ | | |
| $A_l$ | | $-(K_{nlg}+K_{nlc})$ | |
| $C_{Al}$ | | | |
| G | $V_{lg}\ K_{plg}$ | $V_{lg}\ K_{nlg}$ | $V_{lg}\ K_{alg}$ |
| C | $V_{lc}\ K_{plc}$ | $V_{lc}\ K_{nlc}$ | $V_{lc}\ K_{alc}$ |

| | $C_{Al}$ | G | C |
|---|---|---|---|
| $C_{Al}$ | $-K_{calc}$ | | |
| G | o | $-K_{gc}$ | |
| C | $V_{lc}\ K_{calc}$ | $V_{gc}\ K_{gc}$ | o |

where, $V_{hl}$ = Stoichiometric coefficient (Mol. Wt. of heavy fuel oil/Mol. Wt. of light fuel oil)

$V_{hg}$ = Stoichiometric coefficient (Mol. Wt. of heavy fuel oil/Mol. Wt. of gasoline)

$V_{hc}$ = Stoichiometric coefficient (Mol. Wt. of heavy fuel oil/Mol. Wt. of C lump)

$V_{lg}$ = Stoichiometric coefficient (Mol. Wt. of light fuel oil/Mol. Wt. of gasoline)

$V_{lc}$ = Stoichiometric coefficient (Mol. Wt. of light fuel oil/Mol Wt. of C lump)

$V_{gc}$ = Stoichiometric coefficient (Mol. Wt. of gasoline/Mol. Wt. of C lump).

4. The invention recited in claim 1 wherein the decay of the catalyst is dependent only on the concentration of the lump $C_{AH}$ = Wt. % carbon atoms among aromaic rings, n-d-M method, 650°+ and on the catalyst residence time.

5. The invention recited in claim 1 wherein said yields include the detailed composition of the light and heavy fuel oil fractions of the lumps $P_l$, $N_l$, $C_{Al}$, $A_l$, $P_h$, $N_h$, $C_{Ah}$, and $A_h$.

6. The invention recited in claim 1 further comprising lumping said hydrocarbons both kinetically and according to boiling range in a linear combination which produces an indication of the amount of coke deposited on the catalyst independent of the hydrocarbon composition of the feed stock.

* * * * *

UNITED STATES PATENT OFFICE

CERTIFICATE OF CORRECTION

Patent No. 3,960,707 Dated June 1, 1976

Inventor(s) Benjamin Gross et al. Page 1 of 2

It is certified that error appears in the above-identified patent and that said Letters Patent are hereby corrected as shown below:

olumn 3, line 9, "as" should read -- a --.

olumn 6, lines 43 and 44, "$\overline{MW}$ = mean molecular weight of the mixture $= \sum_j a_j$" should read -- $\overline{MW}$ = mean molecular weight of the mixture $= \sum_j a_j$ --.

olumn 6, line 61, the equation

"$\frac{1}{1+BtY_c}$" should read -- $\frac{1}{1+\beta tY_c}$ -- olumn 9, line 62, "mode" should read -- model --.

olumn 10, line 32, "decreased" should read -- decreases --.

olumn 11, line 52, in the phrase "to be the" omit -- be --.

olumn 12, line 31, "the Basic" should read -- The Basic --.

olumn 12, line 39, "($\eta$=1)" should read -- ($\theta$=1) --.

olumn 13, line 27, in the equation, "$L^1$ =" should read -- $L^i$ = --.

olumn 14, line 3, the equation should read $$-- C = \frac{a}{100}\left(\frac{t_c}{5.0}\right)^{0.2} --.$$

olumn 14, line 61, "scaler" should read -- scalar --.

olumn 15, line 26, delete "kinetics".

olumn 16, line 40, "maximum" should read -- minimum --.

UNITED STATES PATENT OFFICE

CERTIFICATE OF CORRECTION

Patent No. 3,960,707 Dated June 1, 1976

Inventor(s) Benjamin Gross et al. Page 2 of 2

It is certified that error appears in the above-identified patent and that said Letters Patent are hereby corrected as shown below:

Column 16, Appendix I, under column "Roman", the second item "a" should read -- $\underset{\sim}{a}$ --; the fourteenth item "K" should read -- $\underset{\approx}{K}$ --; and the seventeenth item "MW" should read -- $\overline{MW}$ --.

Column 17, line 58, "$\left(\frac{\delta pa_j}{\delta t_c}\right)$" should read -- $\left(\frac{\delta pa_j}{\delta t_c}\right)_x$ --.

Column 19, line 6 should read --$\left(\frac{\delta pa_j}{\delta t_c}\right)_x$ --.

Column 19, line 41, "not linear because MW" should read -- not linear because $\overline{MW}$ --.

Column 20, line 35, "give a as" should read -- give $\underset{\sim}{a}$ as --.

line 47, "a(W)" should read -- $\underset{\sim}{a}$(W) --.

Column 81, line 43, "MATRIX OF RATE CONSTANTS K" should read -- MATRIX OF RATE CONSTANTS $\underset{\approx}{K}$ --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*